US011590548B2

(12) United States Patent
Sweeney

(10) Patent No.: US 11,590,548 B2
(45) Date of Patent: Feb. 28, 2023

(54) POWERED BENDER

(71) Applicant: ECM Industries, LLC, New Berlin, WI (US)

(72) Inventor: Matthew W. Sweeney, Ringwood, IL (US)

(73) Assignee: ECM Industries, LLC, New Berlin, WI (US)

( * ) Notice: Subject to any disclaimer, the term of this patent is extended or adjusted under 35 U.S.C. 154(b) by 4 days.

(21) Appl. No.: 17/017,762

(22) Filed: Sep. 11, 2020

(65) Prior Publication Data

US 2021/0069766 A1 Mar. 11, 2021

Related U.S. Application Data

(60) Provisional application No. 63/058,952, filed on Jul. 30, 2020, provisional application No. 62/899,031, filed on Sep. 11, 2019.

(51) Int. Cl.
*B21D 7/06* (2006.01)

(52) U.S. Cl.
CPC ..... *B21D 7/06* (2013.01)

(58) Field of Classification Search
CPC ..... B21D 7/02; B21D 7/022; B21D 7/024; B21D 7/06; B21D 11/00; B21D 7/021
See application file for complete search history.

(56) References Cited

U.S. PATENT DOCUMENTS 1,891,861 A * 12/1932 Wright ..... B21D 7/024 72/218
2,569,544 A * 10/1951 Tal ..... B21D 7/022 72/219
2,863,490 A 12/1958 Bank
2,921,619 A 1/1960 Bank
3,908,425 A 9/1975 Ware
3,921,424 A 11/1975 Pearson
(Continued)

FOREIGN PATENT DOCUMENTS

CH 580995 A 10/1976
DE 4319591 A1 10/1994
(Continued)

OTHER PUBLICATIONS

REMS, "Curvo," Instruction Manual for REMS Akku-Curvo 22V, REMS Curvo, REMS Curvo 50, REMS Akku-Curvo, and REMS Sinus, dated Apr. 12, 2017 (201 pages).
(Continued)

*Primary Examiner* — Teresa M Ekiert
(74) *Attorney, Agent, or Firm* — Wood Herron & Evans LLP

(57) ABSTRACT

An assembly for bending a conduit and a portable conduit bender. The assembly may generally include a portable bender including a base having a base surface supportable on a work surface, a housing supported by the base and defining a housing axis, the housing including a handle engageable by an operator to carry the bender, and a shoe supported by the housing for pivoting movement about the housing axis, the shoe defining a channel for supporting a conduit to be bent; and a pipe threader removably supported by the housing, the threader being operable to pivotably drive the shoe relative to the housing to bend the conduit.

13 Claims, 43 Drawing Sheets

(56) References Cited

U.S. PATENT DOCUMENTS

| | | | | |
|---|---|---|---|---|
| 3,949,584 | A | 4/1976 | Pearson et al. | |
| 4,052,875 | A | 10/1977 | Sakamoto | |
| 4,532,787 | A | 8/1985 | Caporusso et al. | |
| 4,546,632 | A | 10/1985 | Van Den Kiebook et al. | |
| 4,981,030 | A | 1/1991 | Caporusso et al. | |
| 4,986,104 | A | 1/1991 | Caporusso et al. | |
| 5,056,347 | A * | 10/1991 | Wagner | B21D 7/024 72/157 |
| 5,921,132 | A | 7/1999 | Froehlich | |
| 6,026,668 | A | 2/2000 | Oda et al. | |
| 7,024,905 | B1 * | 4/2006 | Carlson | B21D 7/022 72/217 |
| 7,500,372 | B2 * | 3/2009 | Caporusso | B21D 7/024 72/149 |
| 7,900,495 | B2 | 3/2011 | Latoria | |
| 9,358,593 | B1 | 6/2016 | Hopper | |
| 9,718,108 | B2 | 8/2017 | Latoria | |
| 2006/0174672 | A1 * | 8/2006 | Caporusso | B21D 7/024 72/149 |
| 2008/0190164 | A1 | 8/2008 | Boon et al. | |
| 2009/0188291 | A1 | 7/2009 | Itrich et al. | |
| 2016/0074918 | A1 | 3/2016 | Latoria | |

FOREIGN PATENT DOCUMENTS

| | | | |
|---|---|---|---|
| DE | 10128738 | A1 | 1/2003 |
| DE | 212012000199 | U1 | 7/2014 |
| EP | 0611611 | A1 | 8/1994 |
| EP | 0822018 | A1 | 2/1998 |
| EP | 1095716 | A1 | 5/2001 |
| EP | 1095716 | B1 | 12/2003 |
| FR | 1257737 | A | 4/1961 |
| FR | 2474902 | A1 | 8/1981 |
| FR | 2574685 | A1 | 6/1986 |
| WO | 2013068013 | A2 | 5/2013 |

OTHER PUBLICATIONS

REMS, "Curvo," Spare Parts List dated May 2019, <https://www.rems.de/batv/tv%5Ccurvo/TV%20REMS%20Curvo%20-%20Stand%202020-03a%20Web.pdf> (4 pages).

REMS, "Curvo 50," Spare Parts List dated Sep. 2018, <https://www.rems.de/batv/tv%5Ccurvo-50/TV%20REMS%20Curvo%2050%20-%20Stand%202020-03%20Web.pdf> (3 pages).

Rothenberger, "Robend 3000," Instruction Manual, dated Feb. 2007 (15 pages).

Rothenberger, "Robend 3000 No. 025740X_025741X," Spare Parts List dated Mar. 2018 (3 pages).

Rothenberger, "Robend 4000," Instruction Manual, dated Jul. 4, 2016 (44 pages).

Rothenberger, "Robend 4000 No. 1000001559," Spare Parts List, dated Feb. 2019 (3 pages).

Greenlee Textron Inc., "Service Manual 555 Series Electric Benders," 2013 (20 pages).

* cited by examiner

POWERED BENDER

RELATED APPLICATIONS

The present application claims the benefit of U.S. Patent Application No. 62/899,031, filed Sep. 11, 2019, and U.S. Patent Application No. 63/058,952, filed Jul. 30, 2020, the entire contents of both of which are hereby incorporated by reference.

FIELD

The present invention generally relates to a conduit bender and, more particularly, to a powered bender.

SUMMARY

Conduit is used to protect electrical wiring and provides a rigid member for pliable wires to extend through and connect components located on opposite ends of the conduit. Conduit is also used in plumbing lines, gas and compressed air lines, food, pharmaceutical, petrochemical operations, etc. In such operations, solids (e.g., wires) or fluids (e.g., water) pass through the conduit or pipe. In many applications, conduit is bent at least once to extend between the components to be connected.

Conduits of various sizes and materials are used based on design requirements for a given application. A conduit (of a material and size) may be selected based on, for example, the number and size of wires to pass through the conduit, environmental factors regarding the location of the conduit, the number and radius of bends to connect the electrical components, etc.

There are a number of standards for installation of wiring and conduit. For example, Underwriters Laboratories 797, American National Standards Institute C80.3, and National Fire Protection Agency 70 (i.e., National Electrical Code) provide requirements for the manufacturing, size, use, bending of conduit in construction. Other standards for conduits and pipes include, but are not limited to, the following: UL 6 Electrical Rigid Metal Conduit—Steel; UL 6A Electrical Rigid Metal Conduit—Aluminum, Red Brass, and Stainless; UL 797 Electrical Metal Tubing—Steel; UL 797A Electrical Metallic Tubing—Aluminum and Stainless Steel; UL 1242 Electrical Intermediate Metal Conduit—Steel; ANSI/ASME B36.10M Welded and Seamless Steel Pipe; ANSI/ASME 36.19M—Stainless Steel Pipe. Other related standards may apply.

Conduit bending tools provide utility when they are able to make bends with the conduit oriented level to a support surface (e.g., the ground). An operator, knowing the exact starting configuration of the conduit, can make an accurate bend with the bending tool without having to make an adjustment of the desired bend. Thus, the resulting bending operation requires less time and effort, saving time and money.

For example, for some bends, such as kick bends, it is desirable to bend the conduit in a vertical direction relative to a level work surface. This allows the conduit to be inclined from the work surface to provide an additional measurement to confirm that the bend is appropriate for the given application.

For other bending jobs, it may be desirable to bend a conduit in a horizontal direction (e.g., parallel to the work surface). A conduit bending tool that is operable in a number of different orientations (e.g., to bend a conduit in a vertical direction or in a horizontal direction) may be desirable.

Conduit bending tools should be usable by many operators (e.g., require a reasonable amount of force for operation and transport). Manual bending tools require significant force and associated torque to provide bends for certain size/material conduit which some operators are not able to supply. This inhibits certain operators from using such manual bending tools.

Existing motorized bending tools permit use by operators who cannot power the manual bending tools. However, such motorized bending tools are typically heavy and/or require wheeled structures for transport between and around jobsites.

In one independent aspect, an assembly for bending a conduit may be provided. The assembly may generally include a portable bender and a pipe threader. The bender may include a base having a base surface supportable on a work surface, a housing supported by the base and defining a housing axis, the housing including a handle engageable by an operator to carry the bender, and a shoe supported by the housing for pivoting movement about the housing axis, the shoe defining a channel for supporting a conduit to be bent. The pipe threader may be removably supported by the housing, the threader being operable to pivotably drive the shoe relative to the housing to bend the conduit.

In another independent aspect, a portable conduit bender may generally include a base supportable on a work surface; a housing defining a housing axis and supported for movement relative to the base to adjust a position of the housing axis relative to the base; a roller supported by the housing and extending along a roller axis parallel to the housing axis, the roller having a roller surface; and a shoe supported by the housing for pivoting movement about the housing axis, the shoe defining a first channel for supporting a first conduit up to a first diameter and a second channel for supporting a different second conduit up to a second diameter, the second diameter being greater than the first diameter. The housing may be movable relative to the base to selectively align one of the first channel and the second channel relative to the roller surface to support a corresponding one of the first conduit and the second conduit between the roller surface and the one of the first channel and the second channel. The shoe may be pivotable about the housing axis to bend the corresponding one of the first conduit and the second conduit when supported by the shoe.

In yet another independent aspect, a portable bender may generally include a base supportable on a work surface; a housing supported by the base, the housing including a hollow spindle having an outer surface and defining a housing axis; and an annular shoe extending from an inner surface supported by the outer surface of the spindle for pivoting movement about the housing axis, the shoe defining a channel for supporting a conduit to be bent, the shoe being pivotable about the housing axis to bend the conduit.

In a further independent aspect, a conduit bender may generally include a base having a base surface; a housing supported by the base and defining a housing axis; a roller supported by the housing and defining a roller axis, the roller having a roller surface operable to support a portion of a conduit to be bent; and a shoe supported by the housing for pivoting movement about the housing axis, the shoe defining a channel for supporting another portion of the conduit, the shoe including a first portion defining a radially-inner channel surface and a second portion providing a radially-outer surface, the shoe being pivotable about the housing axis to bend the conduit. At least one of the housing and the roller may be supported for relative movement to arrange a line intersecting the roller surface and the radially-outer surface to be substantially parallel to the base surface.

In some constructions, the housing is pivotable about the roller axis relative to the base to arrange the line to be substantially parallel to the base surface. The bender may include a mounting plate connecting the housing and the base, and the housing may be fixed to the base via the mounting plate at a desired angular position. In the desired angular position, a distance between a first line intersecting the radially-inner surface of the channel and parallel to the base surface and a second line intersecting the roller surface and parallel to the base surface is substantially equal to a diameter of the conduit.

In another independent aspect, a conduit bender may generally include a base having a base support surface; a housing supported by the base; a shoe supported by the housing for pivoting movement to bend a conduit; and a support member defining a member support surface extending transverse to the base support surface. The bender may be selectively and alternatively supported and operated to bend a conduit in a first configuration on the base surface and in a second configuration on the member support surface.

In some constructions, the support member may include a number of legs connected to the housing. The housing may define a housing axis, and the legs may extend parallel to the housing axis.

In yet another independent aspect, a conduit bender may generally include a base; a housing supported by the base and defining a housing axis; a shoe supported by the housing for pivoting movement about the housing axis to bend a conduit; and a drive mechanism operable to pivotably drive the shoe, the drive mechanism including an input drive shaft having a shaft axis and supporting a spur gear and a ring gear meshed with the spur gear, the shaft axis being offset from the housing axis.

In a further independent aspect, a conduit bender may generally include a base; a housing supported by the base and having a spindle defining a housing axis, the spindle defining an open central space; a shoe supported by the spindle for pivoting movement about the housing axis to bend a conduit; and a drive mechanism operable to pivotably drive the shoe, the drive mechanism including an input drive shaft having a shaft axis offset from the housing axis.

In another independent aspect, a conduit bender may generally include a base; a housing supported by the base and defining a housing axis; a shoe supported by the housing for pivoting movement about the housing axis to bend a conduit; and a pipe threader removably supportable by the housing and operable to drive the shoe.

In yet another independent aspect, a conduit bender assembly may generally include a base; a housing supported by the base and defining a housing axis; a shoe supported by the housing for pivoting movement about the housing axis to bend a conduit; a pipe threader operable to pivotably drive the shoe; and a remote pendant in communication with the pipe threader and operable to control the pipe threader to drive the shoe.

In a further independent aspect, a conduit bender may generally include a base; a housing supported by the base and defining a housing axis; a shoe supported by the housing for pivoting movement about the housing axis to bend a conduit; a drive member operable to pivot the shoe; a pipe threader removably supportable by the housing and operable to drive the shoe through the drive member; and an adapter removably supportable between the drive member and the pipe threader to transmit driving motion of the pipe threader to drive the shoe.

Other independent aspects of the disclosure may become apparent by consideration of the detailed description, claims and accompanying drawings.

DETAILED DESCRIPTION

Figure 1:
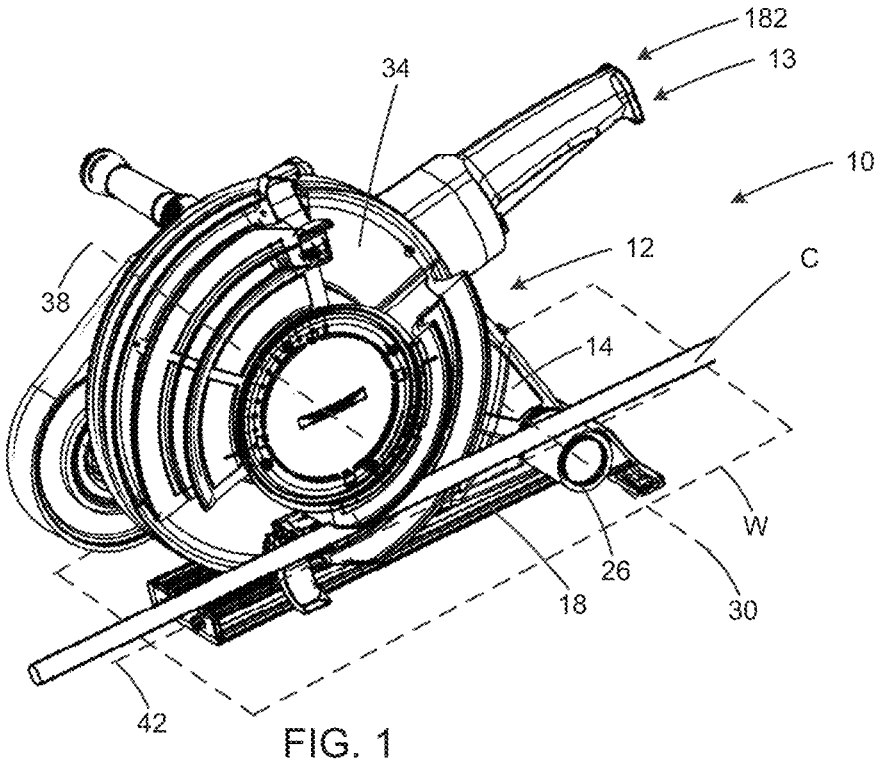
FIG. 1 is a perspective view of a conduit bender assembly including a bender powered by a motor, such as a motorized device, a pipe threader, etc., and illustrated in a first (e.g., vertical) orientation relative to a work surface.
Figure 2:
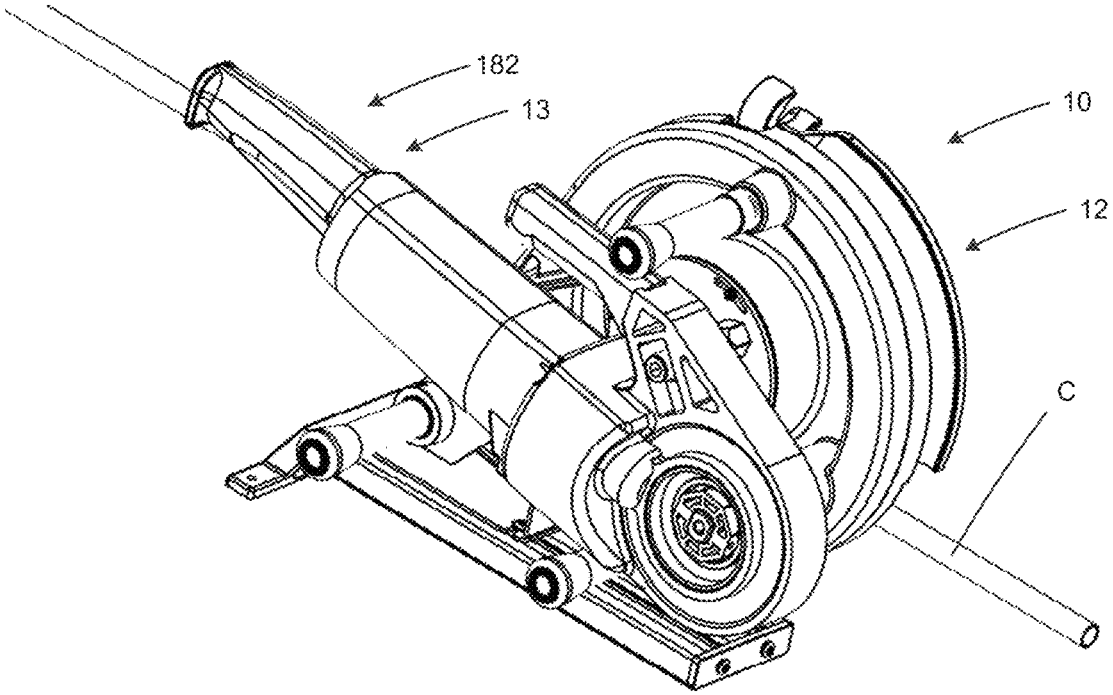
FIG. 2 is a rear perspective view of the bender assembly as shown in FIG. 1.
Figure 3:
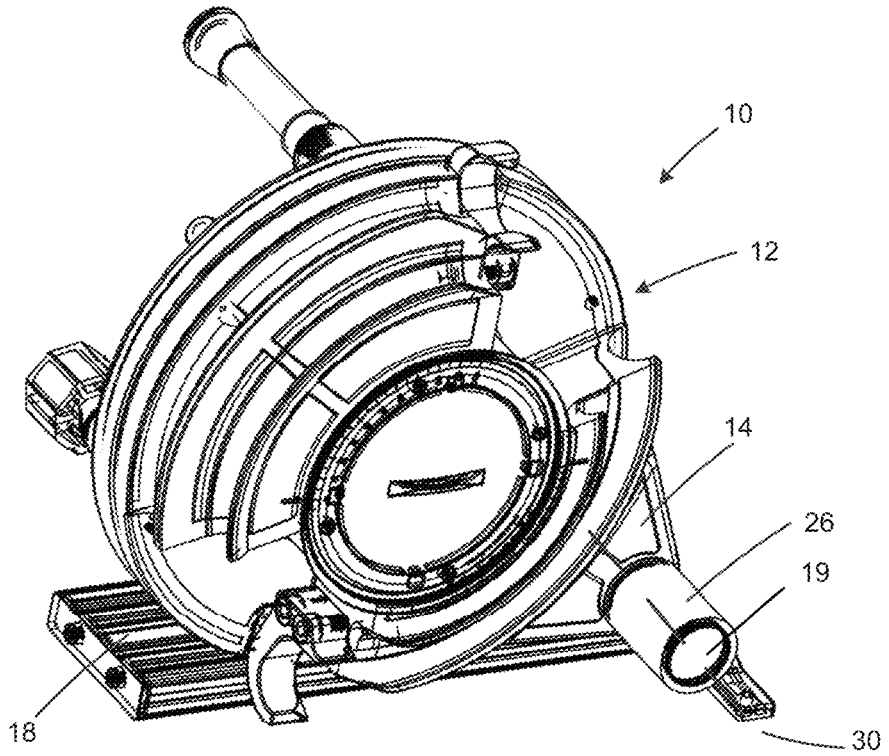
FIG. 3 is a front perspective view of the bender shown in FIG. 1.
Figure 4:
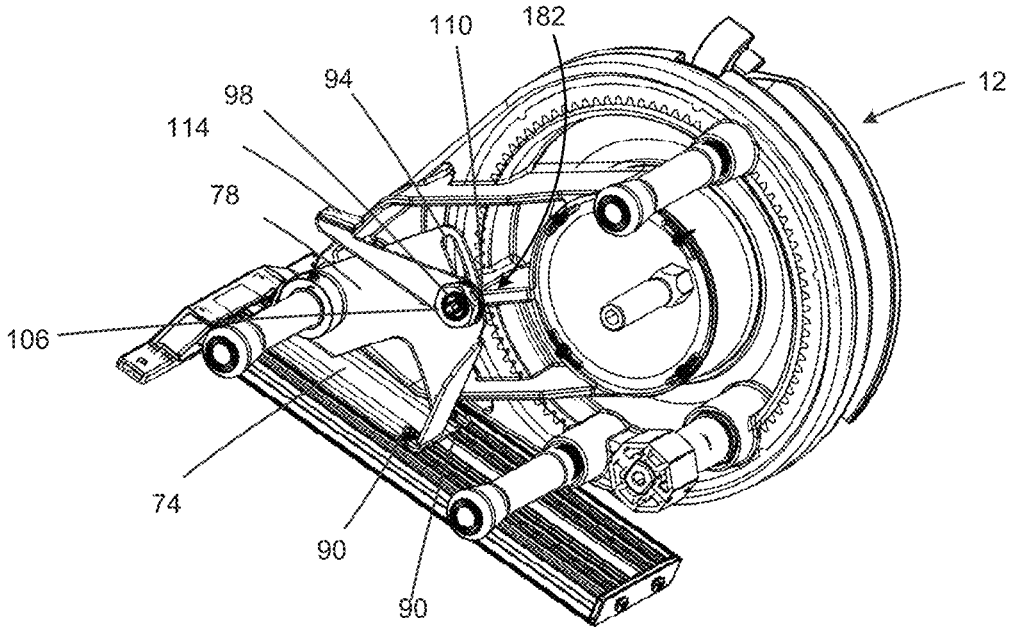
FIG. 4 is a rear perspective view of the bender shown in FIG. 3, illustrated with the housing removed.
Figure 5:
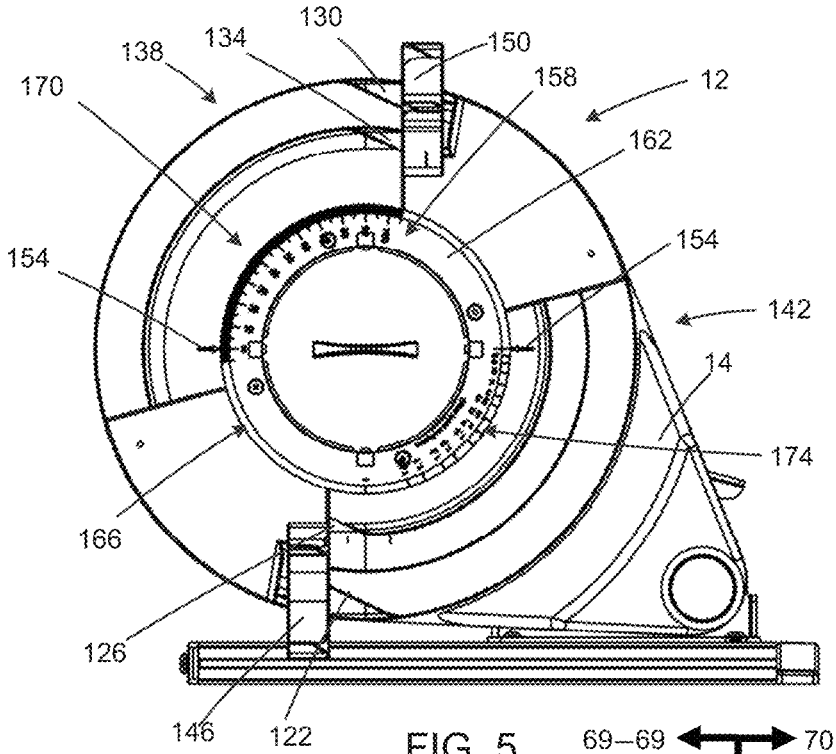
FIG. 5 is a front view of the bender shown in FIG. 3.
Figure 6:
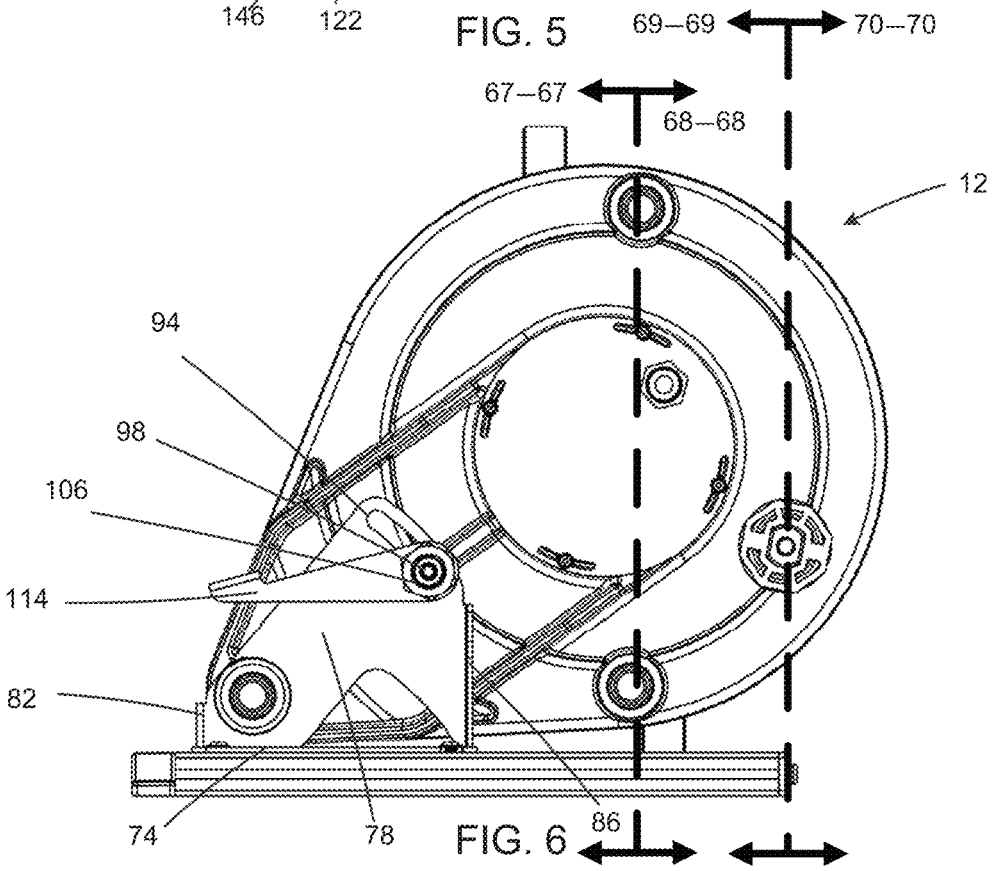
FIG. 6 is a rear view of the bender shown in FIG. 3.
Figure 7:
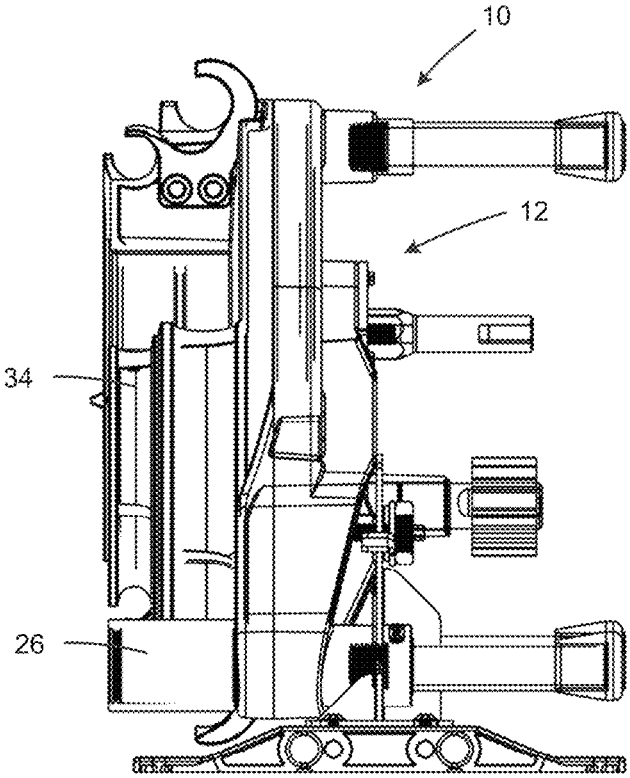
FIG. 7 is a side view of the bender shown in FIG. 3.
Figure 8:
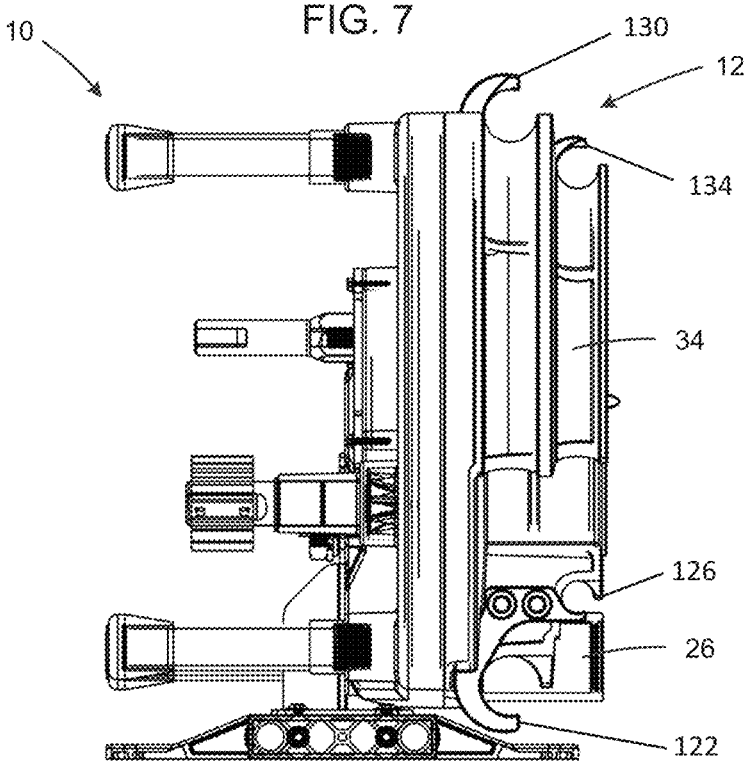
FIG. 8 is an opposite side view of the bender shown in FIG. 3.
Figure 9:
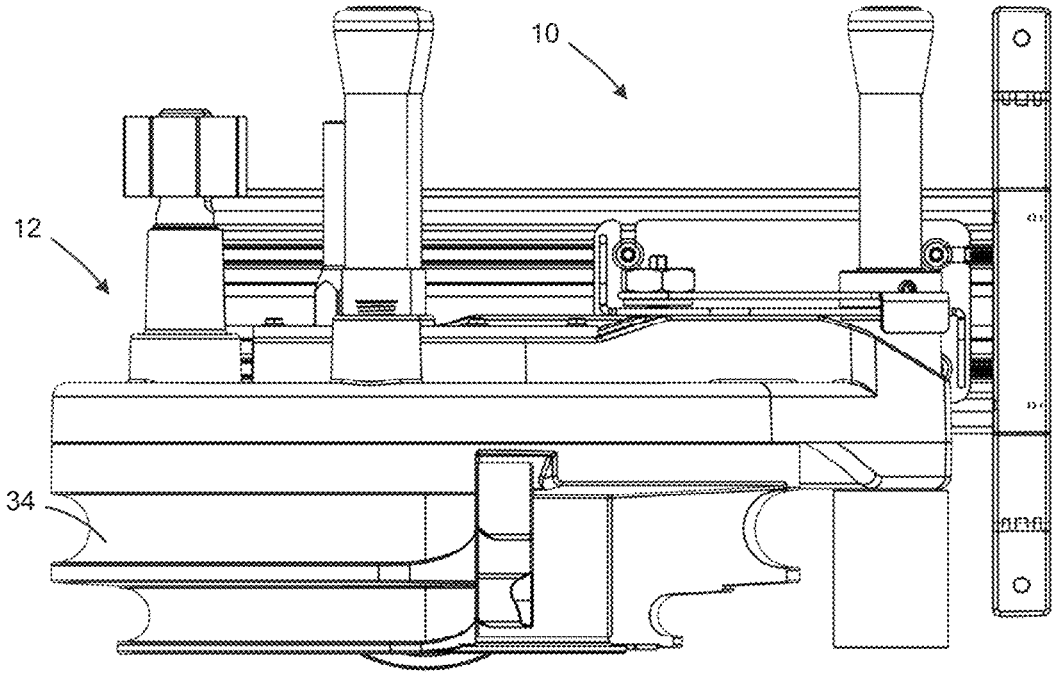
FIG. 9 is a top view of the bender shown in FIG. 3.
Figure 10:
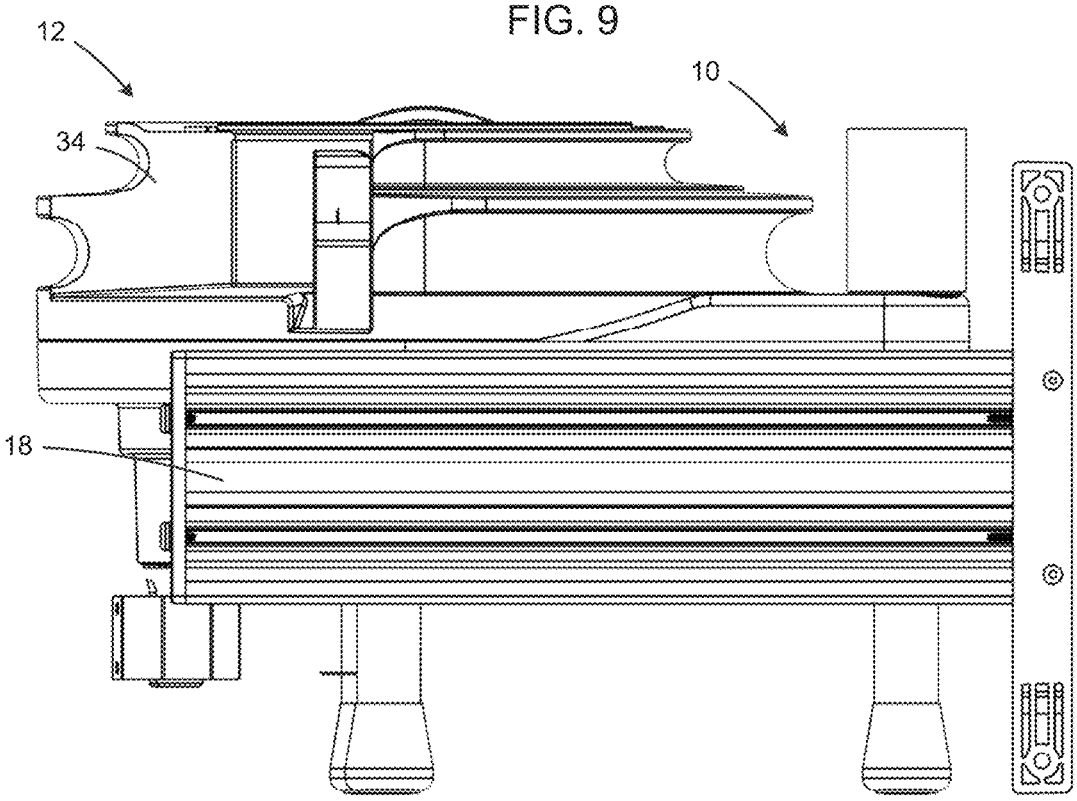
FIG. 10 is a bottom view of the bender shown in FIG. 3.

Before any independent embodiments of the invention are explained in detail, it is to be understood that the invention is not limited in its application to the details of construction and the arrangement of components set forth in the following description or illustrated in the following drawings. The invention is capable of other independent embodiments and of being practiced or of being carried out in various ways. Also, it is to be understood that the phraseology and terminology used herein is for the purpose of description and should not be regarded as limiting.

Use of "including" and "comprising" and variations thereof as used herein is meant to encompass the items listed thereafter and equivalents thereof as well as additional items. Use of "consisting of" and variations thereof as used herein is meant to encompass only the items listed thereafter and equivalents thereof. Unless specified or limited otherwise, the terms "mounted," "connected," "supported," and "coupled" and variations thereof are used broadly and encompass both direct and indirect mountings, connections, supports, and couplings.

Relative terminology, such as, for example, "about", "approximately", "substantially", etc., used in connection with a quantity or condition would be understood by those of ordinary skill to be inclusive of the stated value and has the meaning dictated by the context (for example, the term includes at least the degree of error associated with the measurement of, tolerances (e.g., manufacturing, assembly, use, etc.) associated with the particular value, etc.). Such terminology should also be considered as disclosing the range defined by the absolute values of the two endpoints. For example, the expression "from about 2 to about 4" also discloses the range "from 2 to 4". The relative terminology may refer to plus or minus a percentage (e.g., 1%, 5%, 10% or more) of an indicated value.

Also, the functionality described herein as being performed by one component may be performed by multiple components in a distributed manner. Likewise, functionality performed by multiple components may be consolidated and performed by a single component. Similarly, a component described as performing particular functionality may also perform additional functionality not described herein. For example, a device or structure that is "configured" in a certain way is configured in at least that way but may also be configured in ways that are not listed.

It should also be noted that a plurality of hardware and software-based devices, as well as a plurality of different structural components may be used to implement the embodiments. In addition, it should be understood that embodiments may include hardware, software, and electronic components or modules that, for purposes of discussion, may be illustrated and described as if the majority of the components were implemented solely in hardware. However, one of ordinary skill in the art, and based on a reading of this detailed description, would recognize that, in at least one embodiment, the electronic-based aspects of the invention may be implemented in software (for example, stored on non-transitory computer-readable medium) executable by one or more processors. As such, it should be noted that a plurality of hardware and software-based devices, as well as a plurality of different structural components may be utilized to implement the invention. For example, "control units" and "controllers" described in the specification can include one or more processors, one or more memory modules including non-transitory computer-readable medium, one or more input/output interfaces, and various connections (for example, a system bus) connecting the components.

For ease of description, some or all of the example systems presented herein are illustrated with a single exemplar of each of its component parts. Some examples may not describe or illustrate all components of the systems. Other example embodiments may include more or fewer of each of the illustrated components, may combine some components, or may include additional or alternative components.

A powered bender assembly 10 is illustrated in the figures. In some aspects, the bender assembly 10 may be operable to bend a number of different types of conduits having different bending requirements (e.g., with an adjustable shoe having multiple channels) and, for each type of conduit, may be adjustable to orient a supported conduit C to be level relative to a work surface W. The bender assembly 10 is operable to bend conduits used in electrical construction, plumbing, gas, or compressed air lines, food, pharmaceutical or petrochemical industries, etc. The bender assembly 10 may include a bend indicator that is adjustable to "zero" the indicator (e.g., to accommodate adjustment of the bender assembly 10), select between different bend angle measurement indications.

In some aspects, the bender assembly 10 may be operable to bend a conduit C in multiple different orientations relative to a work surface W (e.g., a vertical orientation and a horizontal orientation). The bender assembly 10 may include an adjustable support assembly operable between an extended support position and a retracted position.

In some aspects, the bender assembly 10 may have a drive input which is offset from the pivot axis of the bender assembly 10. The drive mechanism (e.g., a ring gear driven by a spur gear) of the bender may be arranged with an open central space to house various components, tools, material, etc.

The bender assembly 10 is relatively lightweight and compact when compared to existing powered benders and manual benders (e.g., considering the size and weight of the components of the manual benders required to provide the same bending capabilities of the bender assembly 10).

Figure 33:
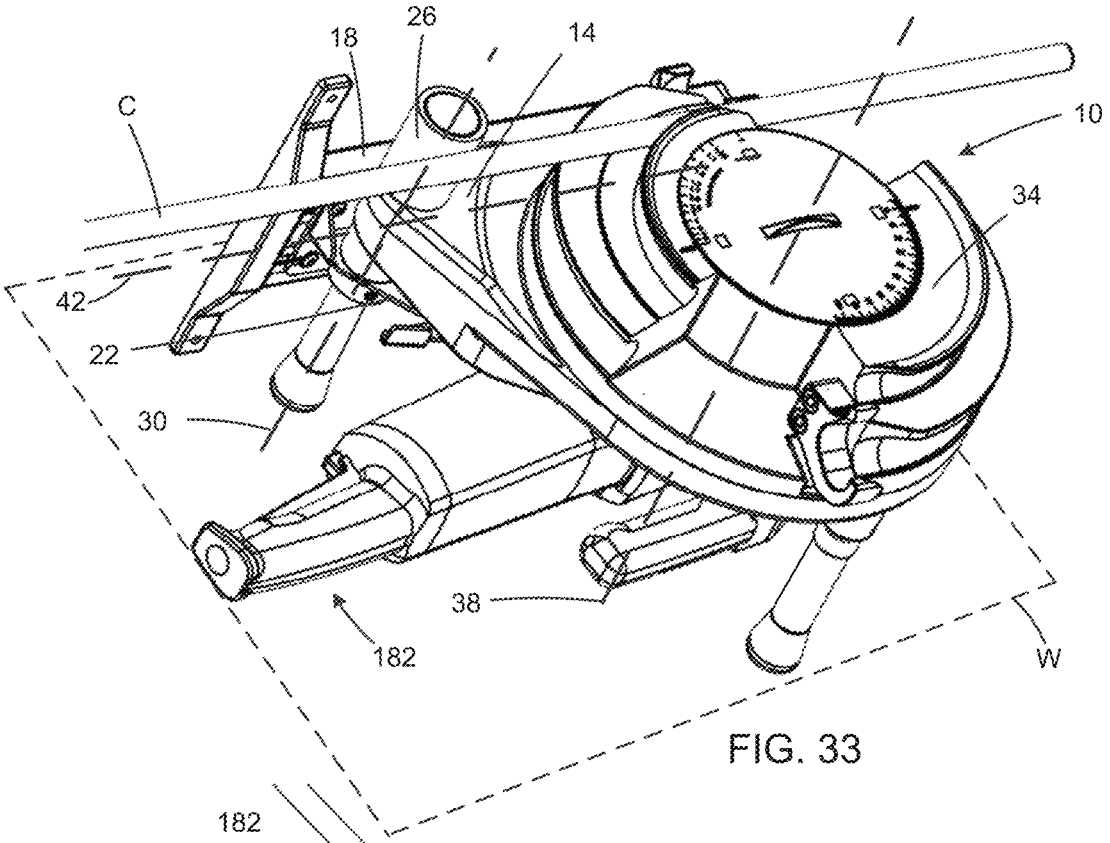
FIG. 33 is a top perspective view of the bender assembly shown in FIG. 1, illustrated in a second (e.g., horizontal) orientation on a work surface.
Figure 34:
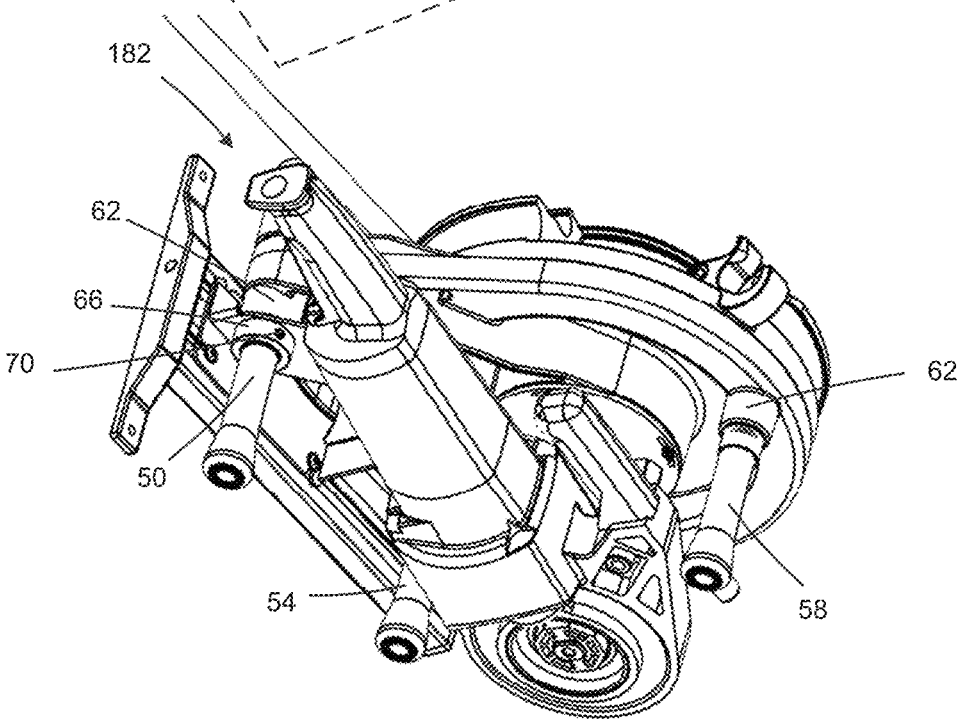
FIG. 34 is a bottom perspective view of the bender assembly as shown in FIG. 33.
Figure 35:
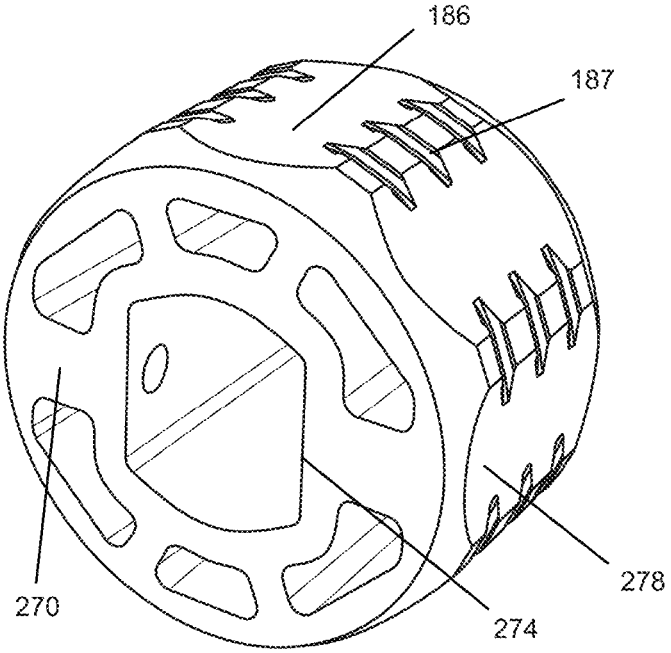
FIG. 35 is a perspective view of a primary adapter.
Figure 36:
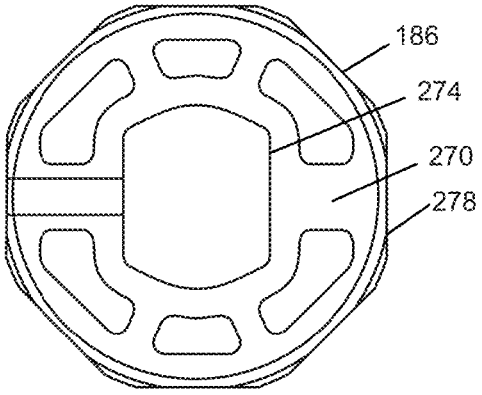
FIG. 36 is an end view of the primary adapter shown in FIG. 35.
Figure 37:
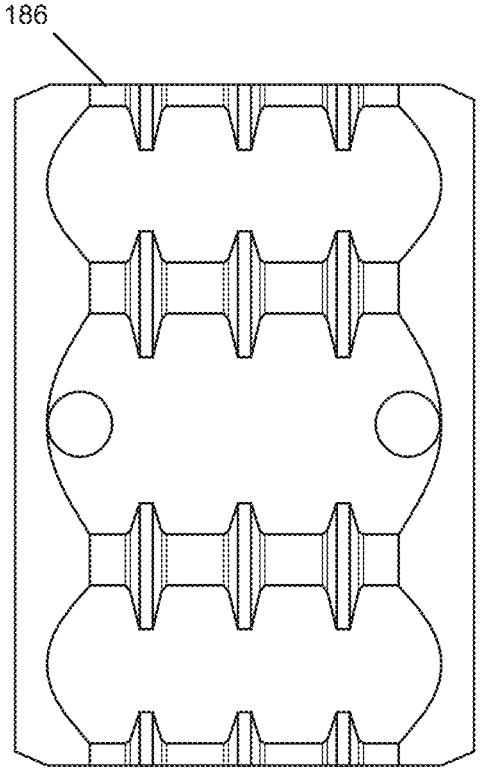
FIG. 37 is a side view of the primary adapter shown in FIG. 35.
Figure 38:
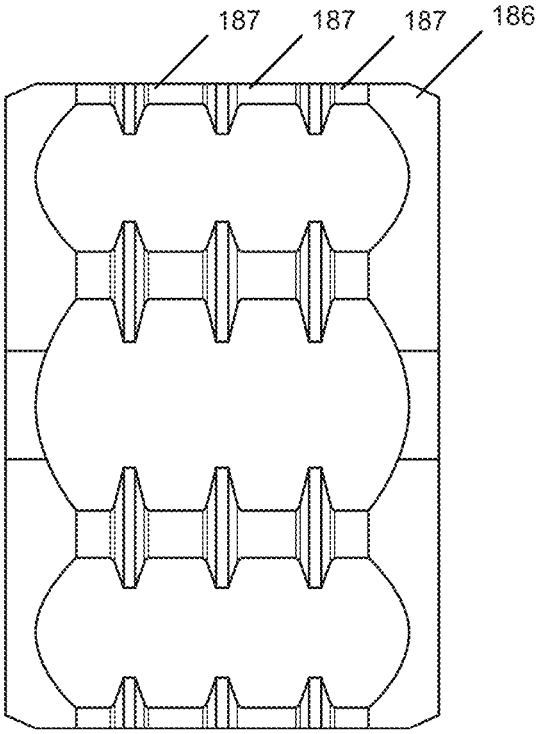
FIG. 38 is a view of another side of the primary adapter shown in FIG. 35.

FIGS. 1-32 illustrate a powered bender assembly 10 in one orientation (e.g., a vertical orientation) with respect to a work surface W. FIGS. 33-34 illustrate the bender assembly 10 in a different orientation (e.g., a horizontal orientation) with respect to the work surface W. The illustrated bender assembly 10 includes a combination of a bender 12 and a power mechanism 13 (e.g., a portable, motorized pipe threader 182, an on-board motor (not shown), etc.).

A pipe threader 182 is commonly used on the jobsite and is a convenient and economical power mechanism for the bender assembly 10. Because the pipe threader 182 is removable, the size and weight of the bender 12 itself is reduced, and these components can be separated for transport. Also, after use to power the bender 12, the pipe threader 182 may be used to thread the bent conduit C.

The bender 12 includes a housing 14 and a base 18 movably connected by a mounting plate 22. In the illustrated construction, a hollow cylindrical portion 19 on the housing 14 extends through a hole in the plate 22 to pivotably connect the housing 14 and the base 18. A roller 26 is supported on the portion 19 which defines a roller axis 30. The illustrated arrangement of the portion 19 on the housing 14 results in a simple rigid construction. A driven shoe 34 engages the housing 14 for pivoting movement relative to the housing 14 about a housing axis 38. In the illustrated embodiment, the axes 30, 38 are parallel to each other and extend transverse to a longitudinal axis 42 of the base 18.

The housing 14 and the shoe 34 are adjustable (e.g., pivotable) relative to the base 18 such that the housing axis 38 is adjustable relative to the base axis 42 between a number of positions for bending of different types of conduit C (e.g., different size, material, etc.). In the illustrated embodiment, the roller axis 30 is fixed relative to the base 18 and the base axis 42 and defines a pivot axis of the housing 14 and the shoe 34 relative to the base 18.

In other constructions (not shown), the roller axis 30 may not be fixed relative to the base 18 and may not define the pivot axis of the housing 14 and the shoe 34 relative to the base 18. In such constructions, the roller axis 30 and the roller 26 may be adjustable relative to the base 18.

The roller 26 may include (see FIGS. 51-52) a conduit engagement groove 27 which may serve to spread the load during bending over a larger surface area to inhibit damage to the plastic roller 26 and/or to a thin-walled conduit C. The roller 26 "floats" (e.g., is slidable along the portion 19) to align the groove 27 with the conduit C. A conduit C engages both the shoe 34 and the conduit engagement groove 27 of the roller 26.

In the vertical orientation (see FIGS. 1-32), the bender assembly 10 is supported on a work surface W via the base 18. In this orientation, the bender assembly 10 is operable to bend the conduit C in a plane perpendicular to the work surface W.

The illustrated bender 12 also includes a number of (three shown) laterally-extending legs 50, 54, 58 which extend parallel to the axis 30, 38. In the horizontal orientation (see FIGS. 33-34), the housing 14 is supported on the work surface W via legs 50, 54, 58 and with the base 18 spaced from the work surface W. The housing 14 may include (see FIG. 55) ribs 46 extending between, the legs 50, 54, 58, and the wall defining the open space 242 of the housing 14. The support ribs 46 also extend between, the wall defining the open space 242 of the housing 14 and the exterior of the housing 14. The leg(s) 50, 54, 58 may be used as a handle to transport the bender assembly 10 to, from or around a jobsite. To facilitate carrying, an ergonomic gripping member (not shown) may be provided on a leg (e.g., on the leg 58).

The illustrated legs 50, 54, 58 are threaded and received by corresponding threaded leg receiving portions 62 of the housing 14. Each illustrated leg 50, 54, 58 is dimensioned to be provided by or replaced with a length of threaded ¾" conduit C. Such threaded conduit C may be readily available to an operator due to the bender assembly 10 being capable of bending ¾" conduit C and a pipe threader 182 being usable as the power mechanism 13. The illustrated legs 50, 54, 58 are removable for example, for storage or replacement but, in other constructions (not shown), may be non-removable. In other embodiments (not shown), the legs 50, 54, 58 and the leg receiving portions 62 may be dimensioned larger or smaller than ¾" conduit.

The legs 50, 54, 58 may be formed of machined steel, injection molded glass-filled nylon, or another suitable material. Injection molded glass-filled nylon legs 50, 54, 58 may be cheaper than machined steel legs while still being able to support the housing 14 and be threaded to engage the threaded leg portions 62.

One leg 50 engages a leg receiving portion 62 and the mounting plate 22 and is aligned along the roller axis 30. As shown in FIG. 34, a collar 66 and a set screw 70 retain the mounting plate 22 between the leg 50 and the housing 14. In another construction (see FIG. 52), the leg 50 is an injection-molded part and has a shoulder engaging the mounting plate 22. A cap 51 is fixed to (e.g., glued to) the end of the leg 50.

The mounting plate 22 includes portions 74, 78, 82, 86. The first portion 74 extends parallel to the base 18 and includes openings 90 to receive fasteners to connect to the base 18. The second portion 78 extends substantially perpendicular to the first portion 74, is retained with the set screw 70 between the leg 50 and the housing 14 and defines an arcuate slot 94. The third and fourth portions 82, 86 extend between and are substantially orthogonal to the first and second portions 74, 78 and provide additional support to the mounting plate 22.

The mounting plate 22 may be formed integrally as one piece including the portions 74, 78, 82, 86 or may be assembled from two or more separate pieces. In the illustrated embodiment, the mounting plate portions 78, 82, 86 are integrally formed as a unit and mechanically fastened (e.g., welded) to the first portion 74.

A rod 98 protrudes from receiving portion 102 of the housing 14 and through the arcuate slot 94 of the mounting plate 22. A nut 106, a washer 110 and a lever 114 are supported on the rod 98. The lever 114 is operable to selectively tighten (a locking condition) and loosen (a release condition) the clamping engagement of the mounting plate 22 between the nut 106 and the washer 110 on one side and the housing 14 on the opposite side. In the release condition, the rod 98 is movable in the slot 94 and the housing 14 is movable relative to the base 18 (e.g., pivotable about the roller axis 30 in the illustrated construction). In the locking condition, the rod 98 and the mounting plate 22 are releasably fixed to retain the housing 14 in a selected position relative to the base 18.

In other constructions (not shown), another type of locking arrangement may be provided to releasably retain the housing 14 in a selected position. For example, additionally or alternatively, a positive locking arrangement (e.g., a selectively engageable detent arrangement) may include a projection engageable in one or more recesses, each corresponding to a selected position of the housing 14.

In a given position of the housing 14 relative to the base 18, a distance or clearance 118 is defined in a direction perpendicular to the base axis 42 between a line parallel to the axis 42 intersecting a surface (e.g., an upper surface in the vertical orientation) of the roller 26 supporting a portion of a conduit C and a line parallel to the axis 42 and intersecting a portion (e.g., a channel surface) of the shoe 34 supporting another portion of the conduit C. The clearance 118 is adjustable by adjusting the position of the housing 14 (and the supported shoe 34) relative to the base 18. When adjusted to an appropriate position, the clearance 118 will be substantially equal to a diameter of a supported conduit C.

Figure 20:
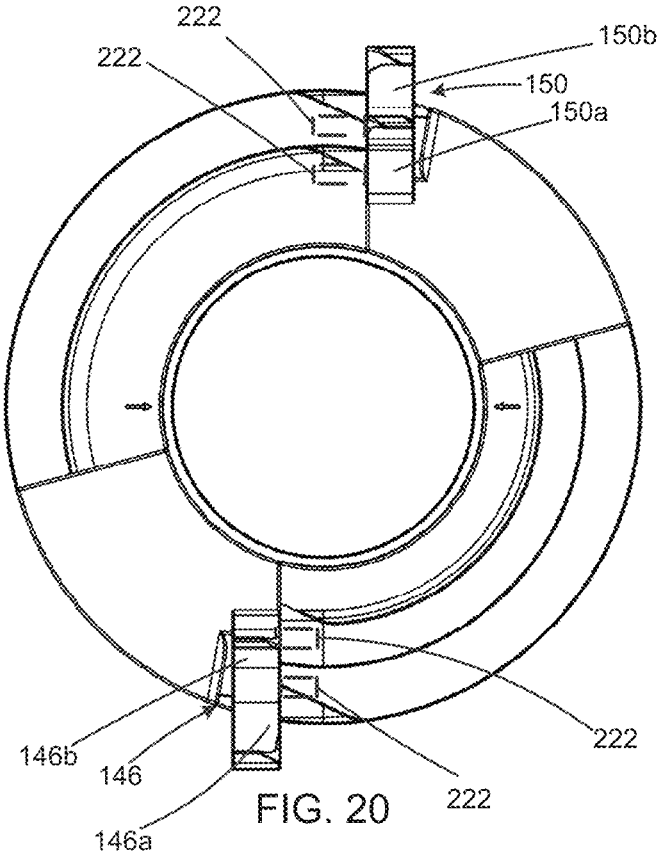
FIG. 20 is a front view of the shoe as shown in FIG. 1.
Figure 21:
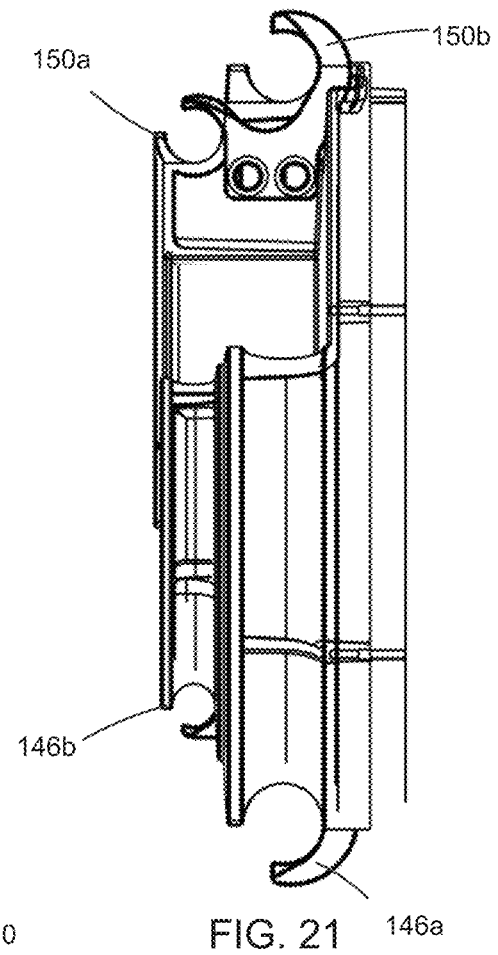
FIG. 21 is a side view of the shoe shown in FIG. 20.

FIGS. 20-21 illustrate the shoe 34 in more detail. The shoe 34 may be formed of aluminum (e.g., cast A380-F aluminum as illustrated). In other embodiments, the shoe 34 is formed of a different material, such as, for example, A356-T6 aluminum, cast iron, a zinc-aluminum alloy (e.g., ZA-27), steel, etc. In the illustrated construction, the shoe 34 is annular and defines a number of (four in the illustrated construction) grooves or channels 122, 126, 130, 134 dimensioned to fit various sizes of conduit C. The channels 122, 126 are formed integrally in a first segment 138 of the shoe 34, and the channels 130, 134 are formed integrally in an opposite second segment 142 of the shoe 34. The channels 122, 126 and 130, 134 in each pair are spaced apart along the housing axis 38.

A first shoe hook 146 is mounted to the shoe 34 proximate an end of the first segment, and a second shoe hook 150 is mounted to the shoe 34 proximate an end of the second segment 142. Holes 222 in the shoe 34 receive fasteners to connect the shoe hooks 146, 150 to the shoe 34. In some embodiments, the fasteners may include a bolt and a nut that engage the holes 222. In other embodiments, the holes 222 may be tapped such that threads of the holes 222 engage fasteners received in the shoe 34 and the shoe hooks 146, 150.

The shoe 34 may be "roughly" adjusted (e.g., pivoted about 180° by the drive mechanism 178 or manually if a clutch is provided) relative to the housing 14 to bring a segment 138 or 142 into an "operational" position to bend a given conduit C. In the operational position, the conduit C supportable in each channel 122, 126 or 130, 134 of the operational segment 138, 142, respectively, may be bent by operation of the bender assembly 10 (e.g., by pivoting movement of the shoe 34 and the hook 146, 150 relative to the housing 14).

Each channel 122, 126, 130, 134 has a radial inner channel surface intersected by the line defining the upper extent (in the vertical orientation) of the clearance 118. The hook 146 defines a hook surface **146*a*, 146*b* associated with each channel 122, 126 to define a radial outer surface proximate the channel 122, 126. The hook 150 defines a hook surface 150*a*, 150*b* associated with each channel 130, 134 to define a radial outer surface proximate the channel 130, 134**.

The distance between the channel surface of a channel 122, 126 and 130, 134 and the corresponding hook surface 146*a*, 146*b* and 150*a*, 150*b* of the associated hook 146, 150, respectively, is substantially equal to the diameter of the conduit C to be supported in the channel 122, 126, 130, 134 and to the clearance between the channel surface and the roller surface when the housing 14 is adjusted to the appropriate position for a given conduit C. In such a position, the corresponding hook surface 146*a*, 146*b* or 150*a*, 150*b* will be aligned with the roller surface along a line parallel to the base axis 42. The roller 26 cooperates with each channel 122, 126, 130, 134 to support an associated conduit C to be bent and does not require adjustment or replacement for use of the bender 12.

whether bending is possible and, if not, moved to another channel 122, 126, 130, 134 appropriate for bending.

In the illustrated embodiment, each channel 122, 126, 130, 134 is dimensioned to allow for manufacturing tolerances in the conduit C and the bending shoe 34. The UL standards listed above allow the diameter to vary ±0.005" for EMT and ±0.015" for RMC. In the illustrated embodiment, the channel 126 measures 0.716"—which is 0.01" larger than the 0.706" outer diameter of an EMT conduit of a ½" in. trade size. Likewise, the channel 134 measures 0.932", the channel 130 measures 1.173", and the channel 122 measures 1.335". Other adjustments may be made to the size of each channel 122, 126, 130, 134 to account for manufacturing tolerances.

TABLE 1

| | Channel 126 | | Channel 134 | | Channel 130 | | Channel 122 | |
|---|---|---|---|---|---|---|---|---|
| | Trade Size (in.) | Outer Diameter (in.) | Trade Size (in.) | Outer Diameter (in.) | Trade Size (in.) | Outer Diameter (in.) | Trade Size (in.) | Outer Diameter (in.) |
| IMC | N/A | N/A | ½ | 0.815 | ¾ | 1.029 | 1 | 1.290 |
| RMC | N/A | N/A | ½ | 0.840 | ¾ | 1.050 | 1 | 1.315 |
| Steel Pipe | ⅜ | 0.675 | ½ | 0.840 | ¾ | 1.050 | 1 | 1.315 |
| Stainless Steel Pipe | ⅜ | 0.675 | ½ | 0.840 | ¾ | 1.050 | 1 | 1.315 |
| PVC Coated RMC | N/A | N/A | ½ | 0.920 | ¾ | 1.130 | N/A | N/A |
| EMT | ½ | 0.706 | ¾ | 0.922 | 1 | 1.163 | N/A | N/A |

As illustrated, the bender assembly 10 is operable to bend conduits C of different materials, types, sizes, for example, due to the multiple channels 122, 126, 130, 134 of the shoe 34, the adjustability of the housing 14 relative to the base 18 to provide a number of clearances 118, etc. The illustrated bender assembly 10 is operable to bend at least intermediate metal conduit (IMC), rigid (i.e., galvanized steel) conduit (RMC), electrical metallic tubing (EMT) conduit, etc., of certain nominal sizes used for electrical wiring.

The bender assembly 10 is also capable of bending conduits formed of other materials, such as, Polyvinyl Carbonate (PVC) coated RMC, carbon steel pipe used for plumbing, gas lines, or compressed air lines, stainless steel pipe used in food, pharmaceutical, or petrochemical industries. The following is a non-exhaustive listing of standards for conduits and pipes that the bender assembly 10 can bend: UL 6 Electrical Rigid Metal Conduit—Steel; UL 6A Electrical Rigid Metal Conduit—Aluminum, Red Brass, and Stainless; UL 797 Electrical Metal Tubing—Steel; UL 797A Electrical Metallic Tubing—Aluminum and Stainless Steel; UL 1242 Electrical Intermediate Metal Conduit—Steel; ANSI/ASME B36.10M Welded and Seamless Steel Pipe; ANSI/ASME 36.19M—Stainless Steel Pipe. Other related standards for conduits and pipes may apply.

Table 1 below illustrates various type(s) and nominal size(s) of conduit C to be supported and bent in the specified channel 122, 126, 130, 134 of the shoe 34. Other combinations of conduit C size and material may be bent in a given channel 122, 126, 130, 134. Table 1 also notes the actual outer diameter of each nominal conduit size. It should be understood that, in other constructions (not shown), the bender assembly 10 may be constructed to bend conduits of materials, types, sizes, etc., other than those listed. It should also be understood that, in other constructions (not shown), the bender assembly 10 may be constructed such that the channel(s) 122, 126, 130, 134 are capable of engaging and bending conduit C of a non-standard size. A conduit C may be positioned in a channel 122, 126, 130, 134 to determine An indicator arrangement is provided to indicate a bend measurement. Indicia 154 (e.g., a line, an arrow, etc.) on the shoe 34 is alignable with indicia 158 (e.g., a line, an arrow, text, etc.) on a face plate 162 supported by the housing 14. As the bender assembly 10 is operated, the indicia 154, 158 are brought into alignment to indicate a bend measurement.

The illustrated faceplate 162 includes different types of indicia (e.g., angular indicia 170 and "bend multiplier" indicia 174), each type cooperating with the indicia 154 on the shoe 34 to indicate a bend measurement. Depending on a given bending job, an operator may want to reference one indicia rather than the other. For example, in kick bends in which a conduit C is bent to avoid an obstacle and then bent back to its original axis, bending multipliers are commonly used to avoid calculation of exact bending angles. The indicia 154, 158 allow simultaneous indication of bend angle and bend multiplier such that an operator can cross-check the measurement, if desired. Common bending multipliers are provided on the multiplier indicia 174. Table 2 below lists some corresponding bend angles and bend multipliers which may be indicated with the indicia 154, 158.

TABLE 2

| Offset Bend Multipliers | |
|---|---|
| Bend Angle (°) | Multiplier |
| 10 | 6 |
| 22.5 | 2.6 |
| 30 | 2 |
| 45 | 1.4 |
| 60 | 1.2 |

In the illustrated construction, the faceplate 162 is selectively movably supported by the housing 14. During bending operations, to provide the bend indication, the faceplate 162 is fixed with and remains stationary relative to the housing 14 while the shoe 34 pivots. As desired by the operator (e.g., to select a set of indicia (bend angle or bend multiplier) to be used) or for accurate indication of the bending operation, the faceplate 162 is pivoted relative to the housing 14 and the shoe 34 to relatively orient the indicia 158, 162. Once in the selected position, the faceplate 162 is again fixed to the housing 14 (e.g., by a frictional and/or positive locking engagement). The illustrated faceplate 162 is also removably mounted to an annular portion the housing 14, as discussed below in more detail.

In another embodiment (not shown), an auxiliary device may be supported for movement with the shoe 34 (e.g., mounted to the shoe 34). The auxiliary device may include a mechanical level or measurement device or an electronic device, such as, for example, a smart phone, a tablet, etc. Such an electronic device may include a level which can provide another bend measurement and indication to the operator. The level can be zeroed or reset when a conduit C is supported for bending, and, as the conduit C is bent, the level will indicate the amount of bend with respect to the zeroed position. By initially being zeroed, the level accounts for any angular adjustment if the conduit C is not level.

A drive mechanism 178 pivotably drives the shoe 34 relative to the housing 14 and the roller 26 to bend a conduit C. The drive mechanism 178 may be driven by an on-board motor or, as illustrated, by an external motorized device, such as, for example, a portable pipe threader 182, a drill, etc. The motor, if provided, or the motorized device may be powered by an external power source (e.g., AC line power) or by a supported power source (e.g., a battery, an engine, etc.).

Figure 39:
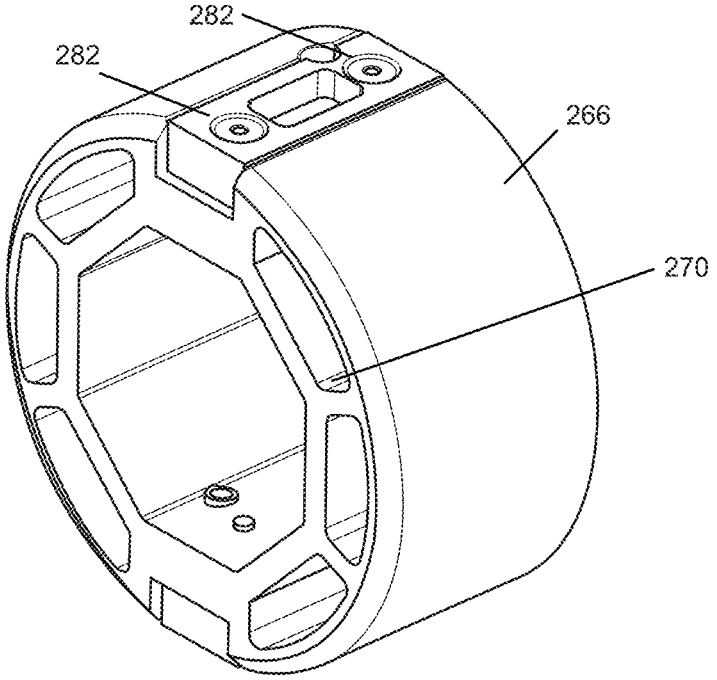
FIG. 39 is a perspective view of a secondary adapter.
Figure 40:
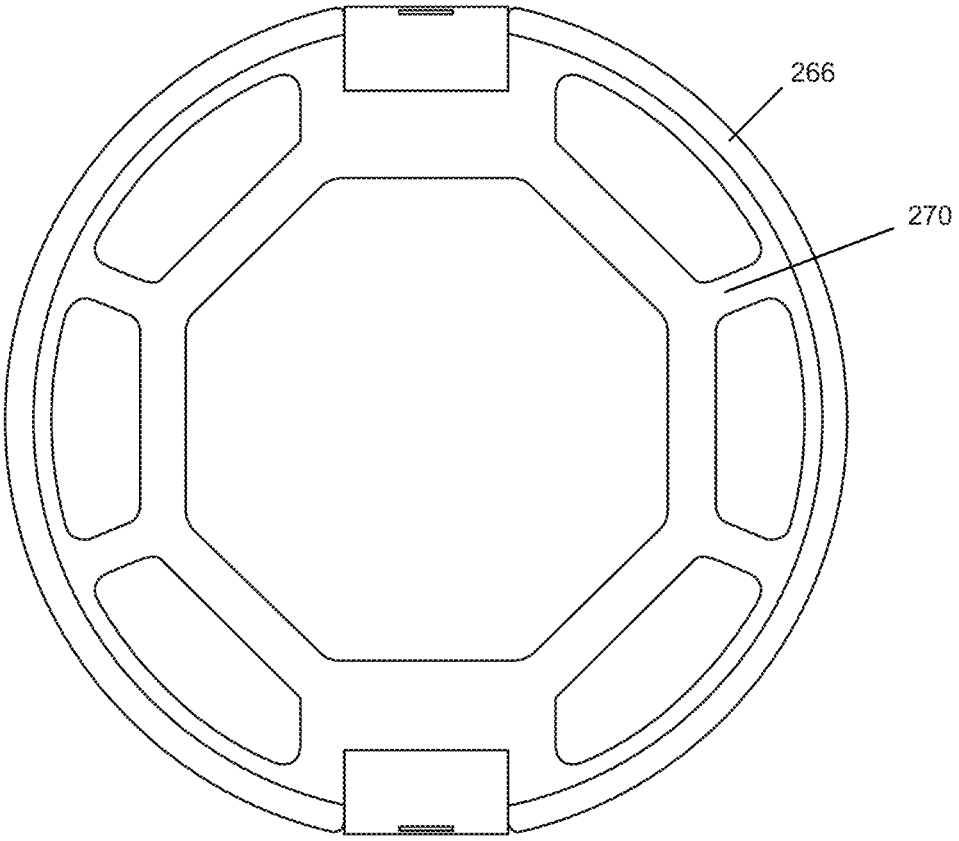
FIG. 40 is an end view of the secondary adapter shown in FIG. 39.
Figure 41:
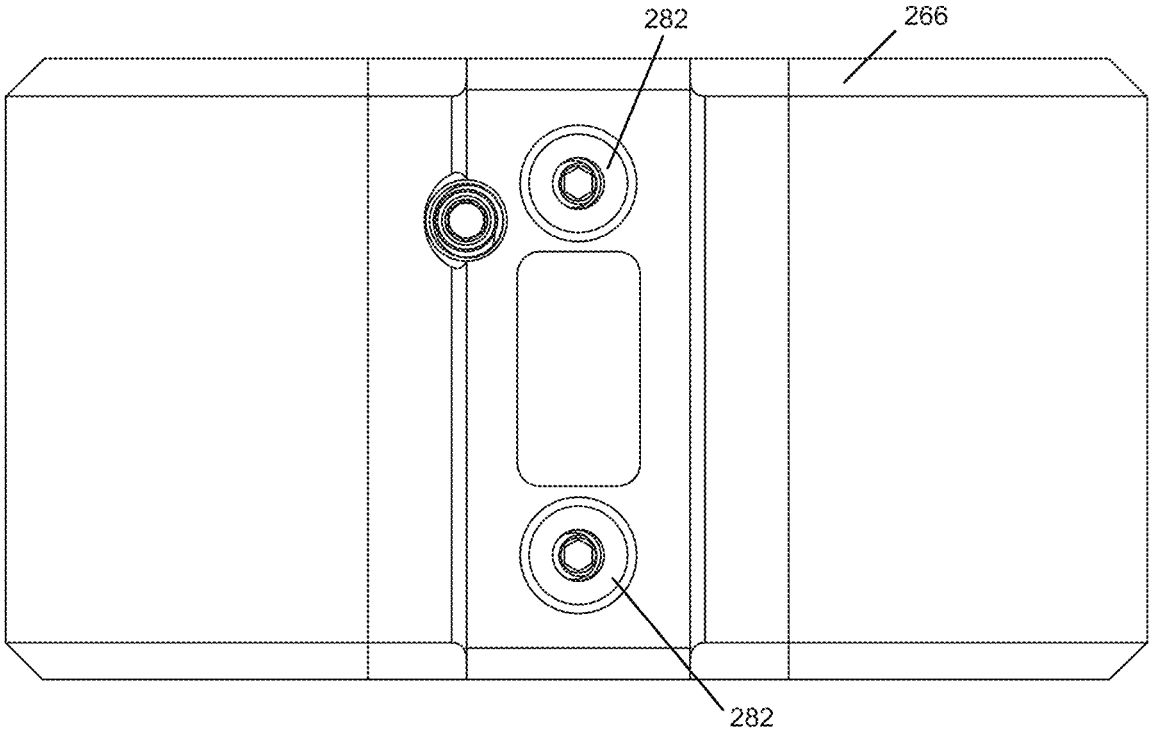
FIG. 41 is a side view of the secondary adapter shown in FIG. 40.

As illustrated, the pipe threader 182 transmits torque via an adapter (i.e., a primary adapter 186) having an input (e.g., an octagonal input). Vertices of the input may include grooves 187 engageable with correspondingly dimensioned ribs of the pipe threader 182. A secondary adapter 266 (see FIGS. 39-41) may be fastened to the primary adapter 186 for engagement with a different sized pipe threader 182.

Each illustrated adapter 182, 266 is generally a hollow extrusion having radially extending support ribs 270 between an interior engagement surface 274 and an exterior engagement surface 278. The secondary adapter 266 and the adapter 186 are shown assembled in FIGS. 45-48. To assemble, fasteners 282 extend through the secondary adapter 266 and engage and an exterior surface 278 of the adapter 182.

Figure 42:
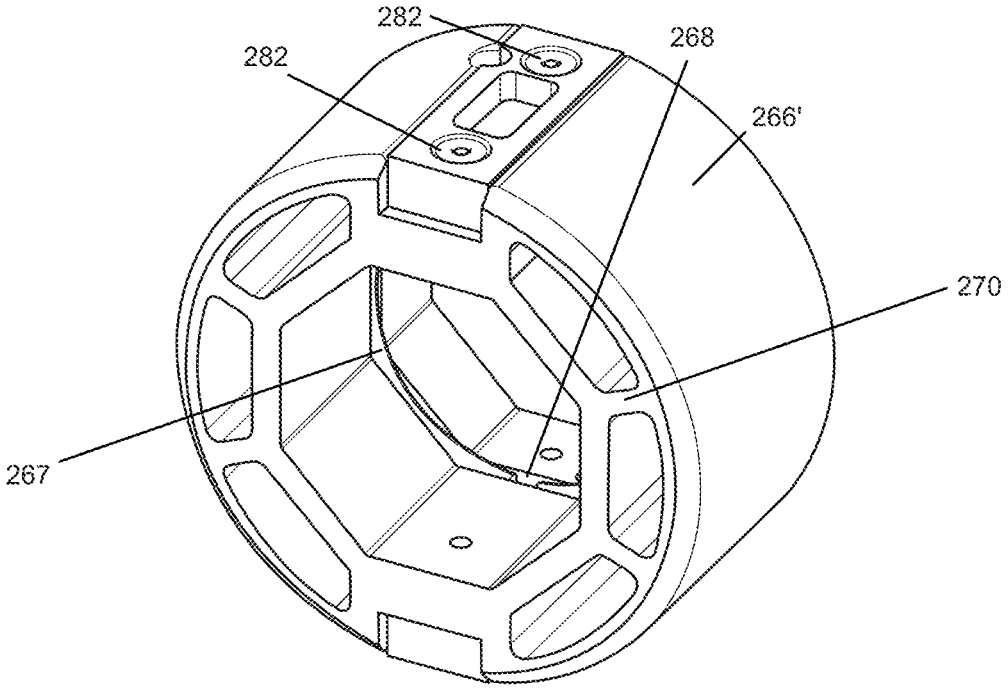
FIG. 42 is a perspective view of an alternate secondary adapter.
Figure 43:
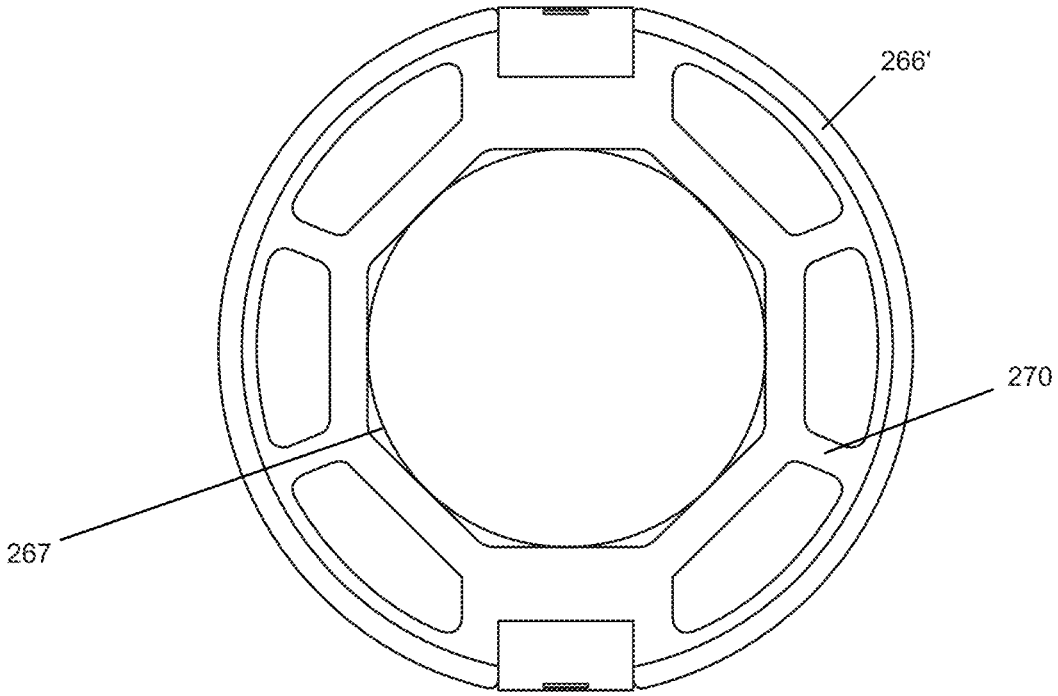
FIG. 43 is an end view of the alternate secondary adapter shown in FIG. 42.
Figure 44:
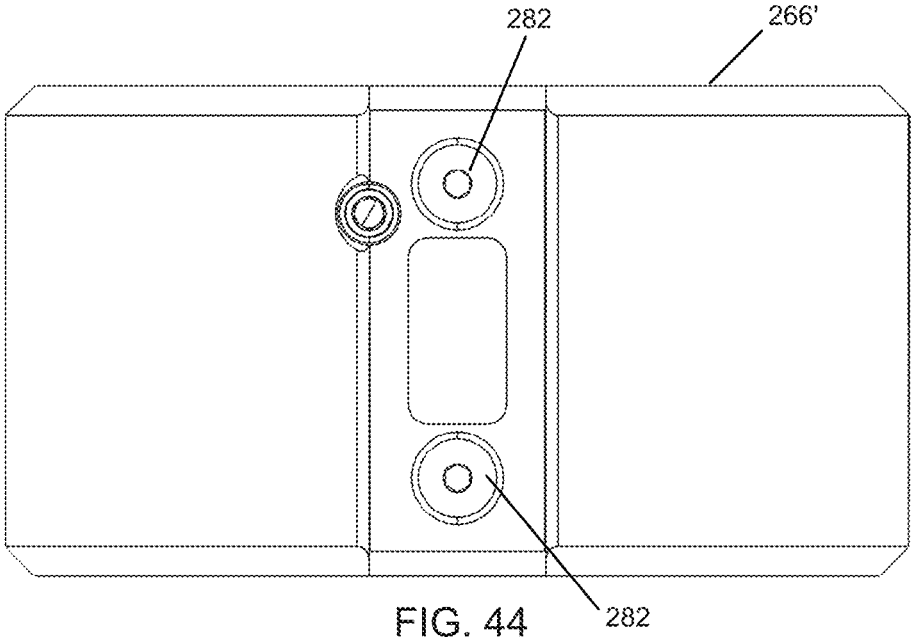
FIG. 44 is a side view of the alternate secondary adapter shown in FIG. 42.
Figure 45:
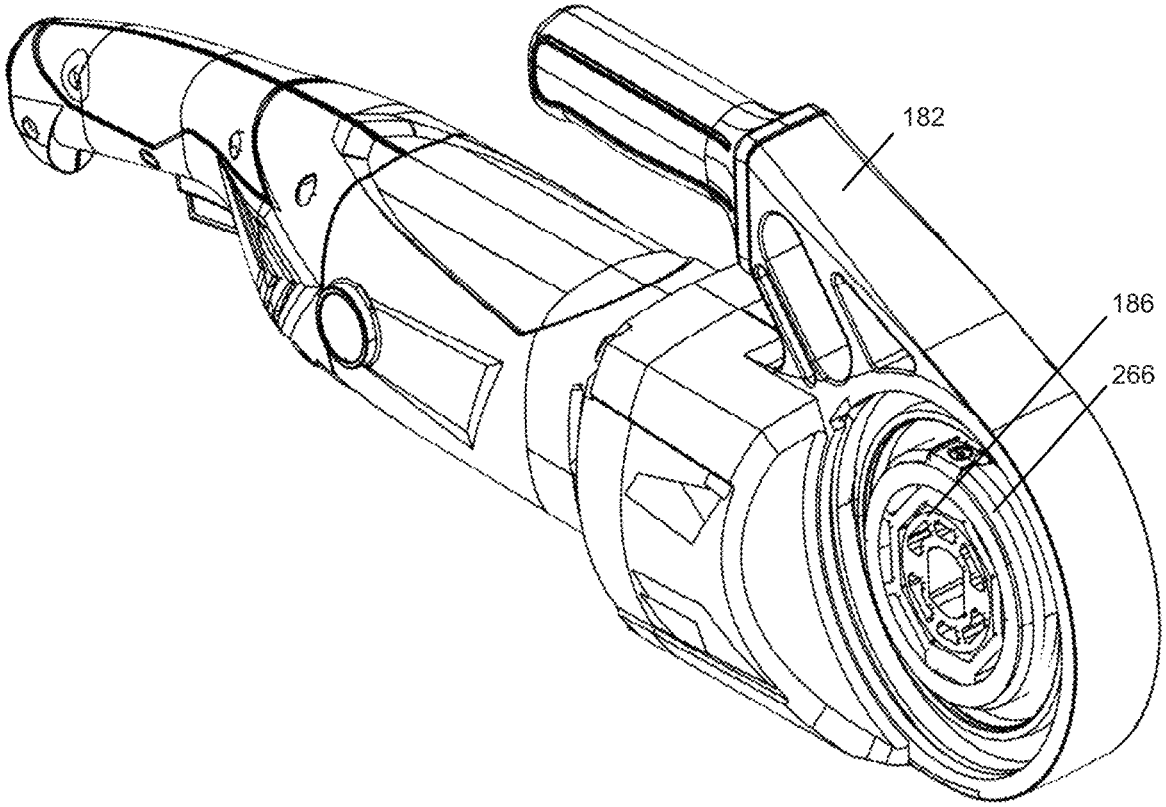
FIG. 45 is a perspective view of the pipe threader with the primary adapter and the secondary adapter.
Figure 46:
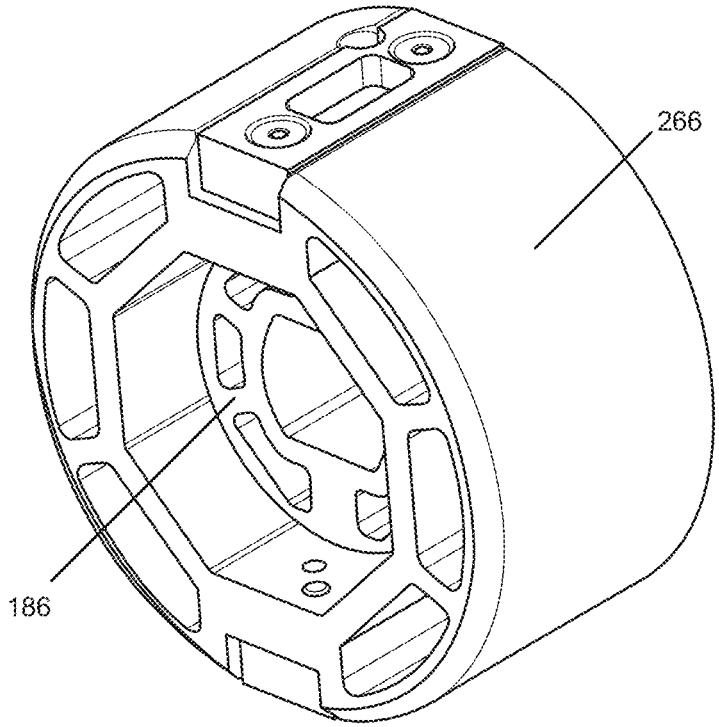
FIG. 46 is a rear perspective view of the primary adapter and the secondary adapter.
Figure 47:
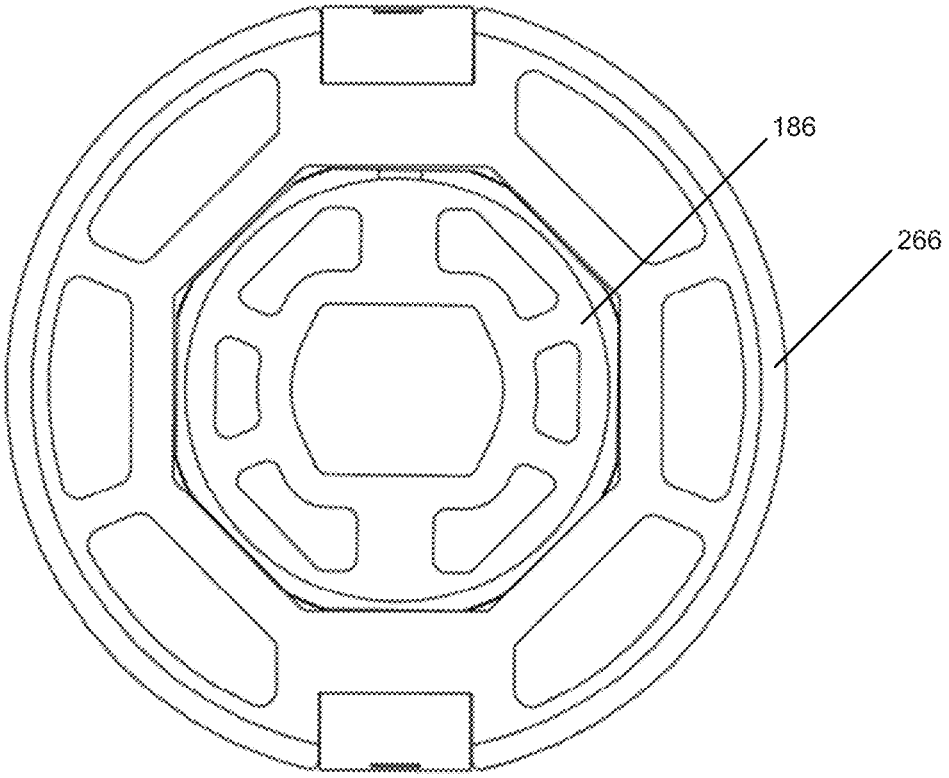
FIG. 47 is an end view of the primary adapter and the secondary adapter as shown in FIG. 46.
Figure 48:
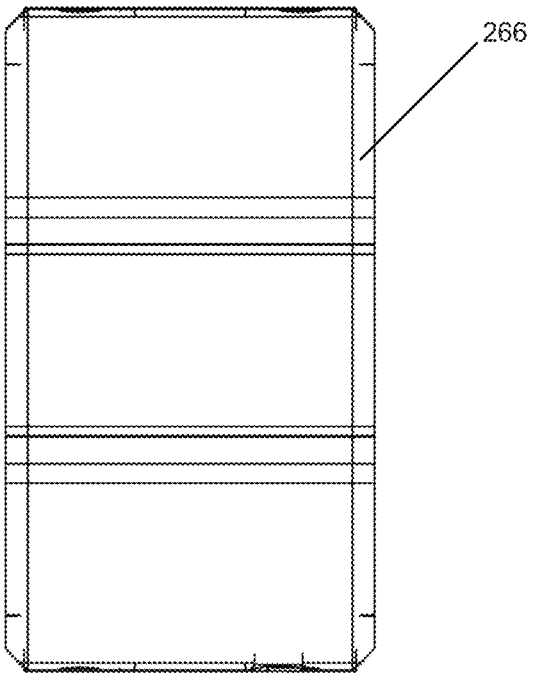
FIG. 48 is a side view of the primary adapter and the secondary adapter as shown in FIG. 46.

FIGS. 42-44 illustrate an alternative construction for a secondary adapter 266' which may be fastened to the primary adapter 186 for engagement with the pipe threader 182. The secondary adapter 266' is fastened to the primary adapter 186 through a circlip 267 retained in a circlip groove 268 defined in an inner periphery of the alternate secondary adapter 266'. The circlip groove 268 has a depth generally corresponding to the radial dimension of the circlip 267. When the circlip 267 is retained in the circlip groove 268, the primary adapter 186 is positioned within the annular alternate secondary adapter 266'. As such, the circlip 267 retains the primary adapter 186 with the secondary adapter 266'.

Figure 55:
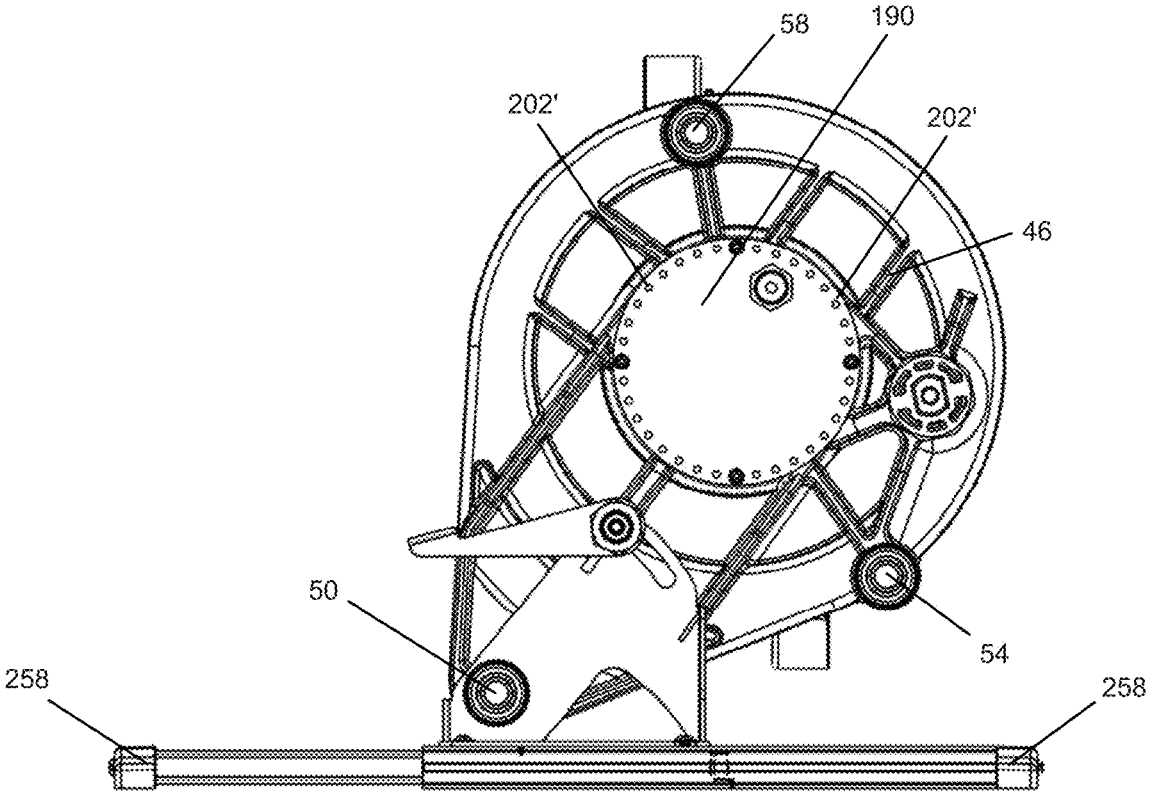
FIG. 55 is a rear view of the bender assembly shown in FIG. 49A, illustrated without the pipe threader.
Figure 56:
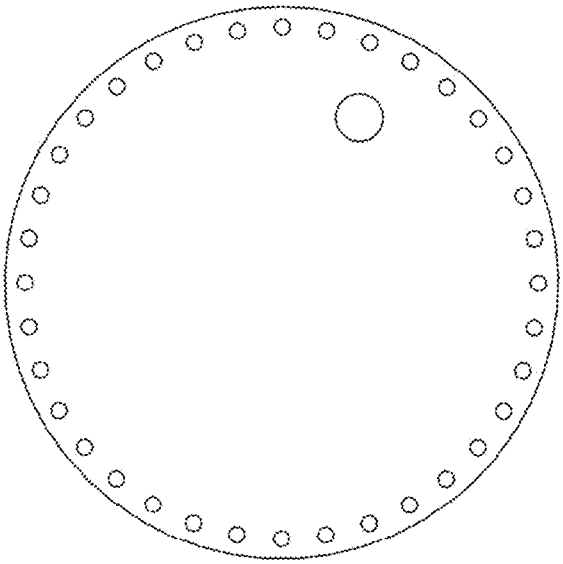
FIG. 56 is a front view of a rear plate of the bender, illustrated without the bender.
Figure 57:
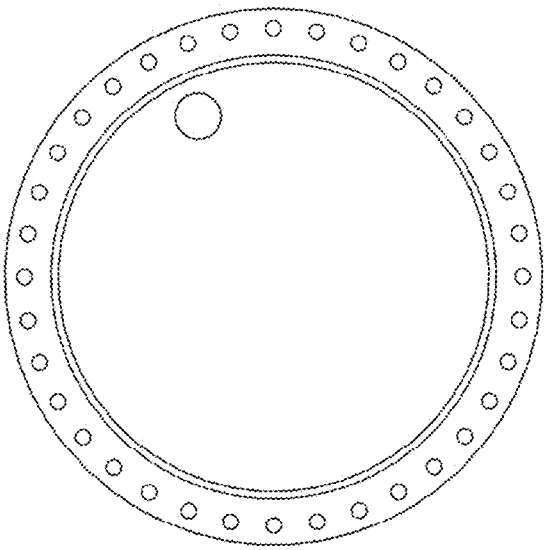
FIG. 57 is a rear view of the rear plate shown in FIG. 56.
Figure 58:
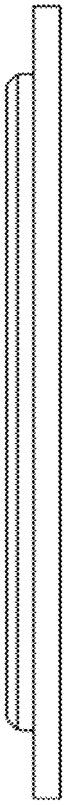
FIG. 58 is a side view of the rear plate shown in FIG. 56.
Figure 59:
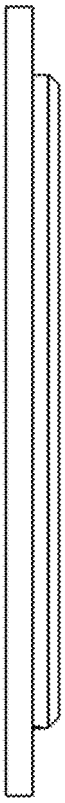
FIG. 59 is an opposite side view of the rear plate shown in FIG. 56.

A rear plate 190 of the housing 14 supports (see FIGS. 17-18 and 25-26) a support pin or rod 194 positioned to engage the pipe threader 182 to inhibit relative rotation of the pipe threader 182 as torque is supplied. In the illustrated embodiment, the rod 194 is retained on the rear plate 190 with a bolt 198. The rear plate 190 defines (see FIGS. 17-18) arcuate slots 202 to receive fasteners so that the rear plate 190 can be attached to the housing 14 in a number positions to allow different types of power mechanisms (e.g., different pipe threaders) to be supported and engage the adapter 186. In another embodiment (see FIG. 55), the rear plate 190 may include multiple holes 202' which receive fasteners so that the rear place 190 and the rod 194 may be attached to the housing 14 in a number of positions. The holes 202' may be circumferentially spaced near the outer periphery of the rear plate 190. FIGS. 55-57 illustrate the rear plate 190 defining multiple holes 202'.

Figure 18:
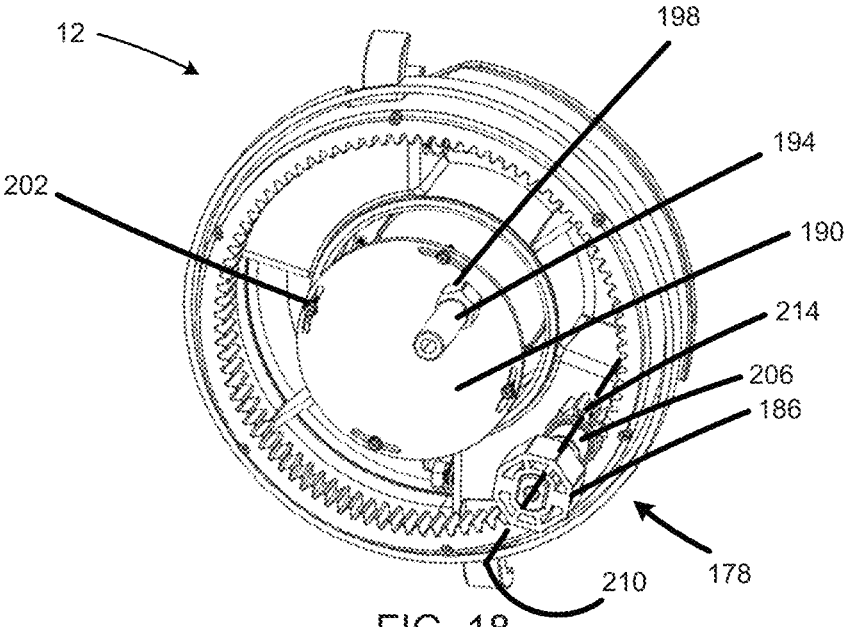
FIG. 18 is a rear perspective view of the bender shown in FIG. 1, with the housing removed to show the drive mechanism.
Figure 19:
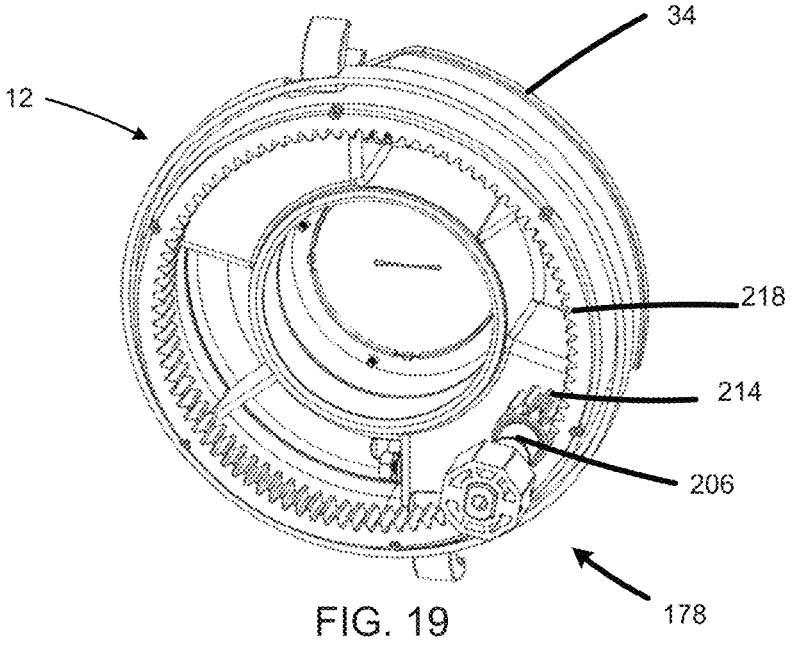
FIG. 19 is a rear perspective view of the bender as shown in FIG. 18 with the housing, the support pin, and the rear plate removed to show the gear mechanism.

FIGS. 18-19 illustrate the drive mechanism 178 in more detail. The drive mechanism 178 includes a shaft 206 with a shaft axis 210 is parallel to and offset from the housing axis 38. The shaft 206 is drivingly rotated by the pipe threader 182 through the adapter 186. A spur gear 214, supported on the shaft 206 for rotation therewith, meshes with an internal ring gear 218. The internal ring gear 218 is connected to the shoe 34, and the ring gear 218 and the shoe 34 are supported by the housing 14 for rotation about the housing axis 38. Rotation of the shaft 206 and the spur gear 214 causes rotation of the internal ring gear 218 and, therewith, the shoe 34. Rotation of the shoe 34 bends the supported conduit C. After bending, the pipe threader 182 can be removed from the bender 12 and used to thread the bent conduit C.

A gear ratio between the spur gear 214 and the internal ring gear 218 increases the torque transmitted from the power mechanism 13 to the shoe 34. In the illustrated embodiment, the ring gear 218 is an approximately 12" diameter gear, and the gear ratio between the internal ring gear 218 and the spur gear 214 is about 9:1. In other embodiments, the gear ratio may be less than or greater than this ratio (e.g., between about 5:1 and about 15:1). In other embodiments (not shown), the gear assembly may include one or more additional gears.

The gear ratio between the spur gear 214 and the internal ring gear 218 allows for the use of a pipe threader 182 to bend conduit C. It has been found that bending 1" rigid metal conduit C may require about 850 ft-lbs. (e.g., 848 ft-lbs.) of torque. The pipe threader 182 may provide about 100 ft-lbs. of torque. With the gear ratio between the spur gear 214 and the internal ring gear 218 being 9:1, the pipe threader 182, through the spur gear 214 and the internal ring gear 218, provides 900 ft-lbs. of torque, sufficient to bend 1" rigid metal conduit C.

In the illustrated construction, the factor of safety between torque supplied by the pipe threader 182 and torque required to bend 1" rigid metal conduit C is around 1.06 (greater than one to provide adequate torque to bend the conduit C). Conduit C that is smaller and/or of a different material may require less torque to bend and, thus, may have a higher factor of safety.

The gear ratio between the spur gear 214 and the internal ring gear 218 slows down the rotation of the pipe threader 182 to an appropriate speed for bending conduit C. The pipe threader 182 may rotate at around 30 RPM. With the gear ratio between the spur gear 214 and the internal ring gear 218, the shoe 34 may be rotated at 30/9 RPM to bend the conduit C. This slower speed may allow for more control and accurate stopping of the rotation of the powered bender assembly 10 at a desired bend of conduit C.

The arrangement of the drive mechanism 178, with the drive shaft 206 offset from the housing axis 38, results in a smaller profile assembly 10 in which the opposite ends 266, 270 of the pipe threader 182 are on opposite sides of the housing axis 38. In comparison, with a drive shaft 206 along the housing axis 38, the pipe threader 182 would extend further to one side of the assembly 10.

Figure 22:
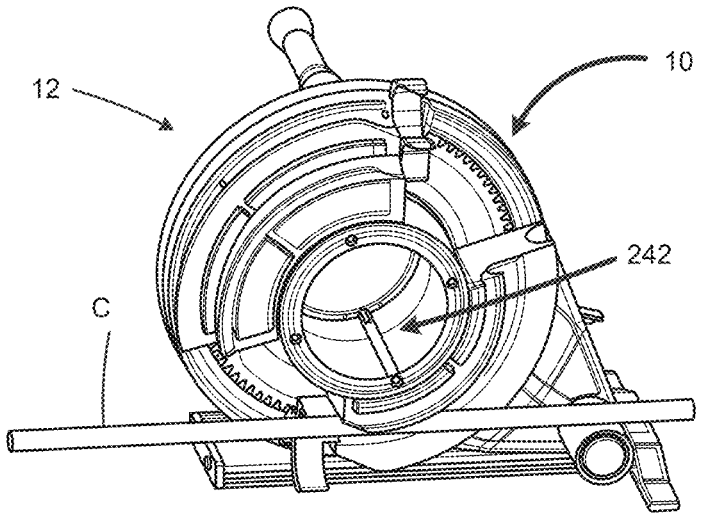
FIG. 22 is a perspective view of the bender shown in FIG. 3, with the front plate removed to show a cavity.

As shown in FIGS. 19 and 22, the structure of the shoe 34 and the arrangement of the drive mechanism 178, with the offset drive shaft 206 and spur gear 214 and annular ring gear 218, allows for an open space 242 in the housing 14. The space 242 may serve as a compartment, closed by the removable faceplate 162, operable to house any component, tool, material, etc., which an operator may need on a jobsite. For example, a power cord to supply power to or a remote pendant 346 and control electronics 358 to control the bender assembly 10 may be stored in the space 242. Alternatively, in an embodiment in which the drive mechanism 178 is driven by an onboard motor, the motor (not shown) and power source (e.g., the power cord, a battery) may be housed within the space 242. Additionally, the space 242 may provide a location for control electronics to monitor and control operation of the bender assembly 10.

Figure 60:
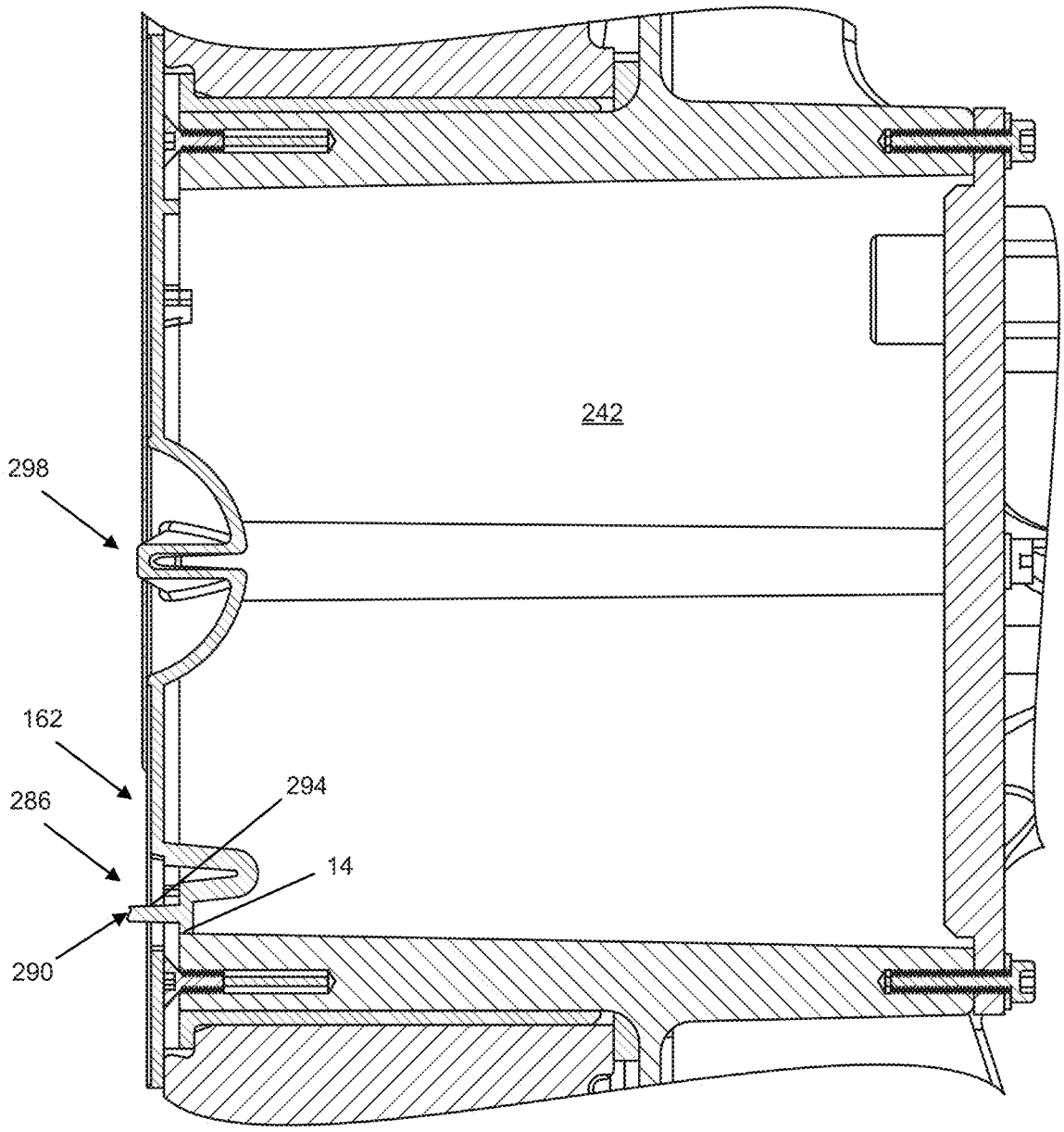
FIG. 60 is a cross-sectional view of the bender assembly, taken generally along line 59-59 in FIG. 49B and illustrating the housing and the latching mechanism.

As shown in FIG. 60, a latching mechanism 286 may be provided to removably engage the faceplate 162 and the housing 14 so that the open space 242 may be selectively closed and opened. The latching mechanism 286 includes a latch arm 290 (e.g., on the faceplate 162) and a latch receiving aperture 294 (e.g., in the faceplate 162) through which a portion of the latch arm 290 extends. The latch arm 290 is biased towards engagement with the aperture 294 (e.g., towards the inner surface of the housing wall defining the open space 242) to retain the faceplate 162 in a closed position in which the open space 242 is covered. An operator engages the latch arm 290 to disengage it from the aperture 294 to remove the faceplate 162 and uncover the open space 242.

The illustrated faceplate 162 has a handle 298 which is generally recessed from an exterior surface of the faceplate 162. In the event that the bender assembly 10 is dropped onto a flat surface, the recessed handle 298 would not contact the flat surface. The handle 298 is also operable to move the latch arm 290 out of the aperture 294, permitting an operator to remove the faceplate 162 only by engaging the handle 290. In the illustrated embodiment, the handle 298 and the latch arm 290 include biased leaf-spring type springs. In other constructions (not shown), other mechanisms may be provided.

Figure 23:
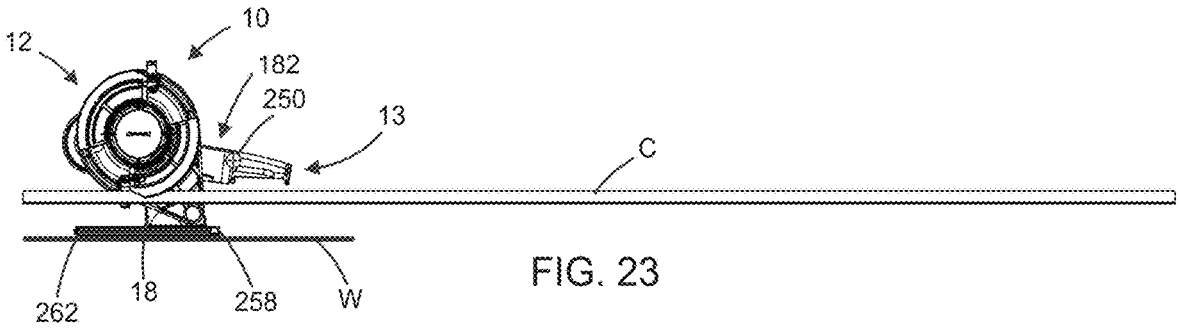
FIG. 23 is a front view of the bender assembly shown in FIG. 1, illustrated supporting a long conduit and with extendable support members in a retracted position.
Figure 24:
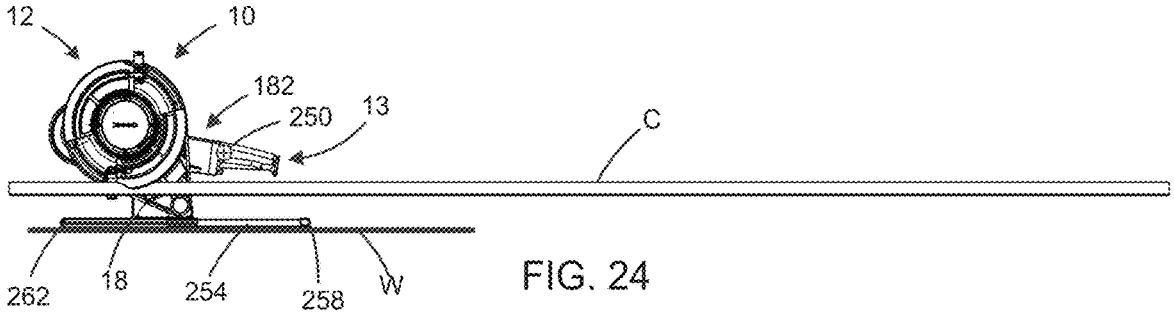
FIG. 24 is a front view of the bender assembly shown in FIG. 1, illustrated supporting a long conduit and with extendable support members in an extended support position.

FIGS. 23-24 illustrate an adjustable support assembly for the bender assembly 10. As illustrated, a relatively long conduit C is supported by the bender assembly 10. The base 18 includes an extension 254 capable of increasing the length of the base 18 along the longitudinal axis 42.

In FIG. 23, the extension 254 is retracted into the base 18 for storage and/or use with relatively shorter conduit C. In FIG. 24, the extension 254 is in the extended support position with the base foot 258 separated from the base 18. In this position, the center of gravity 250 of the assembly is between the base foot 258 and a base cap 262 at the opposite end of the base 18. The assembly has increased stability, and an operator does not have to apply additional downward force to maintain contact between the base 18 and the work surface W.

The extension tube 254 is retained within the base 18 with a fastener which engages a magnet housed within a base foot 258. In other embodiments, the extension tube 254 is retained within the base foot 258 with a molded latch (not shown) at an end of the extension tubes 254 and engageable with the base foot 258. Other retaining mechanisms may be provided.

The base foot 258 engages a distal end of the extension tubes 254. The base foot 258 also includes at least one through hole to receive a fastener to further secure the base foot 258 with the work surface W. At the other end of the base 18, the base cap 262 is retained with fasteners received in fastener receiving channels of the base 18.

Figure 11A:
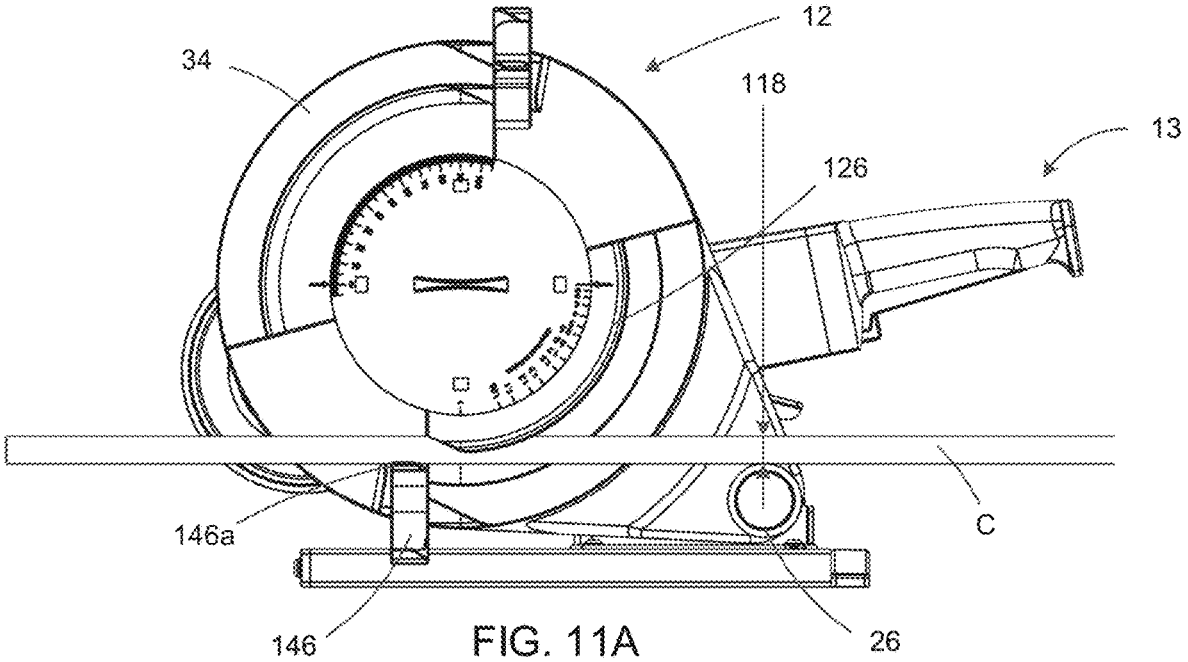
FIG. 11A is a front view of the bender assembly as shown in FIG. 1, illustrated supporting a conduit (e.g., a ½" electrical metallic tubing (EMT) conduit) before bending.
Figure 12A:
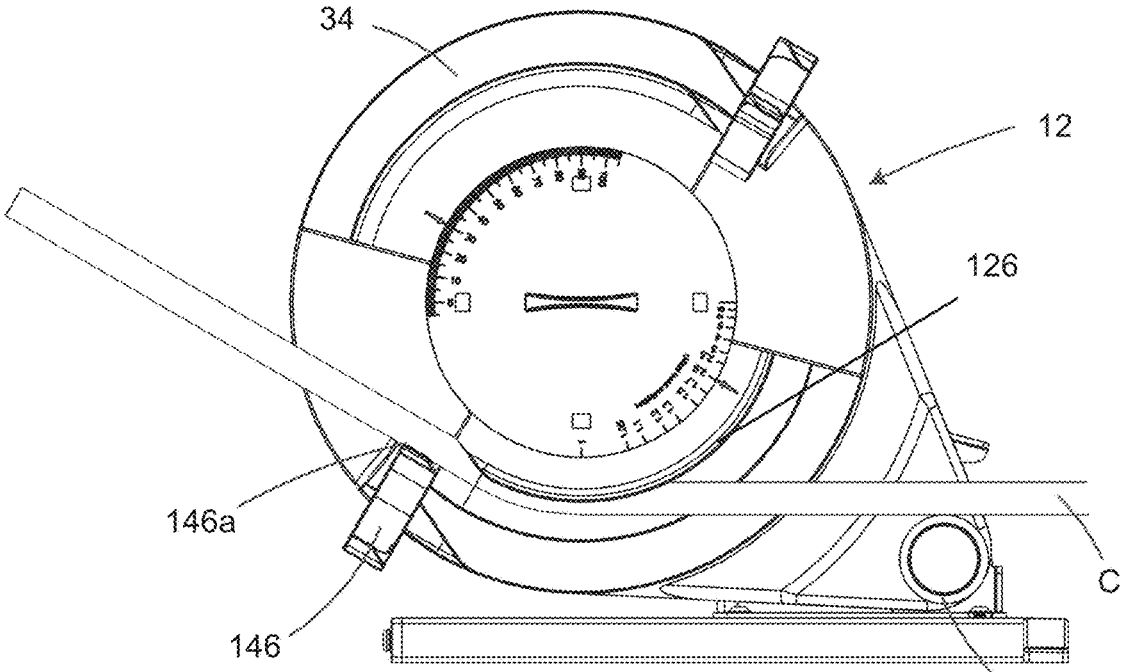
FIG. 12A is a front view of the bender shown in FIG. 11A, illustrating bending of the conduit (e.g., the ½" EMT conduit) and with an indicator plate referencing the angle indicia.
Figure 13:
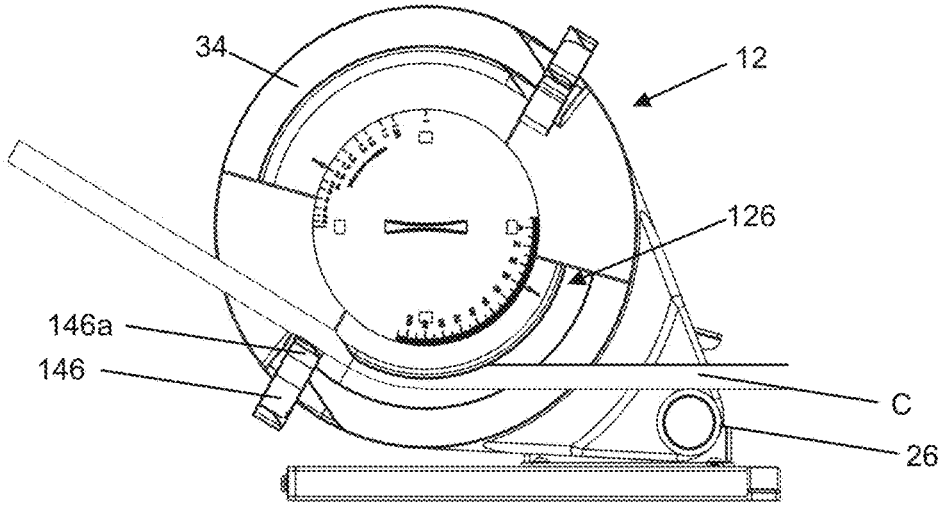
FIG. 13 is a front view of the bender shown in FIG. 11A, illustrating bending of the conduit (e.g., the ½" EMT conduit) and with the indicator plate referencing the multiple indicia.

FIGS. 11A, 12A and 13 illustrate operation of the bender assembly 10 to bend one type and size of conduit C (e.g., a ½" EMT conduit C). As shown in FIG. 11A, the shoe 34 is oriented relative to the housing 14 with the first segment 138 (with the channels 122, 126) in the operational condition. FIG. 11A illustrates the bender assembly 10 and the conduit C before bending, and the illustrated ½" EMT conduit C contacts the roller 26, the portion 146*a* of the first shoe hook 146, and the channel 126 of the shoe 34. In the position shown in FIG. 11A, the housing 14 is positioned relative to the base 18 with the hook surface 146*a* aligned with the roller surface along a line parallel to the base axis 42.

FIG. 12A illustrates the bender assembly 10 operated to bend the conduit C to a bend angle (e.g., about 30°) with the faceplate 162 oriented to use the bend angle indicia 170. FIG. 13 illustrates the bender assembly 10 operated to bend the conduit C with the faceplate 162 oriented to use the bend multiplier indicia 174.

Figure 11B:
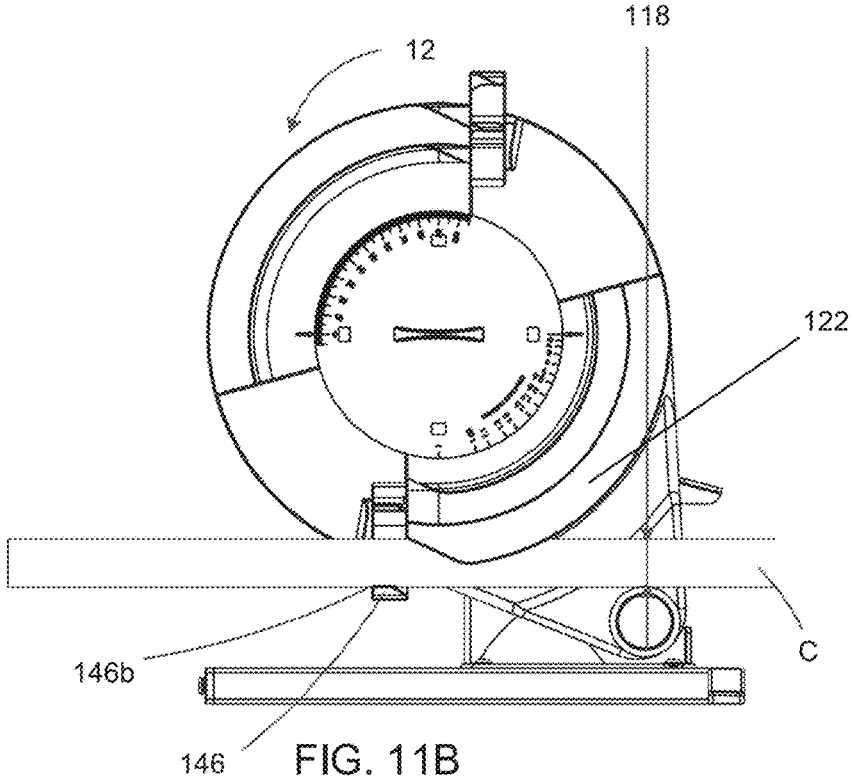
FIG. 11B is a front view of the bender assembly as shown in FIG. 1, illustrated supporting a conduit (e.g., a 1" rigid conduit (RMC)) before bending.
Figure 12B:
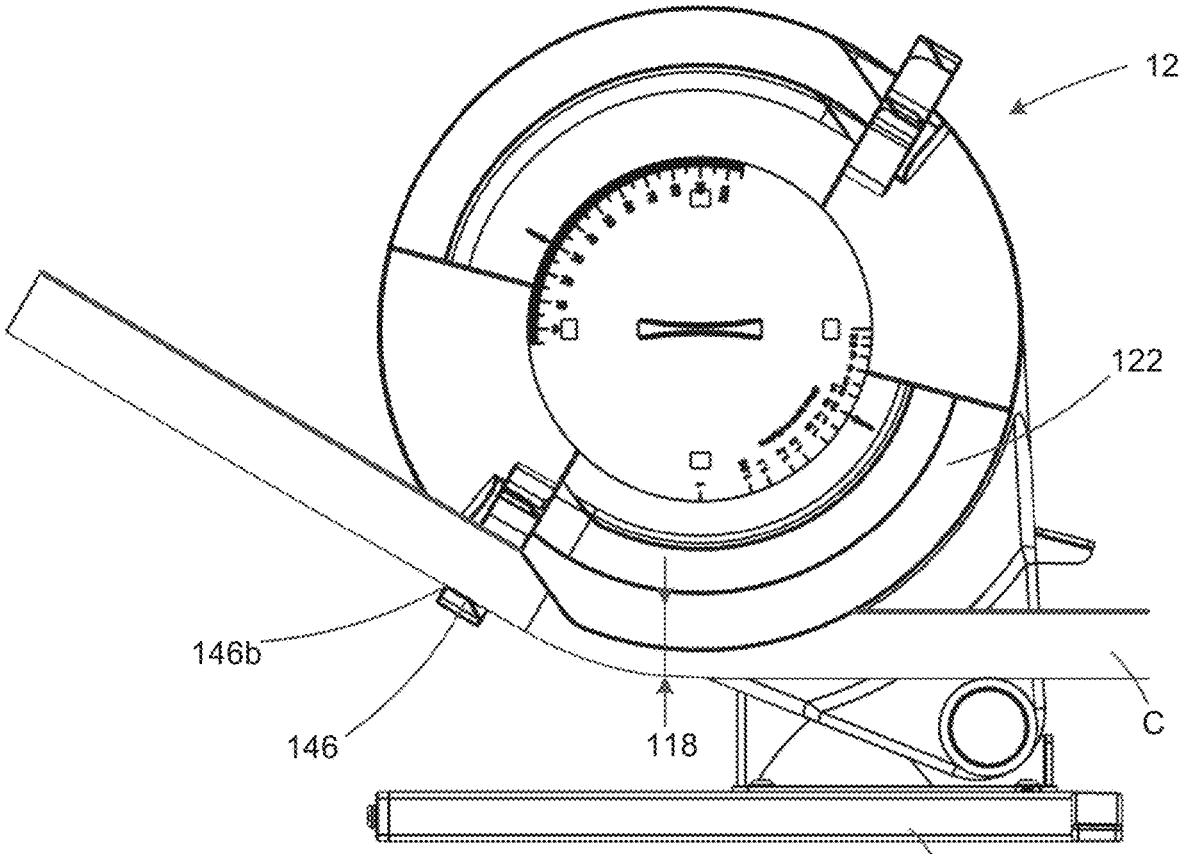
FIG. 12B is a front view of the bender shown in FIG. 11B, illustrating bending of the conduit (e.g., the 1" RMC conduit).

FIGS. 11B and 12B illustrate operation of the bender assembly 10 to bend another different type and/or size of conduit C (e.g., a 1" RMC). As shown in FIG. 11B, the shoe 34 is oriented relative to the housing 14 with the first segment 138 (with the channels 122, 126) in the operational condition. FIG. 11B illustrates the bender assembly 10 and the conduit C before bending, and the illustrated 1" RMC conduit C contacts the roller 26, the portion 146*b* of the first shoe hook 146, and the channel 122 of the shoe 34.

From the position shown in FIG. 11A, the housing 14 is adjusted (e.g., pivoted) relative to the base 18 to, as shown in FIG. 11B, align the hook surface 146*b* with the roller surface along a line parallel to the base axis 42. To pivot the housing 14, the lever 114 is released, and, as the housing 14 is moved, the rod 98 moves in the slot 94 (to the position shown in FIG. 16C). When the housing 14 is in the position shown in FIG. 11B, the lever 114 is tightened to lock the housing 14 relative to the base 18 so that the bender assembly 10 can be operated to bend the conduit C. FIG. 12B illustrates the bender assembly 10 operated to bend the conduit C to a bend angle (e.g., about 30°).

Figure 14:
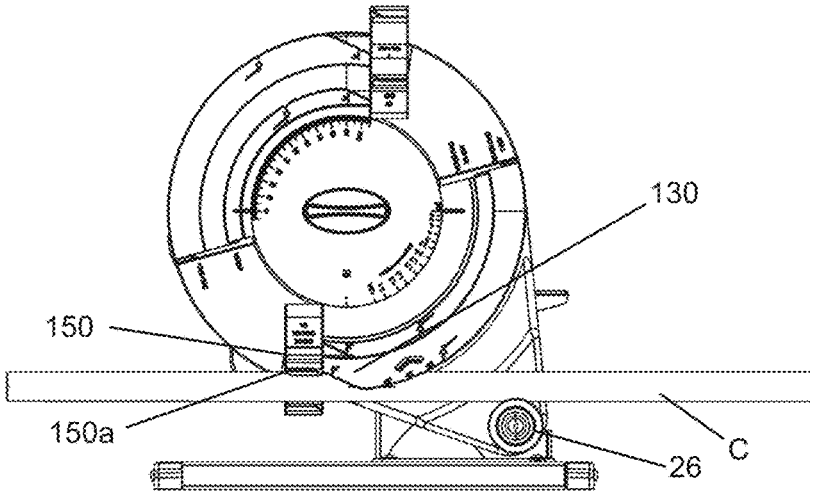
FIG. 14 is a front view of the bender shown in FIG. 1, illustrated supporting another conduit (e.g., a ¾" RMC) before bending.
Figure 15:
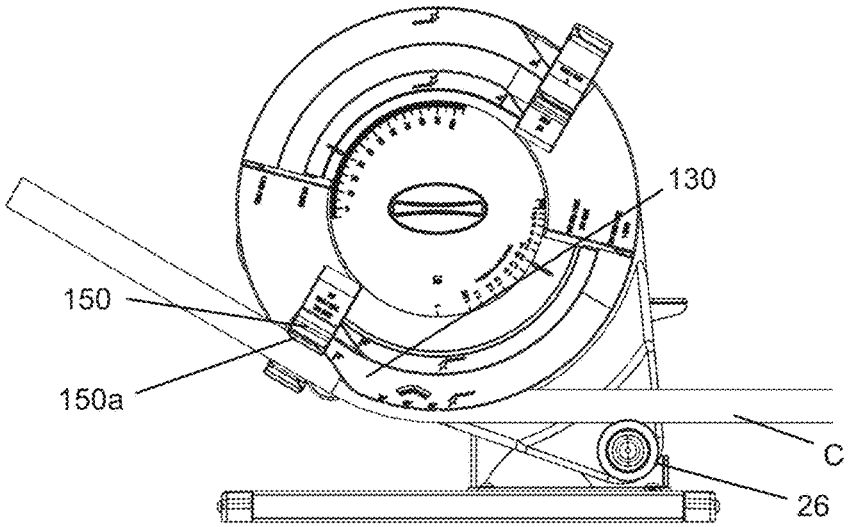
FIG. 15 is a front view of the bender shown in FIG. 14, illustrating bending of the other conduit (e.g., the ¾" RMC).

FIGS. 14-15 illustrate operation of the bender assembly 10 to bend yet another different type and/or size of conduit C (e.g., a ¾" RMC). As shown in FIG. 14, the shoe 34 is pivoted relative to the housing 14 to place the second segment 142 (with the channels 130, 134) in the operational condition.

Figure 16A:
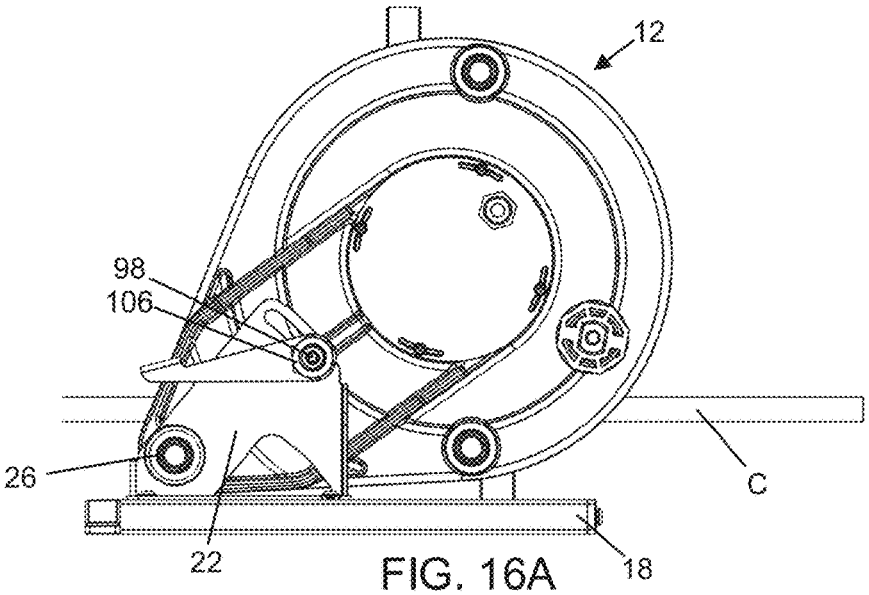
FIG. 16A is a rear view of the bender as shown in FIG. 11A.
Figure 16B:
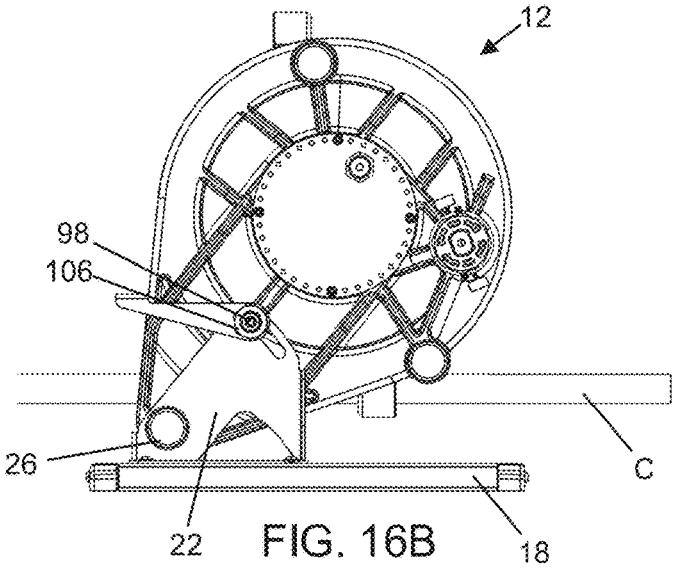
FIG. 16B is a rear view of the bender as shown in FIG. 14.
Figure 16C:
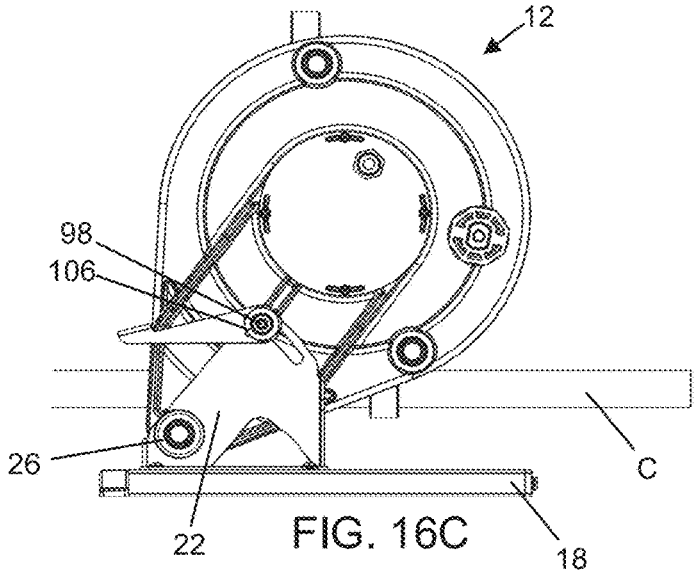
FIG. 16C is a rear view of the bender as shown in FIG. 11B.
Figure 17:
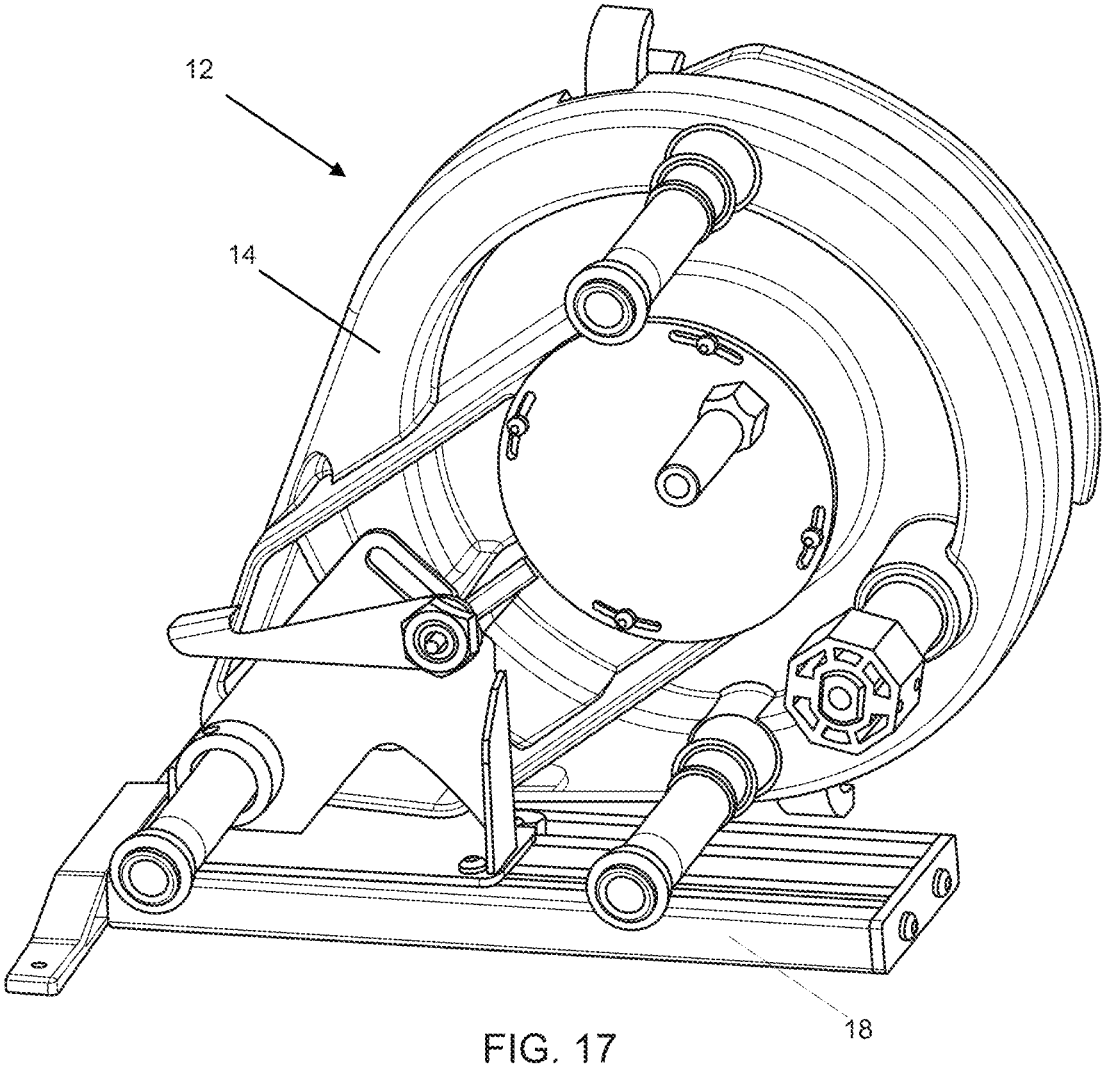
FIG. 17 is a rear perspective view of the bender shown in FIG. 1, with the housing shown.

FIG. 14 illustrates the bender assembly 10 and the conduit C before bending, and the illustrated ¾" RMC conduit C contacts the roller 26, the portion 150*b* of the second shoe hook 150, and the channel 130 of the shoe 34. As shown in FIG. 16B, the rod 98, the nut 106 and the washer 110 are at a position in the arcuate slot 94 spaced from the base 18 (when compared to the position shown in FIG. 16A). FIG. 15 illustrates the bender assembly 10 operated to bend the conduit C to a bend angle (e.g., about 30°).

Figure 25:
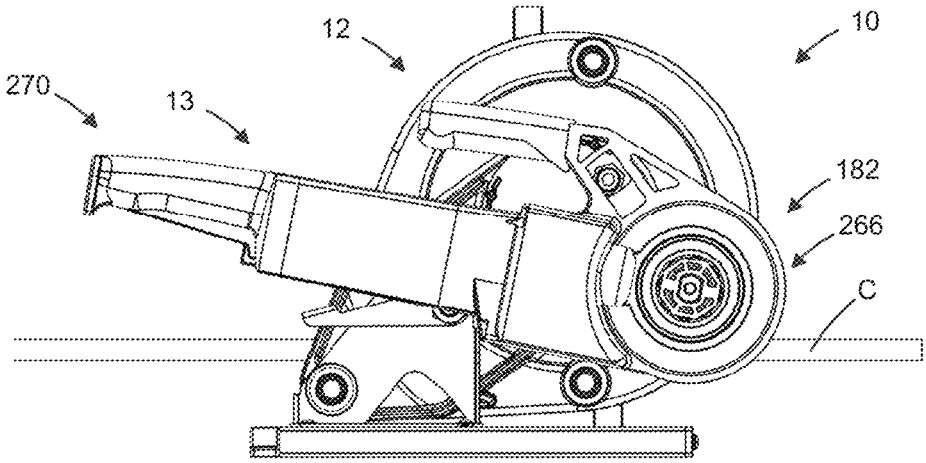
FIG. 25 is a rear view of the bender assembly shown in FIG. 1, illustrated supporting a conduit (e.g., the ½" EMT conduit).
Figure 26:
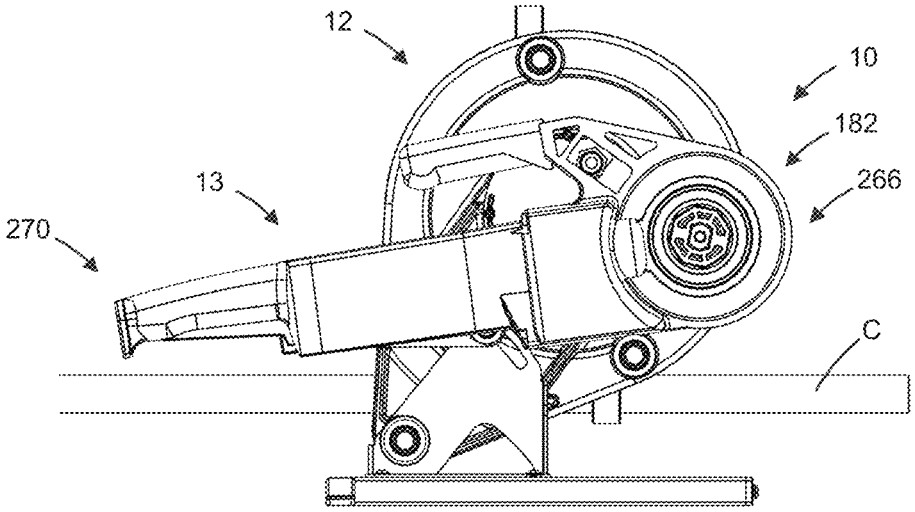
FIG. 26 is a rear view of the bender assembly shown in FIG. 1, illustrated supporting another conduit (e.g., the 1" RMC).
Figure 27:
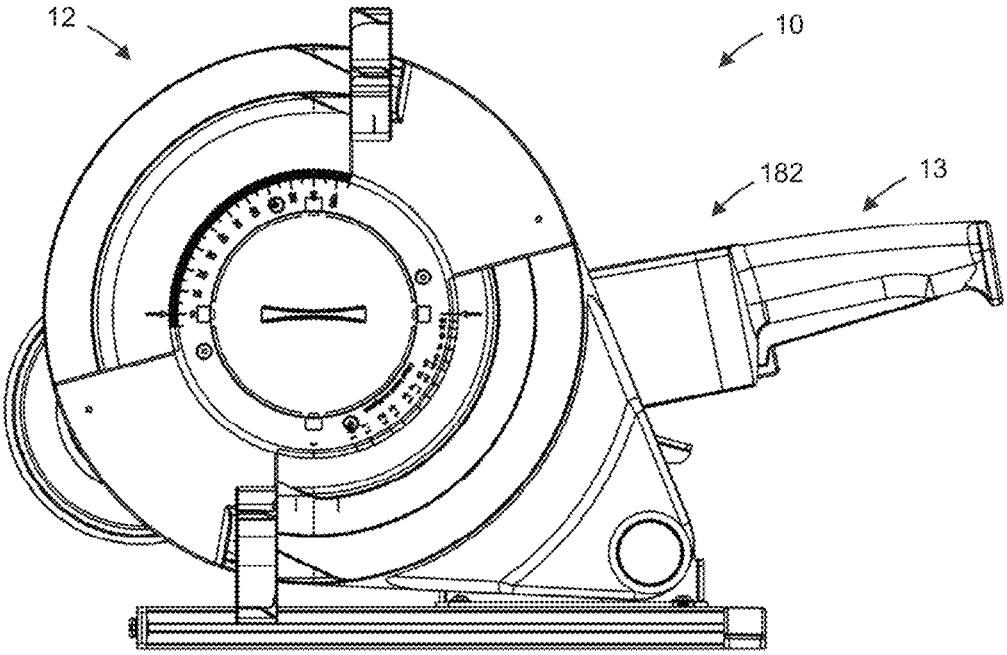
FIG. 27 is a front view of the bender assembly shown in FIG. 1, illustrated in the first (e.g., vertical) orientation.
Figure 28:
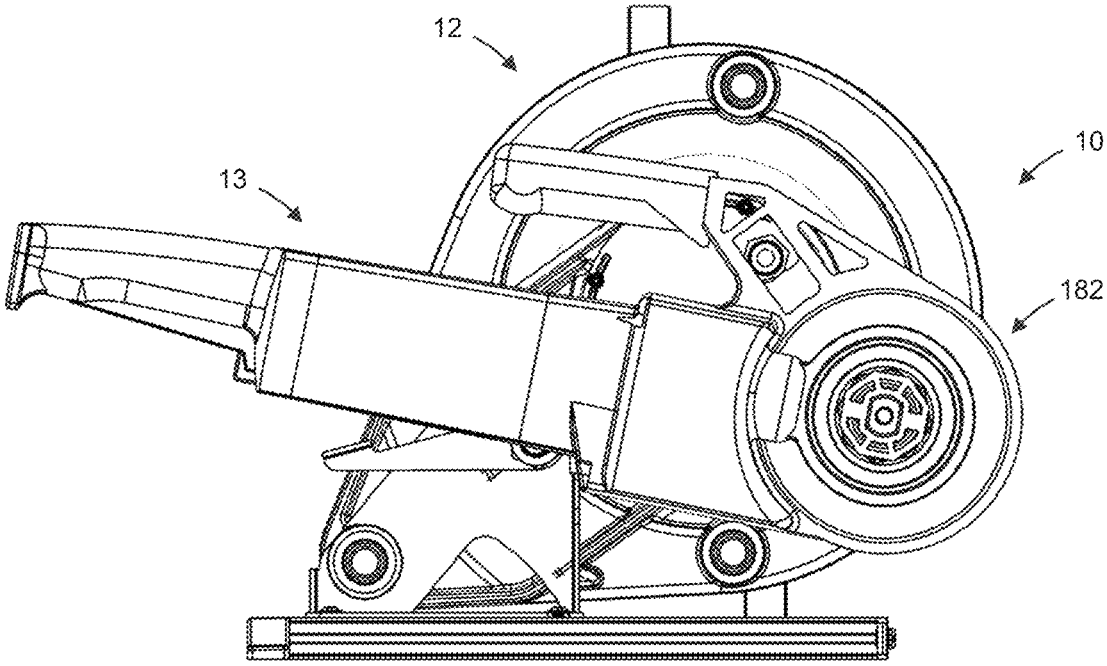
FIG. 28 is a rear view of the bender assembly as shown in FIG. 27.
Figure 29:
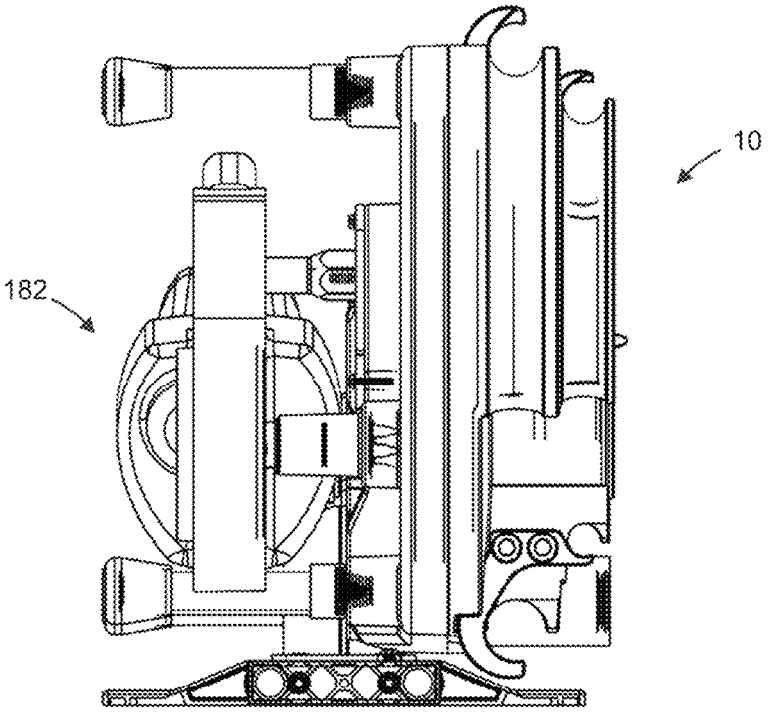
FIG. 29 is a side view of the bender assembly as shown in FIG. 27.
Figure 30:
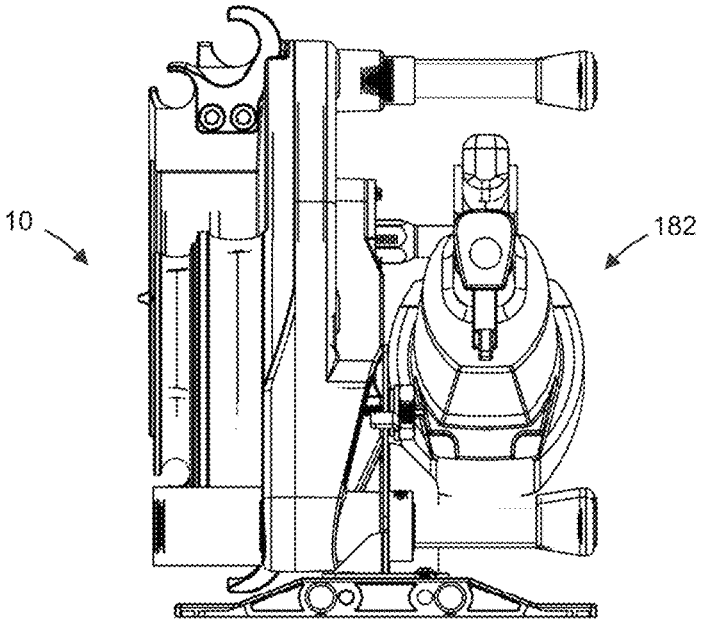
FIG. 30 is an opposite side view of the bender assembly as shown in FIG. 27.
Figure 31:
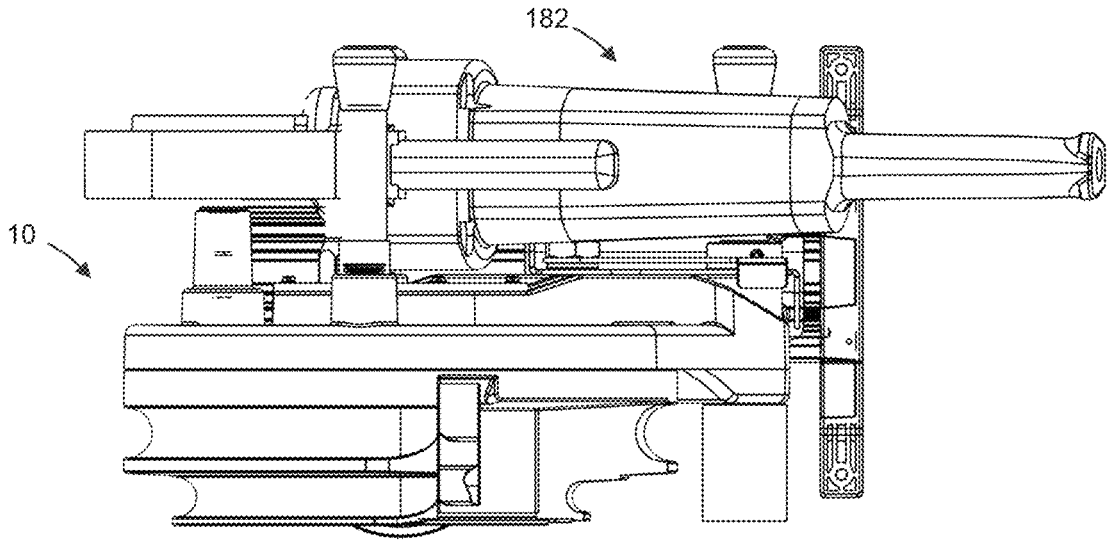
FIG. 31 is a top view of the bender assembly as shown in FIG. 27.
Figure 32:
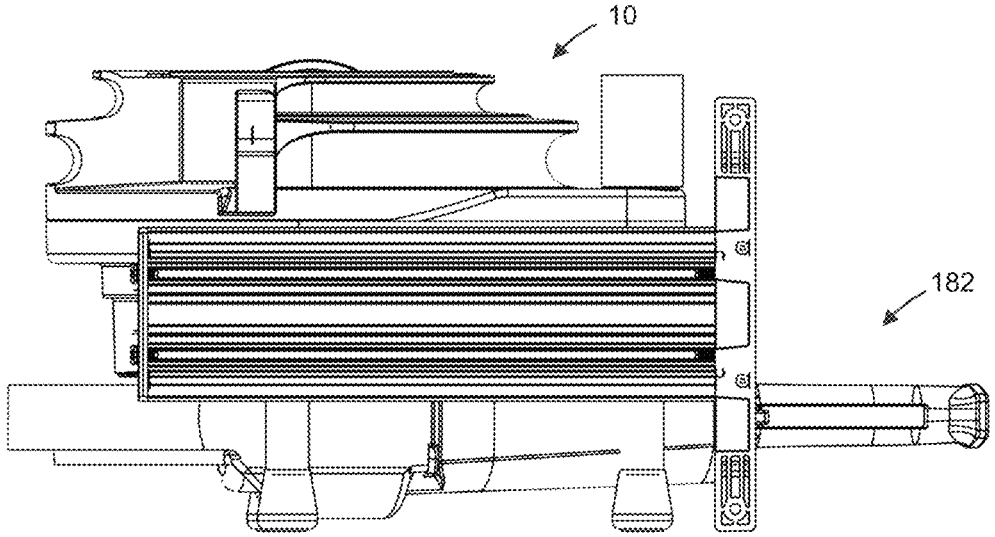
FIG. 32 is a bottom view of the bender assembly as shown in FIG. 27.

FIGS. 25-26 illustrate comparative views of the bender assembly 10 supporting different conduits C. In FIG. 25, ½" EMT conduit C is supported by the bender assembly 10 and the rod 98 is positioned in the arcuate slot 94 relatively close to the base 18. In FIG. 26, 1" RMC conduit C is supported, and, notably, the rod 98 is positioned in the arcuate slot 94 relatively farther from the base 18.

FIGS. 49-53 illustrate an alternative construction of a bender assembly 10' with additional indicia including, but are not limited to shoe hook indicia 302, shoe channel indicia 306, a bend angle indicator 310, indicia 314, and conduit markings 318. The shoe hook indicia 302 indicates at least one of the size and type of conduit which each hook 146, 150 is dimensioned to engage. The illustrated shoe hook indicia 302 is located directly adjacent each hook surface 146*a*, 146*b*, 150*a*, 150*b*, and optionally may be positioned on each hook 146, 150.

Figure 49A:
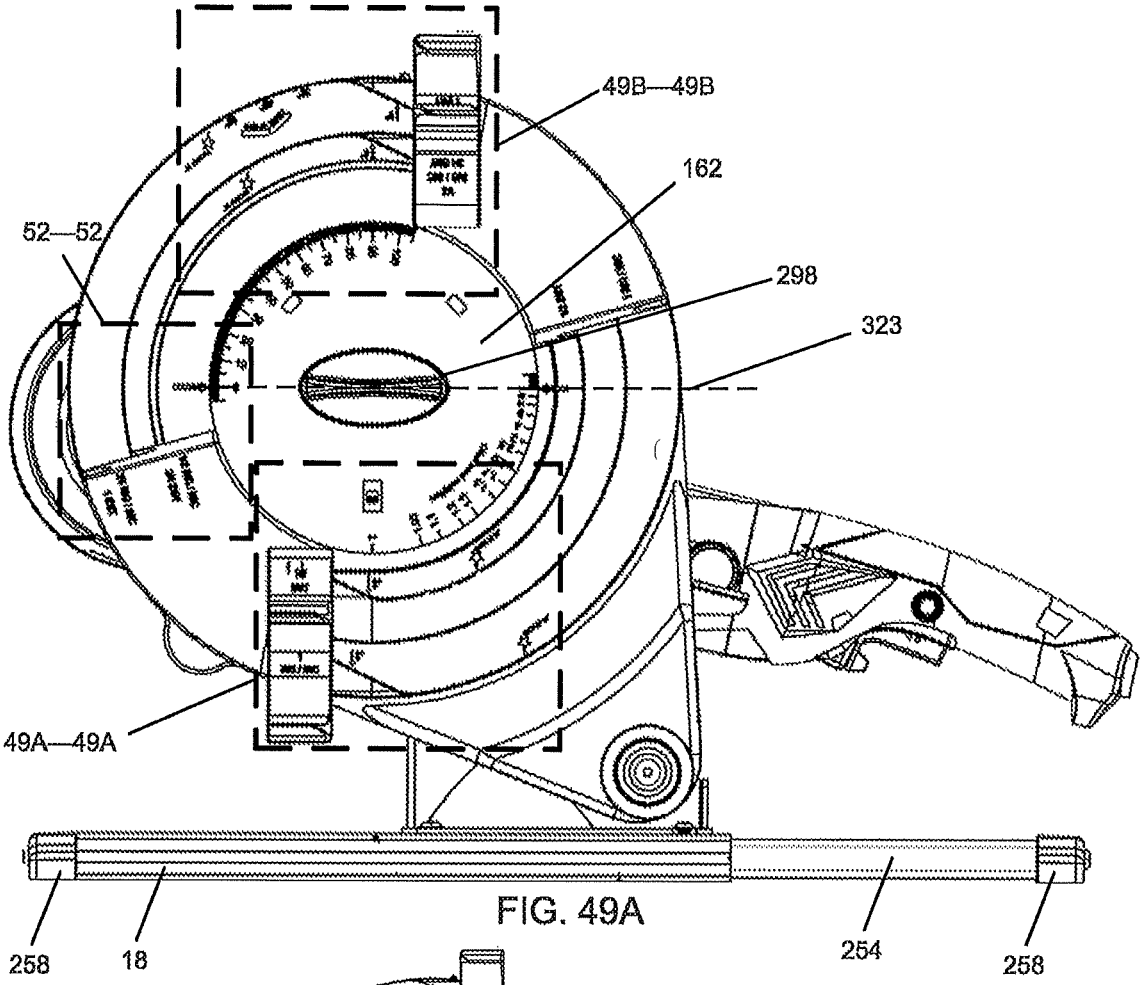
FIG. 49A-49B are front views of an alternate bender assembly, illustrating additional indicia.
Figure 49B:
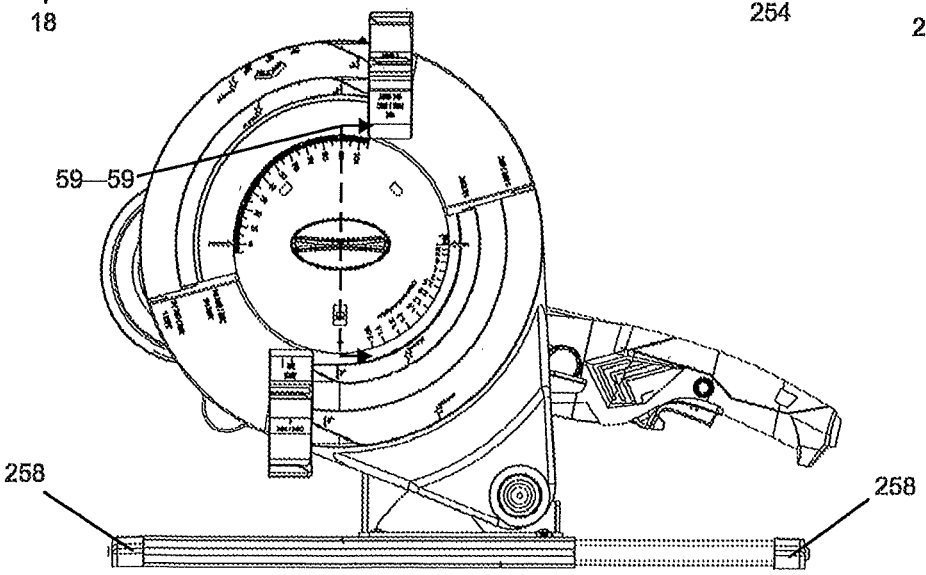
Figure 54:
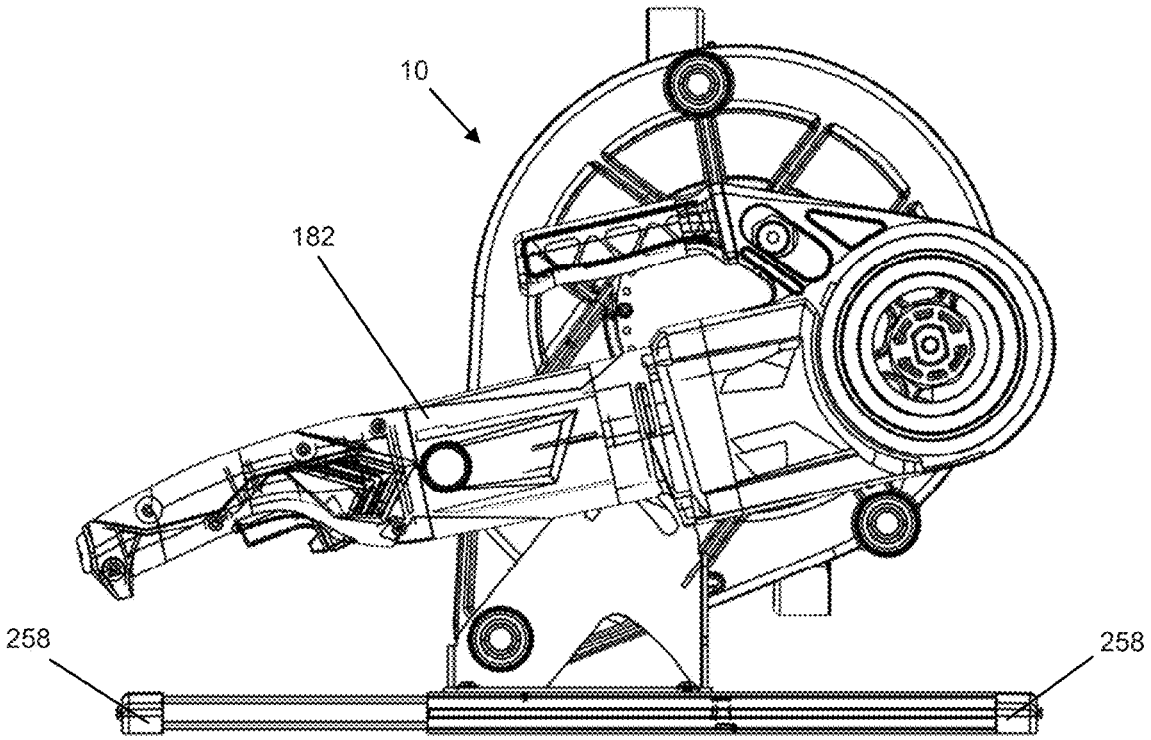
FIG. 54 is a rear view of the bender assembly shown in FIG. 49A, illustrated with the pipe threader.

As illustrated in FIG. 49A, the bender assembly 10' includes a base 18 engaging a base foot 258. A base extension 254 telescopically engages the base 18 at an end opposite the foot 258. Another foot 258 is provided at the end of the extension 254 opposite the foot 258 which directly engages the base 18. Both feet 258 are also illustrated in at least FIGS. 49B and 54-55.

The shoe channel indicia 306 indicate at least one of the cross-sectional size and type of conduit which each channel 122, 126, 130, 134 is dimensioned to engage. The shoe channel indicia 306 may indicate more than one size and type of conduit which the particular channel 122, 126, 130, 134 can engage. The illustrated shoe channel indicia 306 is positioned on the shoe 34 at an end of each channel 122, 126, 130, 134 opposite the hook 146, 150.

The illustrated conduit markings 318 include a deduct arrow 322 which indicates a start location of a bend in conduit C as a turn is formed in the conduit C. As illustrated, the start location is offset from the hook 146, 150 in a direction along the base axis 42 and towards the roller axis 30. In other words, the start location is between the hook 146, 150 and the roller 26 prior to bending. The illustrated conduit markings 318 also include a back of bend indicia 326 which indicates a terminal angle for a desired bend. In the illustrated embodiment, the back of bend indicia 326 are positioned on the shoe 34 adjacent the channels 122, 126, 130, 134 at a location indicating a back of bend of a common bend angle (e.g., 90 degrees).

The illustrated indicia 314 indicates a distance from the deduct arrow 322 to the outside of a 90° bend in the conduit C after bending when using a given channel 122, 126, 130, 134. The indicia 314 is positioned on the shoe 34 adjacent the deduct arrow 322. In the illustrated construction, the positions of the arrows 322 are shifted slightly from a centerline 323 of the shoe 34 so that calculating a "stub up" height is made easier.

Figure 50A:
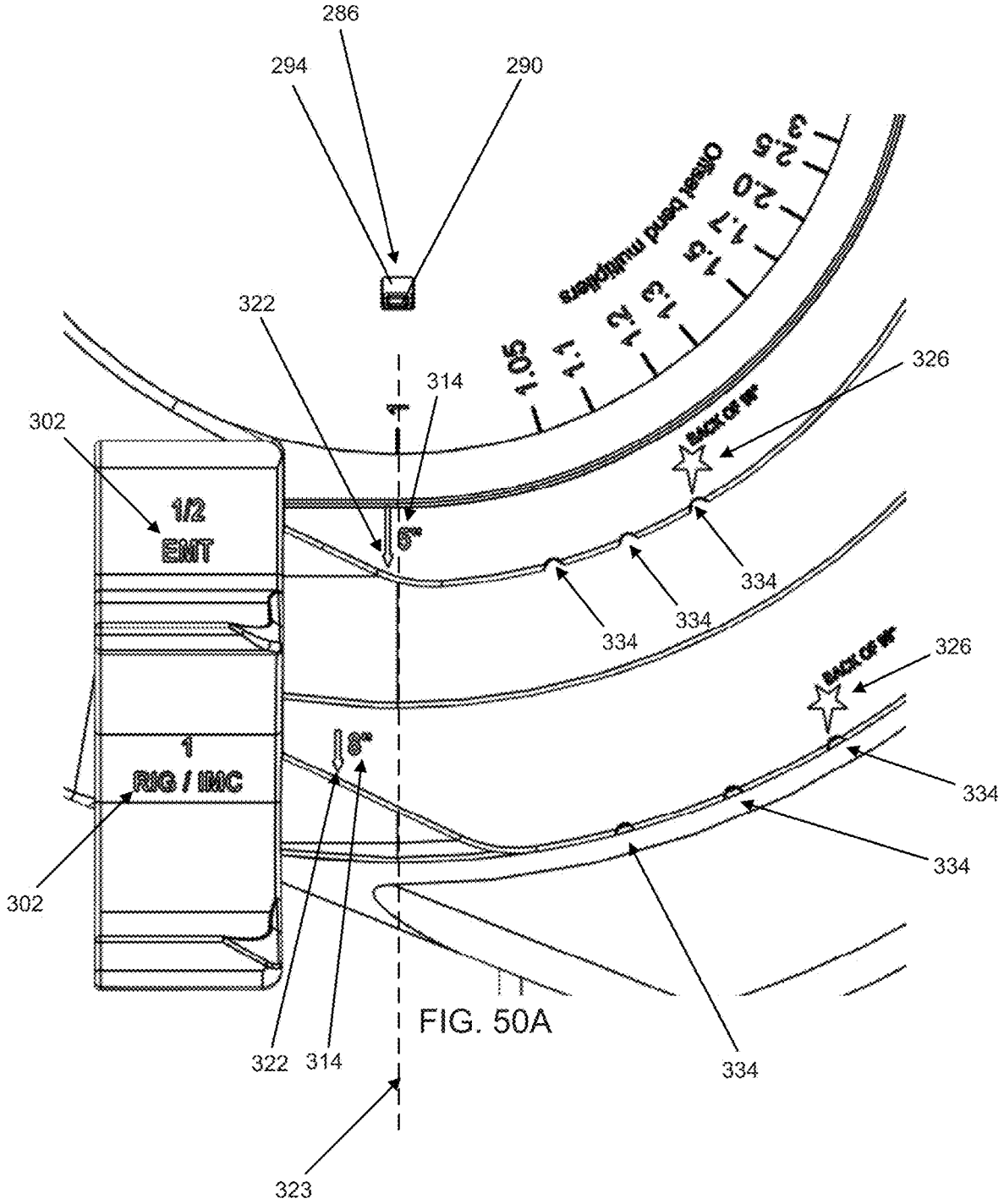
FIG. 50A is an enlarged front view of the portion of the bender assembly in section 49A-49A of FIG. 49A.
Figure 50B:
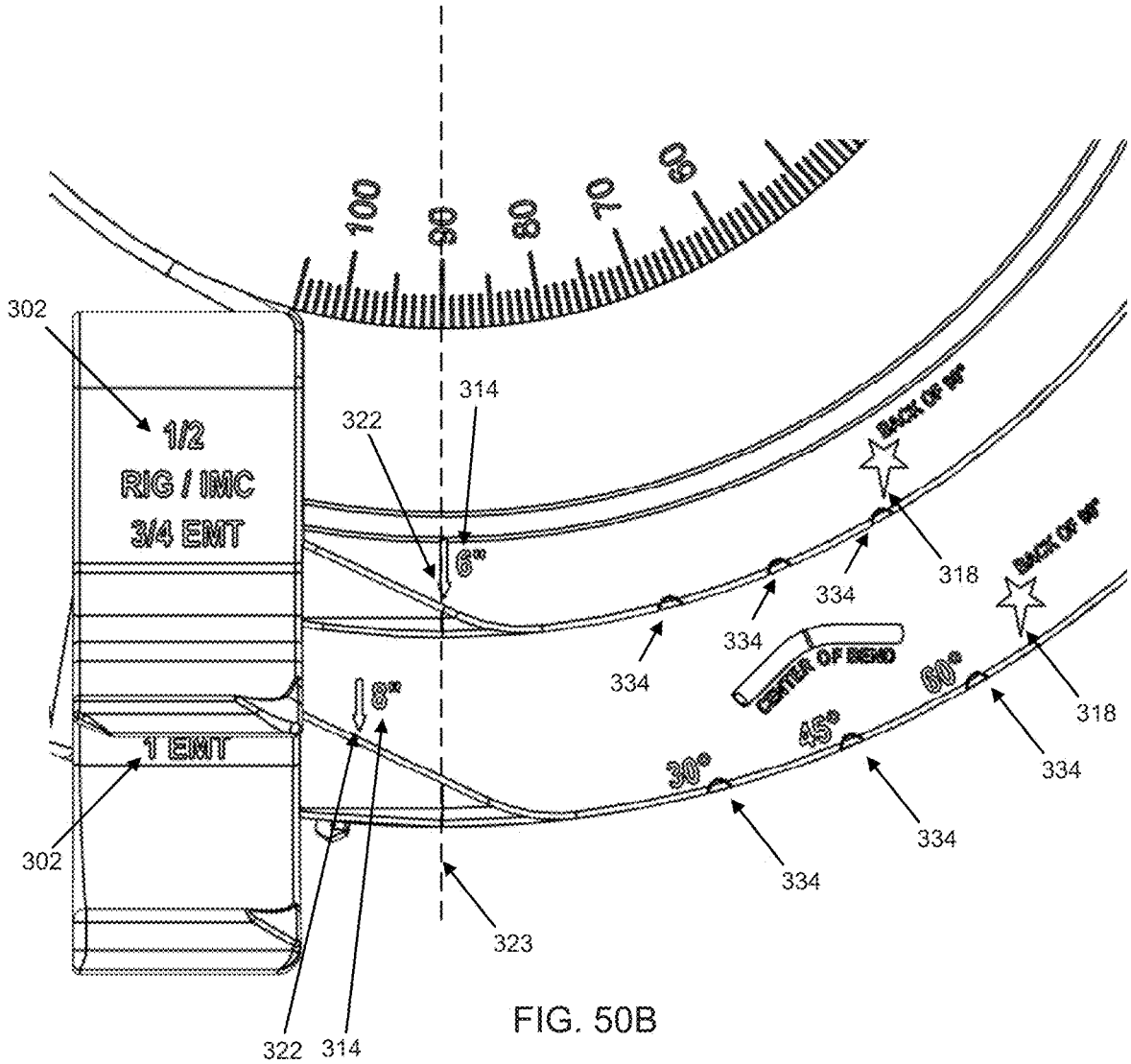
FIG. 50B is an enlarged front view of the portion of the bender assembly in section 49B-49B of FIG. 49A.
Figure 50C:
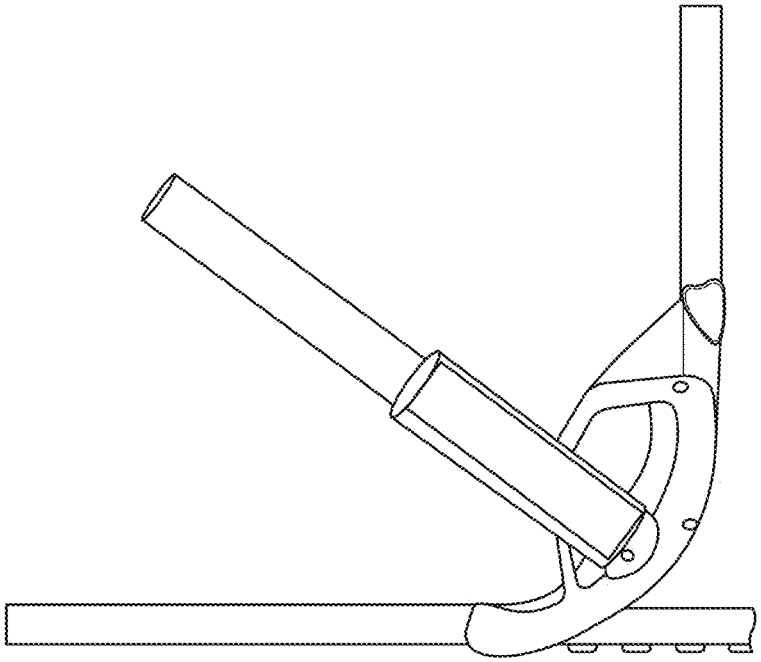
FIG. 50C (PRIOR ART)
FIG. 50C is a side view of a manual bender known in the prior art making a "stub up" bend in conduit.

For example, if an 11" stub-up bend is desired, the value of the indicia 314 (e.g., 8") is subtracted from 11" to determine the location for a mark on the conduit C (e.g., 11"−8"=3" from the end of the conduit C). The mark on the conduit C is aligned with the arrow 322, and a 90° bend is made in the conduit C. For reference, such a "stub up" bend, as made by a manual bender, is illustrated in FIG. 50C.

The illustrated conduit markings 318 also include at least one center of bend angle marking 334 indicating a common bend angle for a desired three-point saddle bend. As illustrated, the center of bend angle marking 334 is positioned on the shoe 34 adjacent the channels 122, 126, 130, 134 at a location indicating a center of bend of at least two common bend angles (e.g., 30, 45, 60 degrees).

Figure 51:
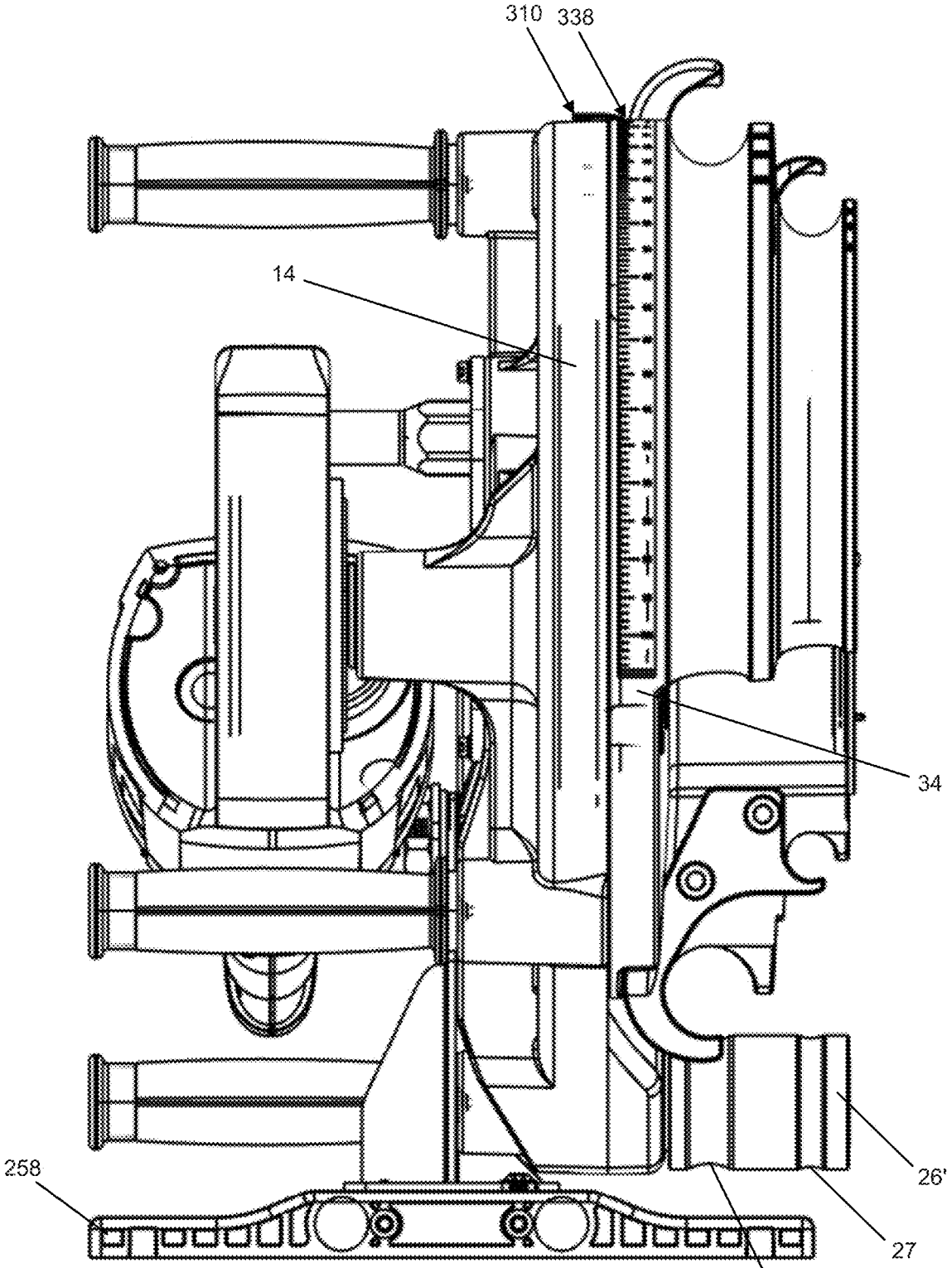
FIG. 51 is an end view of the bender assembly shown in FIG. 49A.
Figure 52:
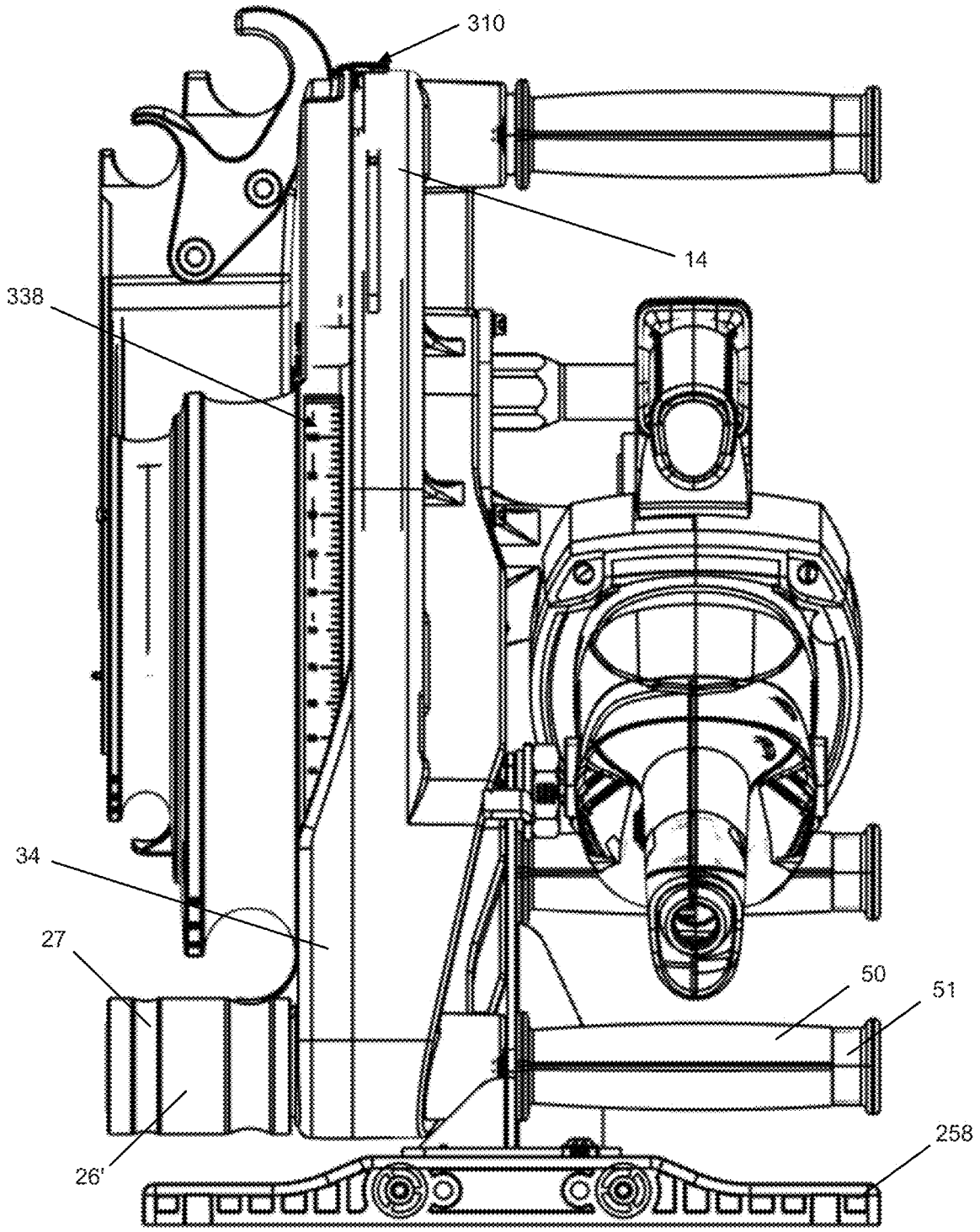
FIG. 52 is an opposite end view of the bender assembly of FIG. 49A.
Figure 53:
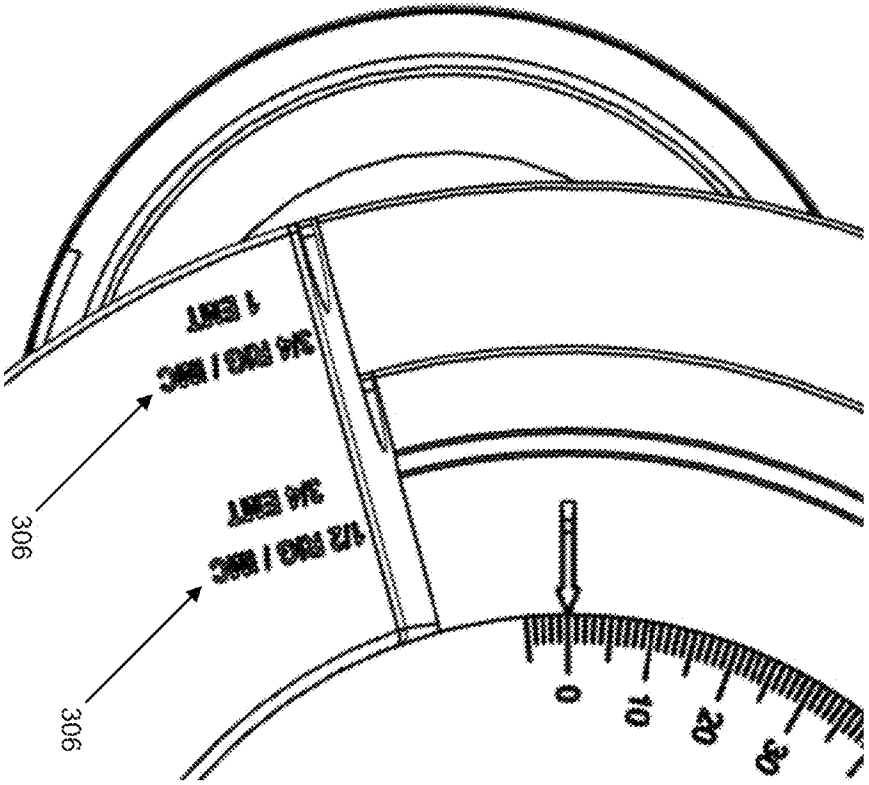
FIG. 53 is an enlarged front view of the portion of the bender assembly in section 52-52 of FIG. 49A.

FIGS. 51-52 illustrate a bend angle scale 338 positioned on a side face of the shoe 34. The housing 14 includes a bend angle indicator 310 which cooperates with the scale 338. As the shoe 34 is rotated, the scale 338 rotates to the corresponding bend angle which is indicated by the bend angle indicator 310. The scale 338 and the bend angle indicator 310 provide means for an operator to view the present bend angle of the shoe 34 relative to the housing 14 from an operating position parallel to the base axis 42. As illustrated, the bend angle indicator 310 and scales 338 may be provided adjacent each of the channels 122, 126, 130, 134.

Each of the additional indicia may be formed using various methods. The additional indicia may be provided by, for example, one of pad printing, laser engraving, casting, sheet printing and applying a sticker, or subtractive detenting or holing.

The additional indicia may be shaped to accurately depict a specific point on the bender assembly 10'. For example, the deduct arrow 322 may point at a specific location on the shoe 34, the bend angle indicator 310 may be a cylindrical notch positioned at a specific location on the shoe 34, and the back of bend indicia 326 may be an irregular pointed star with the irregular point positioned adjacent a specific location on the shoe 34. The bend angle scale 338 may be positioned in a raceway 342 of the shoe such that the scale 338 does not protrude radially outwardly from the housing axis 38 and from within the raceway 342.

FIGS. 51-52 illustrate an alternate roller 26' including at least one conduit engagement groove 27 which serves to center the conduit C on the roller 26' relative to the shoe 34 prior to, during, and after bending. In the illustrated embodiment, the roller 26' includes one conduit engagement groove 27 corresponding with the channels 122, 130 and another conduit engagement groove 27 corresponding with the channels 126, 134. The conduit C engages the hook 246, 250, the shoe 34, and the conduit engagement groove 27 of the roller 26' which fixes the position of the conduit C in a direction parallel to the housing axis 38 (see FIG. 1).

Figure 61:
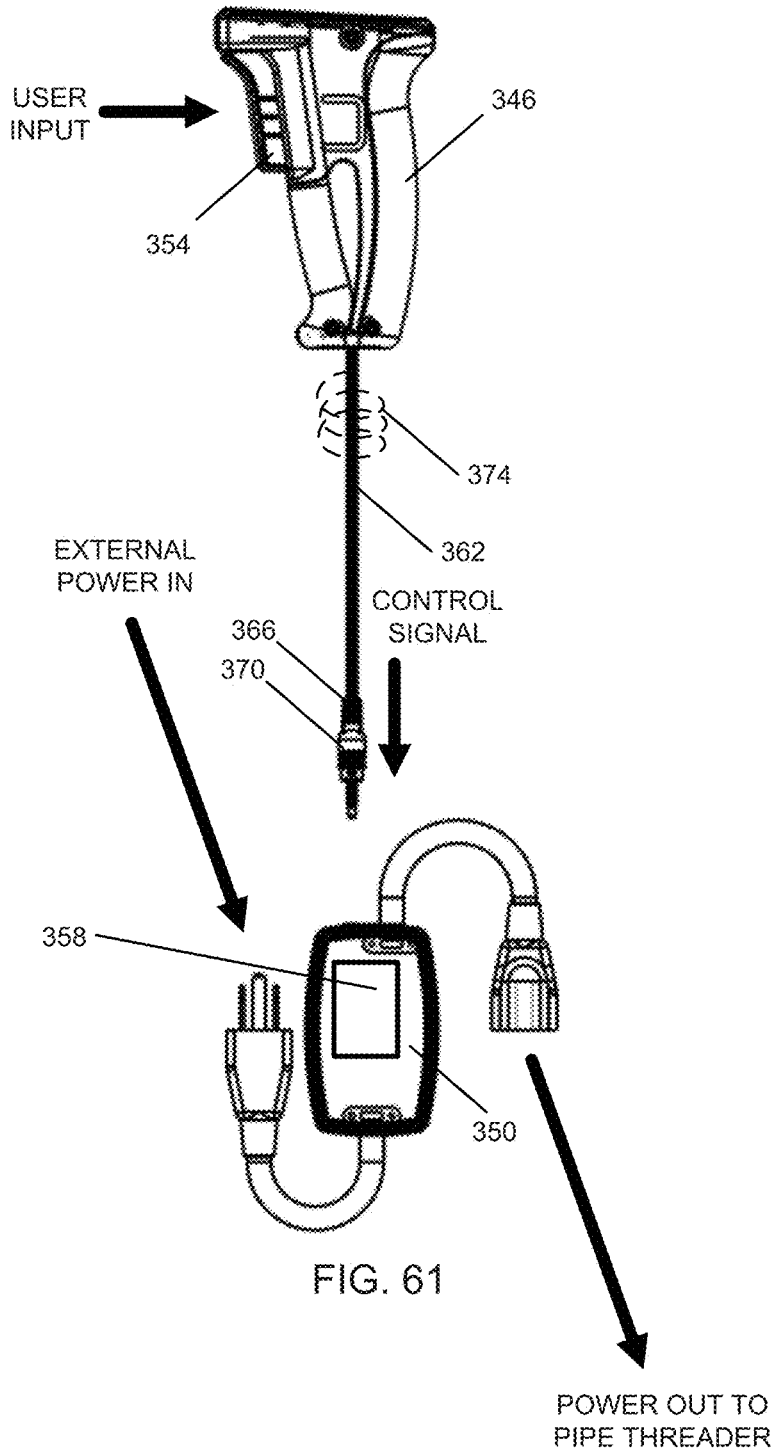
FIG. 61 is a diagram of a remote pendant and control electronics housing.

FIG. 61 illustrates a remote pendant 346 and a housing 350 with control electronics 358 operable to remotely control the bender assembly 10, 10'. In other embodiments (not shown), the remote pendant 346 and the control electronics 358 may be combined as a single structure.

The pendant 346 includes a trigger 354 which can be depressed to send a signal via a communication link (e.g., a wire 362 (illustrated as a light gauge cable for carrying a low voltage control signal)) to the control electronics 358. The control electronics 358 receives the signal from the trigger 354 of the pendant 346, receives power from an external source (through a heavy gauge cable for carrying higher voltages), and, based on the signal from the trigger 354, provides power to the pipe threader 182 (through the heavy gauge cable). In the illustrated embodiment, the control electronics 358 include at least one transistor which outputs the signal based on the position of the trigger 354. In other embodiments, the control electronics 358 may include a potentiometer or similar device to influence the output signal based on the position of the trigger 354.

The wire 362 between the pendant 346 and the control electronics housing 350 is lightweight, coiled, and optionally has a stress reducing feature 366. In the illustrated embodiment, with the lightweight wire 362, the pendant 346 can be placed on the work surface W without falling from or otherwise moving on the work surface W. The wire 362 may have an outlet end 370 configured as a standard male audio jack such as a 3.5 mm audio jack, etc.

In some embodiments, the coiled segment 374 of the wire 362 shortens the length of the wire 362 when not tensioned while allowing an increased distance when tensioned from the control electronics housing 350. In the illustrated embodiment, the un-coiled length (e.g., when under tension) of the wire 362 is about 6 feet and, when relaxed, about 4 or 5 feet long. Other lengths of wire 362 may also be appropriate.

As illustrated, the wire 362 includes a stress reducing feature 366 positioned adjacent the control electronics housing 350 and/or the outlet end 370 (as shown). The stress reducing feature 366 may reduce damage on the wire 362 due to tension, tensile stress, or other stresses.

Figure 62:
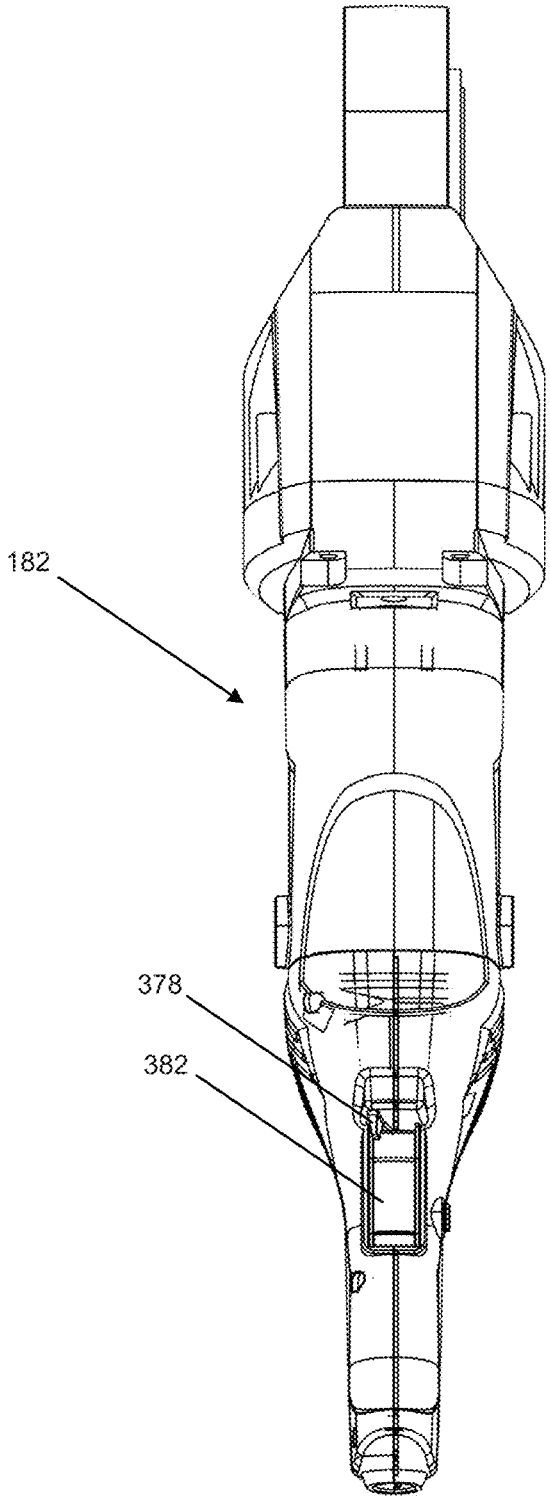
FIG. 62 is a bottom view of the pipe threader, illustrating a trigger lock.

The pipe threader 182 can be operated remotely from the bender assembly 10, 10'. In some embodiments, as illustrated in FIG. 62, the pipe threader 182 has a trigger lock 378 operable to maintain a pipe threader trigger 382 in the engaged (i.e., "ON") position. With the trigger lock 378 engaged, an operator can operate the trigger 354 of the pendant 346 remotely from the assembly 10 to supply power to the pipe threader 182, turn the shoe 34, and bend the conduit C between the hook 146, 150 and the roller 26.

Figure 63:
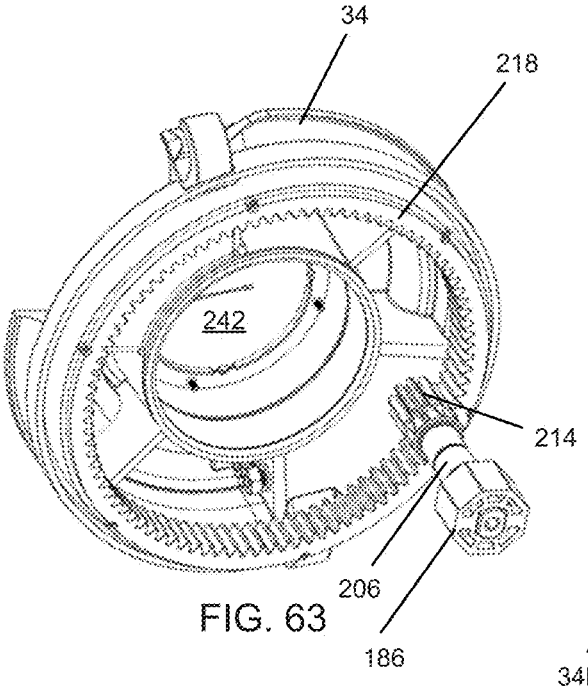
FIG. 63 is a rear perspective view of the shoe, the ring gear, and the spur gear.
Figure 64:
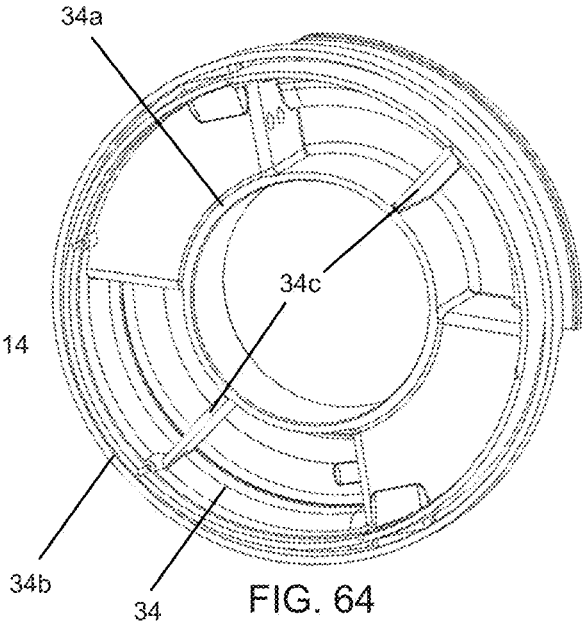
FIG. 64 is a rear perspective view of the shoe.

As shown in FIGS. 63-64, the shoe 34 has a radially-inner cylinder 34*a* and a radially-outer cylinder 34*b* connected by ribs 34*c*. The cylinders 34*a*, 34*b* define therebetween an annular space accommodating the structure and avoiding inhibiting operation of the drive mechanism 178 (e.g., the spur gear 214 and the ring gear 218 or another drive mechanism).

Figure 65:
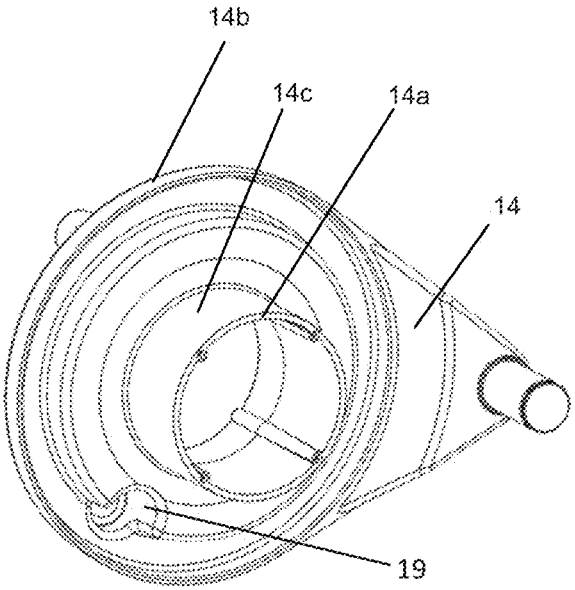
FIG. 65 is a front perspective view of the housing.
Figure 66:
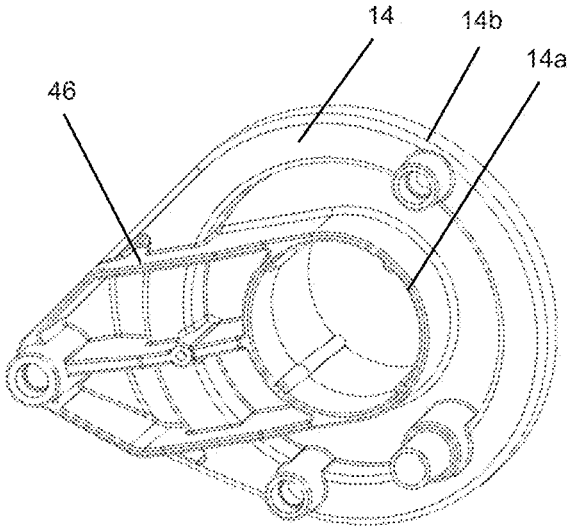
FIG. 66 is a rear perspective view of the housing.
Figure 67:
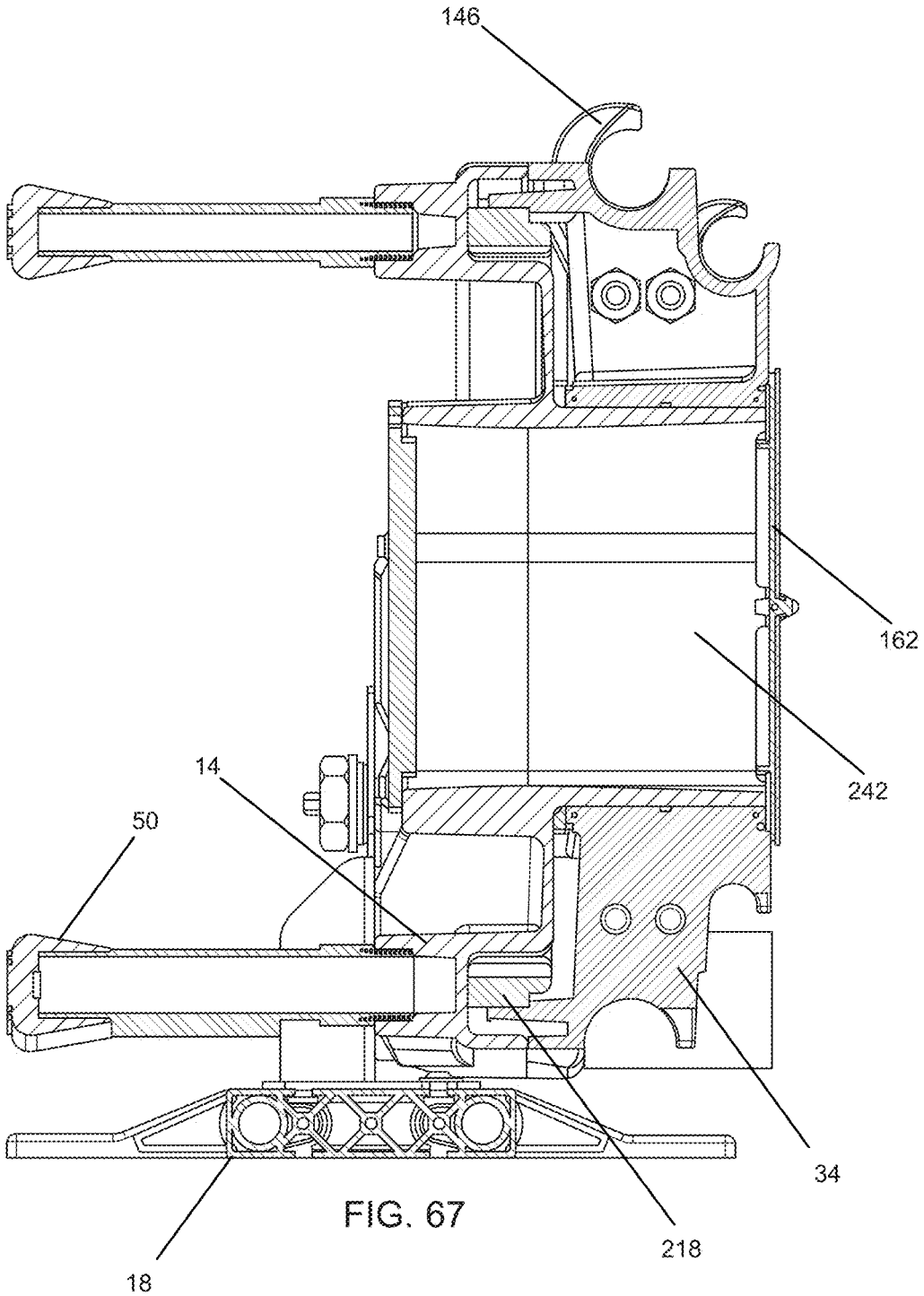
FIG. 67 is a cross sectional view of the bender assembly, taken generally along line 67-67 in FIG. 6.
Figure 68:
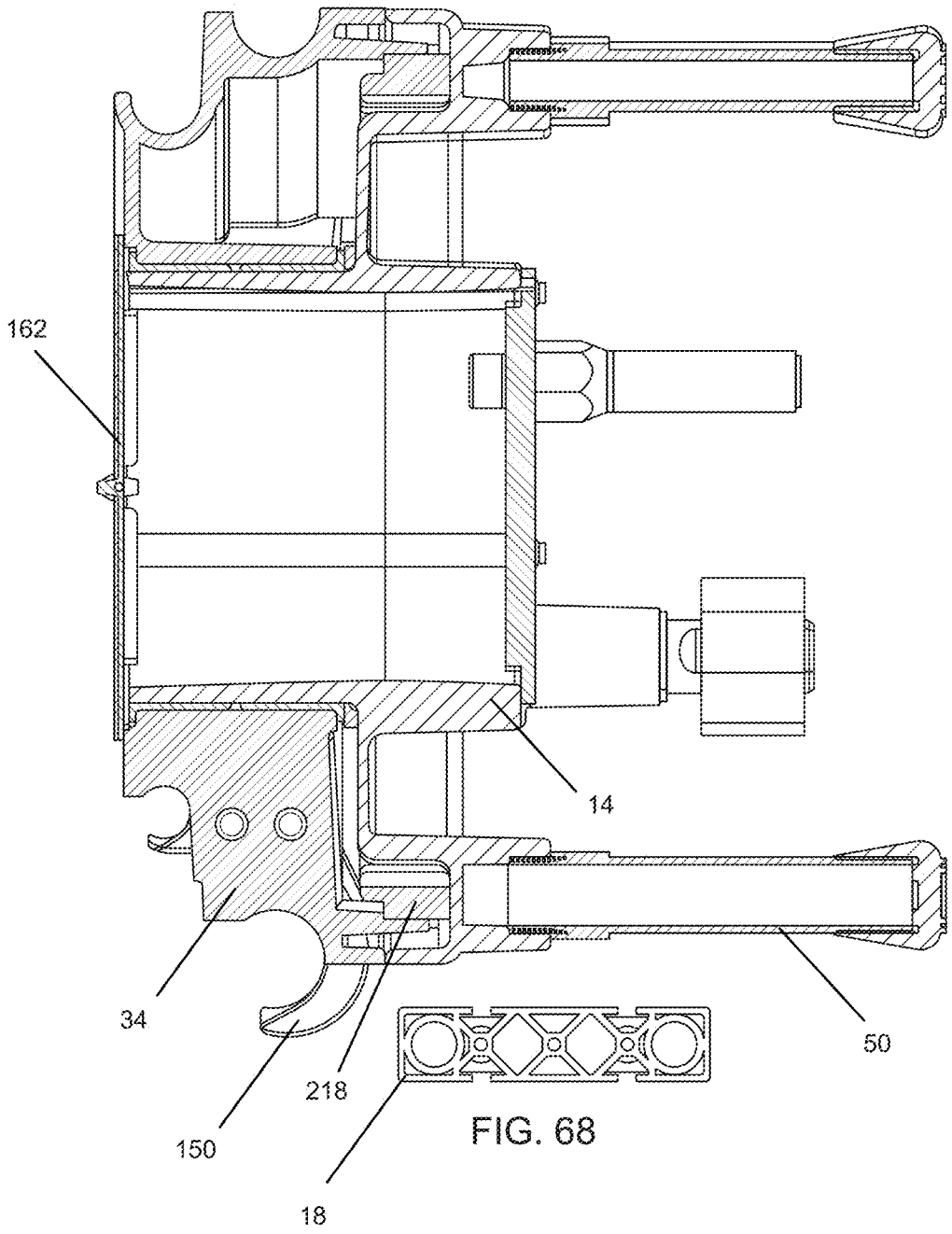
FIG. 68 is a cross sectional view of the bender assembly, taken generally along line 68-68 in FIG. 6.
Figure 69:
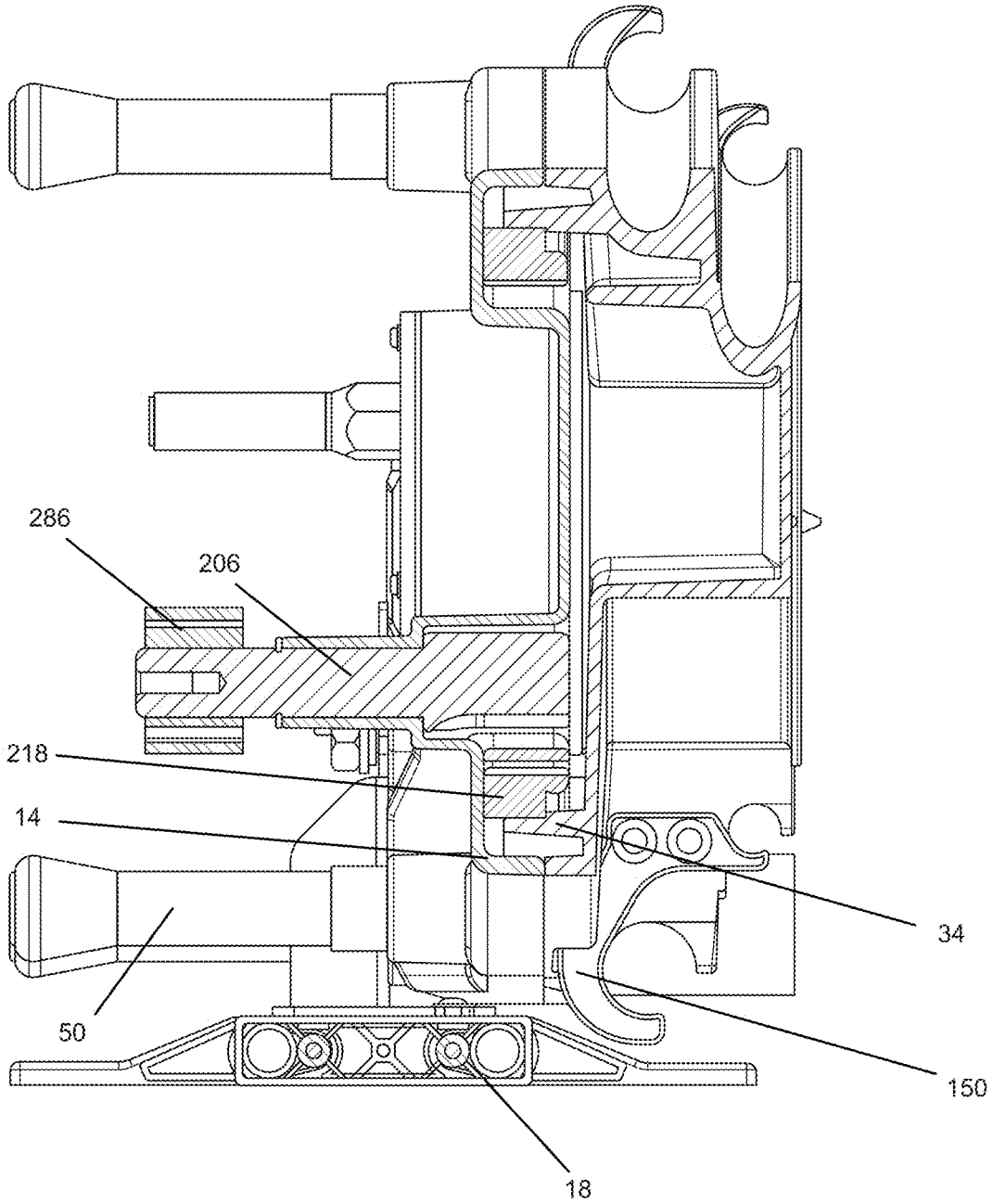
FIG. 69 is a cross sectional view of the bender assembly, taken generally along line 69-69 in FIG. 6 and illustrating the drive mechanism.
Figure 70:
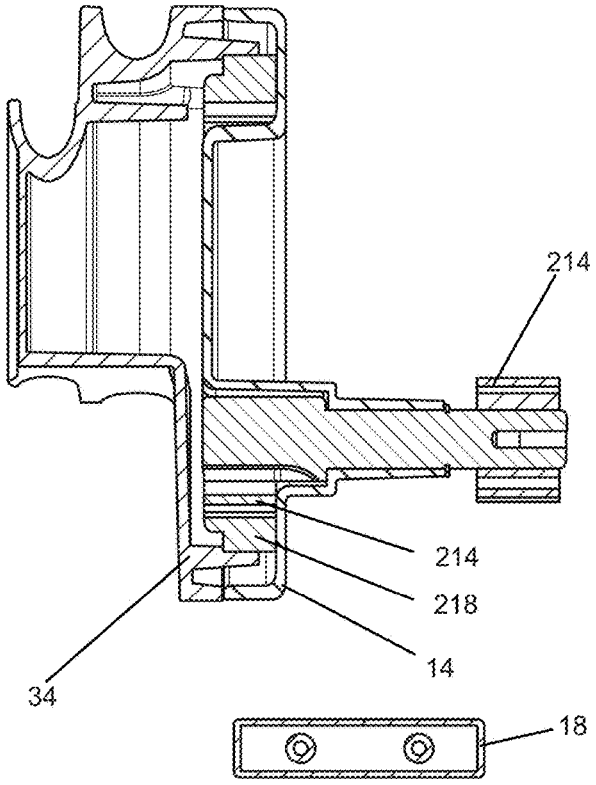
FIG. 70 is a cross sectional view of the bender assembly, taken generally along line 70-70 in FIG. 6 and illustrating the drive mechanism.
Figure 71:
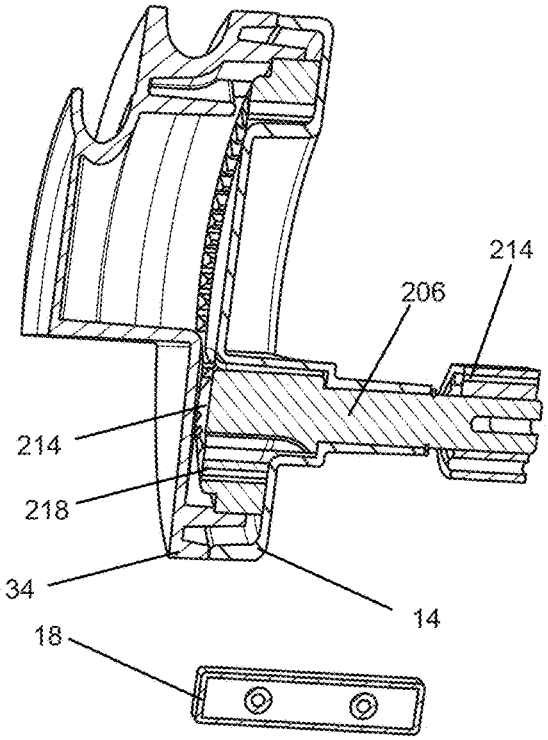
FIG. 71 is a perspective cross sectional view of the bender assembly, taken generally along line 70-70 in FIG. 6 and illustrating the engagement of the spur gear and the ring gear.

FIGS. 65-66 illustrate the housing 14 as having complementary inner and outer cylinders 14*a*, 14*b* rotatably supporting the shoe cylinders 34*a*, 34*b* (see FIGS. 67-68) through bearings. The housing inner cylinder 14*a* generally defines the perimeter of the space 242. The housing inner cylinder 14*a* includes a spindle surface 14*c* dimensioned to correspond with the size of the shoe inner cylinder 34*a*. As such, the shoe inner cylinder 34*a* is operable to rotate about the spindle surface 14*c* when the spur gear 214 and, thus, the ring gear 218 are rotated.

The relative size in diameter between the inner cylinder 14*a* and the spindle surface 14*c* define a thickness of the spindle wall. The illustrated spindle is relatively thin walled, thereby reducing the weight of the housing 14. In the illustrated embodiment, the inner cylinder 14*a* has a diameter of between about 4 inches (in.) and about 6 in. (e.g., about 5.3 in.), and the spindle surface 14*c* has a diameter of between about 5 in. and about 7 in. (e.g., about 6.1 in.). In the illustrated embodiment, the wall thickness is between about 0.1 in. and about 1.5 in. (e.g., about 0.4 in.). The ratio of the wall thickness to the radius of the inner cylinder 14*a* (e.g., about 3.05 inches, as illustrated) is between about 1:12 and 1:2 (e.g., about 1:8). As illustrated, the wall thickness is about 13.1% of the radius, to avoid distortion under load.

In other constructions (not shown), the wall thickness may be decreased for a larger radius inner cylinder 14*a* and may be increased for a smaller radius inner cylinder 14*a*. The ratio of the wall thickness to the radius of the inner cylinder 14*a* may be determined based on, for example, the material of the housing, expected loading, a desired factor of safety, the outer diameter of the spindle surface 14*c*, and a variety of other factors.

With a large spindle surface 14*c*, the hollow spindle defines a large open space 242 (e.g., as a storage compartment) and also reduces the weight of the housing 14. The larger spindle also reduces the material and weight of the annular shoe 34, eliminating excess material of the shoe 34 extending inwardly to the housing axis 38. In the illustrated embodiment, the shoe 34 has an inner diameter generally corresponding to the outer diameter of the spindle surface 14*c* (e.g., about 6.1 in.). The shoe 34 extends to an outer diameter of between about 10 in. and about 15 in. (e.g., about 12.9 in.). In the illustrated construction, the ratio of the diameter of the spindle surface 14*c* to the diameter of the shoe outer surface is between about 1:4 to about 1:1.5 (e.g., about 1:2 as illustrated). As illustrated, the spindle diameter is about 45% to about 50% (e.g., about 47.29%) the outer diameter of the shoe 34.

To, for example, maintain desired bending capabilities of 1" EMT without changing the radius of the channel 126, the ratio of the diameter of the spindle surface 14*c* to the diameter of the shoe outer surface may be between about 1:1.7 and about 1:7.5. It should be understood, however, that other ratios may be possible.

The arrangement of the drive mechanism 178 (of the spur gear 214 and the ring gear 218), the size of the shoe inner cylinder 34*a* and the size of the housing inner cylinder 14*a* allows for the space 242 to have a sufficient size for storage (e.g., to hold the remote pendant 346, a power cord, other devices, supplies, etc.). In other constructions (not shown), the space 242 may accommodate other structure (e.g., a motor).

The structure of the hollow spindle/inner cylinder 14*a* may reduce material of the housing 14 and allow the spindle to be made as a cast part (e.g., a cast aluminum housing 14) compared to a separate shaft or tube. The illustrated roller support portion 19 is formed with the housing 14. The inner cylinder 14*a* and the support portion 19 are cast with the housing 14 and thereafter machined to have the desired precise dimensions. The inner cylinder 14 a and the support portion 14 are hard anodized. In the illustrated embodiment, the housing 14 is formed of cast A380-F aluminum.

In other embodiments, the housing 14 may be formed of a different material, such as, for example, A356-T6 aluminum, cast iron, a zinc-aluminum alloy (e.g., ZA-27), etc. A polymer spindle bearing may be used between the shoe 34 and the housing 14. In other constructions (not shown), the housing 14 may include a smaller-diameter solid spindle.

In the illustrated construction, the shoe 34 and the housing 14 are connected for relative pivoting movement during bending operations but are otherwise fixed. In some embodiments (not shown), the shoe 34 may be removable from the housing 14 (e.g., for substitution with a different shoe 34 to bend different types of conduits C, for replacement of the shoe 34/the housing 14 due to wear or damage, for transport/storage, etc.). In yet other embodiments (not shown), one or more portions of the shoe 34 (e.g., portions defining the channels 122, 126, 130, 134, the hooks 150, 154) may be removable and replaceable.

FIGS. 18-19, 63 and 69-71 illustrate the drive assembly of the bender assembly 10. In the illustrated embodiment, the drive assembly includes the primary adapter 186, the shaft 206, and the spur gear 214, supported on the housing 14, and the ring gear 218 fixed to the shoe 34. The pipe threader 182 provides drive input to the adapter 186, causing the shaft 206 and spur gear 214 to rotatably drive the ring gear 218 and the shoe 34.

In other embodiments (not shown), the bender assembly 10 may include a different drive assembly for rotating the shoe 34. Such other drive assemblies may include different gear assemblies (e.g., an external ring gear, bevel gears, a face gears, roller chains, etc.). As described above, an onboard motor and gearbox and power source may be housed within the space 242.

The bender assembly 10, 10' is configured to receive commands from an electronic controller of the control system to conduct a bending process. The unit is communicatively connected to the electronic controller via one or more communication links and, in this example, via a wired connection; however, in some embodiments, the bender assembly 10, 10' may be communicatively connected over a wireless network or a short-range wireless connection.

The electronic controller includes a plurality of electrical and electronic components that provide power, operation control, and protection to the components and modules within the electronic controller. The illustrated electronic controller includes, among other things, an electronic processor (such as a programmable electronic microprocessor, microcontroller, or similar device), a memory, a communication interface, and a display. In some embodiments, the electronic controller is incorporated into the unit or may be a separate computing device, such as a laptop computer, a tablet computer, a smart phone, a smart watch, etc.

The memory is, for example, a non-transitory, machine-readable memory. The communication interface is communicatively connected to the bender assembly 10, 10'. The electronic processor is communicatively connected to the memory, and the communication interface. The memory includes a bender engine (for example, software or a set of computer-readable instructions that determines commands to be sent to the bender assembly 10, 10').

The electronic controller may be implemented in several independent controllers each configured to perform specific functions or sub-functions. Additionally, the electronic controller may contain sub-modules that include additional electronic processors, memory, or application specific integrated circuits (ASICs) for handling communication functions, processing of signals, and application of the methods listed below. In other embodiments, the electronic controller includes additional, fewer, or different components.

The communication interface coordinates the communication of information between the electronic processor and the bender assembly 10, 10'. In the example illustrated, information received from the display is provided to the electronic processor to assist in determining what commands will be executed by the bender engine. The determined commands are then provided from the electronic processor to the communication interface where the commands are transmitted to the bender assembly 10, 10'. In other embodiments, the information received from the display may be provided without a display and may be, for example, transmitted from a remote server where the information is stored in a storage medium, such as a database.

The memory can include one or more non-transitory machine-readable media, and includes a program storage area and a data storage area. The program storage area and the data storage area can include combinations of different types of memory, as described herein. In some embodiments, data is stored in a non-volatile random-access memory (NVRAM) of the memory. Furthermore, in some embodiments, the memory stores predetermined factors with which to adjust commands for the bender assembly 10, 10'.

The control system may include a user interface provided on a display to operate with the bender assembly 10, 10' with various parameters (set bend angle, current bend angle, etc.) being output/displayed to an operator and various inputs (e.g., bend angle, type of bend, start/stop operation, etc.) being received from the operator.

The embodiment(s) described above and illustrated in the figures are presented by way of example only and are not intended as a limitation upon the concepts and principles of the present disclosure. As such, it will be appreciated that variations and modifications to the elements and their configuration and/or arrangement exist within the spirit and scope of one or more independent aspects as described.

What is claimed is:

1. A portable bender comprising:

a base supportable on a work surface;

a housing supported by the base, the housing including a hollow spindle having an outer surface and defining a housing axis;

an annular shoe extending from an inner surface supported by the outer surface of the spindle for pivoting movement about the housing axis, the shoe defining a channel for supporting conduit to be bent, the shoe being pivotable about the housing axis to bend the conduit; and a gear assembly operable to drive the shoe, the gear assembly including a ring gear connected to the shoe, a spur gear meshed with the ring gear, and an input shaft supporting the ring gear and supported by the housing for rotation about a shaft axis, the input shaft being drivable to rotate the spur gear about the shaft axis to thereby pivot the ring gear and the shoe about the housing axis;

wherein the shaft axis extends parallel to and is offset from the housing axis.

2. The bender of claim 1, wherein the outer surface of the spindle defines a spindle outer diameter, wherein the inner surface of the shoe defines a shoe inner diameter, the shoe having a shoe outer diameter and extending between the shoe inner diameter and the shoe outer diameter, and wherein a spindle-to-shoe ratio of the spindle outer diameter to the shoe outer diameter is at least about 1:4.

3. The bender of claim 2, wherein the spindle-to-shoe ratio is up to about 1:2.

4. The bender of claim 1, wherein the outer surface of the spindle defines a spindle radius, the spindle having a wall thickness, a thickness-to-radius ratio of the wall thickness to the spindle radius being no more than 1:2.

5. The bender of claim 4, wherein the thickness-to-radius ratio is about 1:8.

6. The bender of claim 1, wherein the spindle has an open end and defines a storage compartment accessible through the open end.

7. A portable bender comprising:

a base supportable on a work surface;

a housing supported by the base, the housing including a hollow spindle having an outer surface and defining a housing axis;

an annular shoe extending from an inner surface supported by the outer surface of the spindle for pivoting movement about the housing axis, the shoe defining a first channel and a second channel for supporting a first conduit and a second conduit, respectively, to be bent, the shoe being pivotable about the housing axis to bend the conduit;

wherein the first channel supports the first conduit up to a first diameter, and the shoe defines the second channel for supporting the second conduit up to a second diameter, the second diameter being greater than the first diameter, the shoe pivoting relative to the housing to selectively bend one of the first conduit and the second conduit when supported by the shoe;

a gear assembly operable to drive the shoe, the gear assembly including a ring gear connected to the shoe, a spur gear meshed with the ring gear, and an input shaft supporting the ring gear and supported by the housing for rotation about a shaft axis, the input shaft being drivable to rotate the spur gear about the shaft axis to thereby pivot the ring gear and the shoe about the housing axis; and a drive mechanism operable to pivotably drive the shoe relative to the housing to bend one of the conduits;

wherein the shaft axis extends parallel to and is offset from the housing axis.

8. The bender of claim 7, wherein the first channel and the second channel are in a first segment of the shoe, the shoe defining a third channel for supporting a third conduit up to a third diameter and a fourth channel for supporting a fourth conduit up to a fourth diameter, the third diameter being different than the first diameter and the second diameter, the fourth diameter being greater than the first diameter and the third diameter and different than the second diameter, the third channel and the fourth channel being in a second segment of the shoe, and wherein the shoe is pivotable relative to the housing to selectively orient one of the first segment and the second segment.

9. The bender of claim 7, further comprising a drive mechanism operable to pivotably drive the shoe relative to the housing to bend one of the first conduit and the second conduit.

10. A portable bender comprising:

a base supportable on a work surface;

a housing supported by the base, the housing including a hollow spindle having an outer surface and defining a housing axis; and an annular shoe extending from an inner surface supported by the outer surface of the spindle for pivoting movement about the housing axis, the shoe defining a first channel and a second channel for supporting a first conduit and a second conduit, respectively, to be bent, the shoe being pivotable about the housing axis to bend the conduit;

wherein the first channel supports the first conduit up to a first diameter, and the shoe defines the second channel for supporting the second conduit up to a second diameter, the second diameter being greater than the first diameter, the shoe pivoting relative to the housing to selectively bend one of the conduits;

a gear assembly operable to drive the shoe, the gear assembly including an input shaft supported by the housing for rotation about a shaft axis;

wherein the shaft axis extends parallel to and is offset from the housing axis.

11. The bender of claim 10, further comprising a drive mechanism operable to pivotably drive the shoe relative to the housing to bend one of the first conduit and the second conduit.

12. The bender of claim 10, wherein the spindle has an open end and defines a storage compartment accessible through the open end.

13. The bender of claim 10, wherein the gear assembly further comprises a ring gear connected to the shoe, a spur gear meshed with the ring gear, and the input shaft supporting the ring gear and supported by the housing for rotation about the shaft axis, the input shaft being drivable to rotate the spur gear about the shaft axis to thereby pivot the ring gear and the shoe about the housing axis.

* * * * *